US007291448B2

(12) United States Patent
Sakai et al.

(10) Patent No.: US 7,291,448 B2
(45) Date of Patent: Nov. 6, 2007

(54) PHOTOTHERMOGRAPHIC MATERIAL

(75) Inventors: Minoru Sakai, Kanagawa (JP); Yasuhiro Yoshioka, Kanagawa (JP)

(73) Assignee: Fujifilm Corporation, Tokyo (JP)

( * ) Notice: Subject to any disclaimer, the term of this patent is extended or adjusted under 35 U.S.C. 154(b) by 0 days.

(21) Appl. No.: 11/357,299

(22) Filed: Feb. 21, 2006

(65) Prior Publication Data

US 2006/0188830 A1 Aug. 24, 2006

(30) Foreign Application Priority Data

Feb. 24, 2005 (JP) ..... 2005-048988

(51) Int. Cl.
*G03C 1/00* (2006.01)
*G03C 1/498* (2006.01)

(52) U.S. Cl. ..... 430/517; 519/523; 519/531; 519/619; 540/122

(58) Field of Classification Search ..... 430/619, 430/517, 519, 574, 576, 531, 523; 540/122
See application file for complete search history.

(56) References Cited

U.S. PATENT DOCUMENTS

| | | | | |
|---|---|---|---|---|
| 6,727,057 | B2 | 4/2004 | Suzuki et al. | |
| 7,153,646 | B2 * | 12/2006 | Fukui et al. | 430/617 |
| 2004/0234909 | A1 * | 11/2004 | Inoue et al. | 430/617 |
| 2005/0214700 | A1 * | 9/2005 | Yamamoto et al. | 430/619 |
| 2006/0141406 | A1 * | 6/2006 | Yamamoto | 430/619 |

* cited by examiner

*Primary Examiner*—Thorl Chea

(74) *Attorney, Agent, or Firm*—Margaret A. Burke; Sheldon J. Moss

(57) ABSTRACT

A photothermographic material having, on at least one side of a support, an image forming layer including at least a photosensitive silver halide, a non-photosensitive organic silver salt, a reducing agent, and a binder, and at least one non-photosensitive layer, wherein the photothermographic material contains a water-insoluble azomethine dye and a metal phthalocyanine dye represented by formula (PC-1):

Formula (PC-1)

wherein M represents a metal atom; $R_1$, $R_2$, $R_3$, $R_4$, $R_5$, $R_6$, $R_7$, and $R_8$ each independently represent a hydrogen atom or a substituent; and at least one of them is an electron-attracting group. The invention provides a photothermographic material which exhibits preferable image tone and excellent image storability.

19 Claims, No Drawings

PHOTOTHERMOGRAPHIC MATERIAL

CROSS-REFERENCE TO RELATED APPLICATION

This application claims priority under 35 USC 119 from Japanese Patent Application No. 2005-048988, the disclosure of which is incorporated by reference herein.

BACKGROUND OF THE INVENTION

1. Field of the Invention

The present invention relates to a photothermographic material preferably used in the field of films for medical diagnosis, the field of films for graphic arts, or the like.

2. Description of the Related Art

In recent years, in the medical field and the graphic arts field, there has been a strong desire for providing a dry photographic process from the viewpoints of protecting the environment and economy of space. Further, the development of digitization in these fields has resulted in the rapid development of systems in which image information is captured and stored in a computer, and then when necessary processed and output by transmitting it to a desired location. Here the image information is output onto a photosensitive material using a laser image setter or a laser imager, and developed to form an image at the location. It is necessary for the photosensitive material to be able to record an image with high-intensity laser exposure and that a clear black-tone image with a high resolution and sharpness can be formed. While various kinds of hard copy systems using pigments or dyes, such as ink-jet printers or electrophotographic systems, have been distributed as general image forming systems using such digital imaging recording materials, images on the digital imaging recording materials obtained by such general image forming systems are insufficient in terms of the image quality (sharpness, granularity, gradation, and tone) needed for medical images used in making diagnoses, and high recording speeds (sensitivity). These kinds of digital imaging recording materials have not reached a level at which they can replace medical silver halide film processed with conventional wet development.

Photothermographic materials utilizing organic silver salts are already known. Photothermographic materials have an image forming layer in which a reducible silver salt (for example, an organic silver salt), a photosensitive silver halide, and if necessary, a toner for controlling the color tone of developed silver images are dispersed in a binder.

Photothermographic materials form black silver images by being heated to a high temperature (for example, 80° C. or higher) after imagewise exposure to cause an oxidation-reduction reaction between a silver halide or a reducible silver salt (functioning as an oxidizing agent) and a reducing agent. The oxidation-reduction reaction is accelerated by the catalytic action of a latent image on the silver halide generated by exposure. As a result, a black silver image is formed in the exposed region. Photothermographic materials have been described in many documents, and the Fuji Medical Dry Imager FM-DPL is an example of a practical medical image forming system using a photothermographic material that has been marketed.

These photothermographic materials utilizing an organic silver salt have a great characteristic of containing all components necessary for image formation in the film in advance and being capable of forming images only by heating. However, on the other hand, there are many technical problems to be solved.

Generally, silver halide photographic materials contain dyes for various purposes. However, the dyes are mainly employed for two purposes described below.

The first purpose is to provide a light filter, an antihalation effect or an anti-irradiation effect to the materials, where the dye exerts its function during the imagewise exposure process but becomes unnecessary after an image is formed. In the case of a dye having absorption in the visible light region, when the dye remains, the remaining dye degrades image quality. Therefore, it is necessary to decolor the remaining dye during the developing process.

The second purpose is to control image tone, where the dye exerts its function after the image forming process, and it is required to complement the color tone of developed silver images and to have a desired spectral light absorption characteristic in order to bring about preferable image tone.

A dye which is used for a photothermographic material has another task, in addition to the above purposes, which is unique to the photothermographic material. As mentioned above, the photothermographic material contains all components necessary for forming an image in the film in advance. Further, even after an image has been formed, unreacted components or reaction products remain in the film, and these exert complicated influences on storage stability of the dye (prior to or after the image formation). Especially after the image formation, it is required that the dye is stable so that change in color or decoloration does not occur during image storage under various conditions (for example, under light illumination, high temperature and high humidity conditions, or the like).

More specifically, in order to attain images with a good degree of sharpness, the incorporation of dyes is very important for photothermographic materials exposed by a laser beam to provide sufficient antihalation and anti-irradiation effects at the wavelength used for the imagewise exposure. As for the wavelength of a laser beam used for the exposure, a wide range of wavelength regions such as the near infrared region, the infrared region, or the visible light region from red to blue can be applied.

For photothermographic materials exposed with either a near infrared or an infrared laser beam, Japanese Patent Application Laid-Open (JP-A) Nos. 9-146220 and 11-228698 disclose photothermographic materials which practically require no color bleaching mechanism therein due to use of a dye which has an absorption maximum within the near infrared region outside of visual sensitivity, a narrow half band width, and little light absorption within the visible light region. All of the patents, patent publications, and non-patent literature cited in the specification are hereby expressly incorporated by reference herein.

For photothermographic materials which are subjected to imagewise exposure with a laser beam having a wavelength within the visible light region of blue to red, a method for decoloring dyes by way of heating during a thermal developing process has been proposed. For example, U.S. Pat. No. 5,135,842 discloses a method for decoloring polymethine dyes of a specific structure by heating. Moreover, U.S. Pat. Nos. 5,314,795, 5,324,627, and 5,384,237 disclose methods in which polymethine dyes are decolorized by heating using a carbanion generating agent.

However, the discoloring mechanisms described above often bring about problems such as incomplete decoloring of dyes or dye decolorization during storage of photothermographic materials due to the insufficient stability of dye occurring after bleaching ability has been enhanced. Moreover, there are also problems such as film turbidity caused by crystallization of decoloring reaction products in the film and powdery deposits oozing out to the surface. Especially, in photothermographic materials used in medical diagnosis, high sharpness and preferable image tone are required. Furthermore, demand has increased for image forming methods used for processing photothermographic materials at a higher speed within a short time.

As dyes used for photographic applications, metal phthalocyanine dyes are well known in the art, and in particular, water-soluble metal phthalocyanine dyes and pigments are known. JP-A No. 2003-295388 discloses the use of a water-soluble metal phthalocyanine dye in photothermographic materials. However, these conventional metal phthalocyanine dyes have a broad spectral light absorption spectrum and can only be added in an amount in a range that does not affect image tone when used in a photothermographic material, and thus, sufficient antihalation effect has not been achieved.

JP-A Nos. 10-268465, and 2000-39685 disclose photothermographic materials which contain dyes or pigments having an absorption maximum in the wavelength region of from 500 nm to 700 nm, or from 520 nm to 580 nm. However, these dyes present problems such as having a broad light absorption spectrum or insufficient storage stability.

SUMMARY OF THE INVENTION

The present invention has been made in view of the above circumstances and provide a photothermographic material comprising, on at least one side of a support, an image forming layer comprising at least a photosensitive silver halide, a non-photosensitive organic silver salt, a reducing agent, and a binder, and at least one non-photosensitive layer, wherein the photothermographic material contains a water-insoluble azomethine dye and a metal phthalocyanine dye represented by formula (PC-1):

Formula (PC-1)

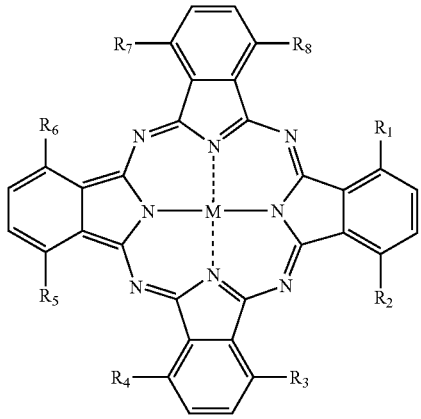

wherein M represents a metal atom; $R_1$, $R_2$, $R_3$, $R_4$, $R_5$, $R_6$, $R_7$, and $R_8$ each independently represent a hydrogen atom or a substituent; and at least one of $R_1$, $R_2$, $R_3$, $R_4$, $R_5$, $R_6$, $R_7$, and $R_8$ is an electron-attracting group.

DETAILED DESCRIPTION OF THE INVENTION

An object of the present invention is to provide a photothermographic material which exhibits preferable image tone and excellent image storability.

The photothermographic material of the present invention has, on at least one side of a support, an image forming layer containing at least a photosensitive silver halide, a non-photosensitive organic silver salt, a reducing agent, and a binder, and at least one non-photosensitive layer, and further contains a water-insoluble azomethine dye and a metal phthalocyanine dye represented by formula (PC-1).

Formula (PC-1)

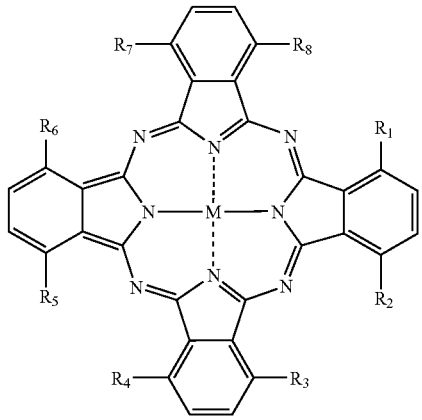

In formula (PC-1), M represents a metal atom. $R_1$, $R_2$, $R_3$, $R_4$, $R_5$, $R_6$, $R_7$, and $R_8$ each independently represent a hydrogen atom or a substituent, and at least one of $R_1$, $R_2$, $R_3$, $R_4$, $R_5$, $R_6$, $R_7$, and $R_8$ is an electron-attracting group.

Preferably, the water-insoluble azomethine dye is a compound represented by the following formula (I).

Formula (I)

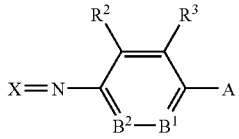

In formula (I), X represents a residual of a color photographic coupler, A represents —$NR^4R^5$ or a hydroxy group, and $R^4$ and $R^5$ each independently represent one selected from a hydrogen atom, an aliphatic group, an aromatic group, or a heterocyclic group. $B^1$ represents ═$C(R^6)$— or ═N—, and $B^2$ represents —$C(R^7)$═ or —N═. $R^2$, $R^3$, $R^6$, and $R^7$ each independently represent a hydrogen atom, a halogen atom, an aliphatic group, an aromatic group, a heterocyclic group, a cyano group, —$OR^{51}$, —$SR^{52}$, —$CO_2R^{53}$, —$OCOR^{54}$, —$NR^{55}R^{56}$, —$CONR^{57}R^{58}$, —$SO_2R^{59}$, —$SO_2NR^{60}R^{61}$, —$NR^{62}CONR^{63}R^{64}$, —$NR^{65}CO_2R^{66}$, —$COR^{67}$, —$NR^{68}COR^{69}$, or —$NR^{70}SO_2R^{71}$, $R^{51}$, $R^{52}$, $R^{53}$, $R^{54}$, $R^{55}$, $R^{56}$, $R^{57}$, $R^{58}$, $R^{59}$, $R^{60}$, $R^{61}$, $R^{62}$, $R^{63}$, $R^{64}$, $R^{65}$, $R^{66}$, $R^{67}$, $R^{68}$, $R^{69}$, $R^{70}$, and $R^{71}$ each independently represent a hydrogen atom, an aliphatic group, or an aromatic group.

Preferably, the water-insoluble azomethine dye is contained in the photothermographic material in the form of a solid fine particle dispersion.

Preferably, in the aforementioned formula (PC-1), at least one of $R_1$, $R_2$, $R_3$, $R_4$, $R_5$, $R_6$, $R_7$, and $R_8$ is a group represented by formula (PC-II).

—$L^1$—$R^{17}$ Formula (PC-II)

In formula (PC-II), $L^1$ represents a group selected from **—$SO_2$—*, **—$SO_3$—*, **—$SO_2NR_N$—*, **—SO—*, **—CO—*, **—$CONR_N$—*, **—COO—*, **—COCO—*, **—$COCO_2$—*, or **—$COCONR_N$—*.

** denotes a bond with a phthalocyanine skeleton at this position. * denotes a bond with $R^{17}$ at this position. $R_N$ represents one selected from a hydrogen atom, an alkyl group, an aryl group, a heterocyclic group, an acyl group, an alkoxycarbonyl group, a carbamoyl group, a sulfonyl group, or a sulfamoyl group. $R^{17}$ represents one selected from a hydrogen atom, an alkyl group, an aryl group, or a heterocyclic group.

More preferably, four or more from among $R_1$, $R_2$, $R_3$, $R_4$, $R_5$, $R_6$, $R_7$, and $R_8$ in formula (PC-1) are a group represented by formula (PC-II).

Preferably, the metal phthalocyanine dye has at least one water-soluble group or oil-soluble group. More preferably, at least two of $R_1$, $R_2$, $R_3$, $R_4$, $R_5$, $R_6$, $R_7$, and $R_8$ are each a water-soluble group or an oil-soluble group. Even more preferably, when the metal phthalocyanine dye has an oil-soluble group, the metal phthalocyanine dye is contained in the photothermographic material in the form of a solid fine particle dispersion.

Preferably, at least one of the water-insoluble azomethine dye or the metal phthalocyanine dye is contained in the image forming layer. More preferably, the water-insoluble azomethine dye is contained in the image forming layer, and the metal phthalocyanine dye is contained in the non-photosensitive layer. And most preferably, the water-insoluble azomethine dye is contained in the image forming layer, the metal phthalocyanine dye is contained in the non-photosensitive layer, the metal phthalocyanine dye is a water-soluble dye, and the non-photosensitive layer is a back layer.

Preferably, the binder of the image forming layer includes a polymer latex having a glass transition temperature (Tg) of from −50° C. to 45° C.

The present invention is explained below in detail.

(Metal Phthalocyanine Dye Represented by Formula (PC-1))

The metal phthalocyanine dye represented by formula (PC-1) according to the present invention is explained below. The metal phthalocyanine dye represented by formula (PC-1) according to the present invention preferably has a half band width of 100 nm or less at the maximum absorbance, more preferably, a half band width of 80 nm or less, and even more preferably, a half band width of 50 nm or less.

The wavelength region having the maximum absorbance is preferably in a range of from 600 nm to 750 nm, more preferably from 600 nm to 720 nm, and even more preferably from 620 nm to 700 nm.

Formula (PC-1)

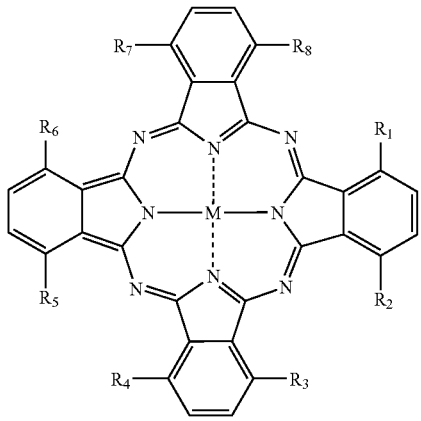

In formula (PC-1), M represents a metal atom. The metal atom represents any metal which forms a stable complex, and a metal selected from the group consisting of Li, Na, K, Be, Mg, Ca, Ba, Al, Si, Cd, Hg, Cr, Fe, Co, Ni, Cu, Zn, Ge, Pd, Sn, Pt, Pb, Sr, or Mn can be used. Mg, Ca, Co, Zn, Pd, or Cu is preferably used, more preferably, Co, Pd, Zn, or Cu is used, and particularly preferably, Cu is used.

<Substituents and the Like>

In formula (PC-1), $R_1$, $R_2$, $R_3$, $R_4$, $R_5$, $R_6$, $R_7$, and $R_8$ each independently represent a hydrogen atom or a substituent, and at least one of them is an electron-attracting group.

In formula (PC-1), a group represented by formula (PC-II) is preferably used as an electron-attracting group.

$$—L^1—R^{17}$$ Formula (PC-II)

$L^1$ represents a group selected from **—$SO_2$—*, **—$SO_3$—*, **—$SO_2NR_N$—*, **—SO—*, **—CO—*, **—$CONR_N$—*, —COO—*, **—COCO—*, **—$COCO_2$—*, or **—$COCONR_N$—*. ** denotes a bond with a phthalocyanine skeleton at this position. * denotes a bond with $R^{17}$ at this position. $R_N$ represents one selected from a hydrogen atom, an alkyl group, an aryl group, a heterocyclic group, an acyl group, an alkoxycarbonyl group, a carbamoyl group, a sulfonyl group, or a sulfamoyl group. $R_N$ may further be substituted by a substituent which $R_1$, $R_2$, $R_3$, $R_4$, $R_5$, $R_6$, $R_7$, and $R_8$ in formula (PC-1) may have. $L^1$ is preferably **—$SO_2$—*, **—$SO_2NR_N$—*, **—CO—*, **—$CONR_N$—*, or **—COO—*, more preferably, **—$SO_2$—*, **—$SO_2NR_N$—*, or **—$CONR_N$—*, and particularly preferably, **—$SO_2$—* or —$SO_2NR_N$—*.

$R_N$ is preferably a hydrogen atom, an alkyl group, an aryl group, or a heterocyclic group, more preferably a hydrogen atom, an alkyl group having 1 to 20 carbon atoms, an aryl group having 6 to 20 carbon atoms, or a heterocyclic group having 1 to 20 carbon atoms, even more preferably a hydrogen atom, an alkyl group having 1 to 10 carbon atoms, an aryl group having 6 to 10 carbon atoms, or a heterocyclic group having 1 to 10 carbon atoms, and particularly preferably a hydrogen atom or an alkyl group having 1 to 6 carbon atoms.

$R^{17}$ represents one selected from a hydrogen atom, an alkyl group, an aryl group, or a heterocyclic group. In the case where $R^{17}$ represents an alkyl group, an aryl group, or a heterocyclic group, these groups may be further substituted by substituents which $R_1$, $R_2$, $R_3$, $R_4$, $R_5$, $R_6$, $R_7$, and $R_8$ in formula (PC-1) can have. $R^{17}$ is preferably an alkyl group or an aryl group, and particularly preferably an alkyl group. $R^{17}$ has from 1 to 30 carbon atoms, preferably from 1 to 20 carbon atoms, and more preferably from 1 to 10 carbon atoms.

1) Water-Soluble Group $R^{17}$ is preferably substituted by a water-soluble group. Herein, a water-soluble group indicates a carboxy group, a sulfo group, a phosphate group, a group having a structure of quaternary salt of nitrogen, a group having a structure of quaternary salt of phosphorus, or a poly(ethylene oxy) group. In the case where the water-soluble group is a carboxy group, a sulfo group, or a phosphate group, the hydrophilic group may have a counter cation, when necessary. As the counter cation, a metal cation, an ammonium ion, a group having a structure of quaternary salt of nitrogen, or a group having a structure of a quaternary salt of phosphorus is used.

In the case where W is a group having a structure of quaternary salt of nitrogen, or a group having a structure of quaternary salt of phosphorus, W may have a counter anion, when necessary. As examples of the counter anion, a halogen ion, a sulfate ion, a nitrate ion, a phosphate ion, an oxalate ion, an alkanesulfonate ion, an arylsulfonate ion, an alkanecarboxylate ion, an arylcarboxylate ion, and the like can be described. The water-soluble group is preferably a carboxy group, a sulfo group, or a phosphate group, and more preferably, a carboxy group or a sulfo group. In this case, as a counter cation, $Li^+$, $Na^+$, $K^+$, $Mg^{2+}$, $Ca^{2+}$ or $NH_4^+$ is preferably used, more preferably, $Li^+$, $Na^+$, $K^+$ or $NH_4^+$ is used, and particularly preferably, $Li^+$ or $Na^+$ is used.

2) Oil-Soluble Group

Preferably, at least two of $R_1$, $R_2$, $R_3$, $R_4$, $R_5$, $R_6$, $R_7$, and $R_8$ are an oil-soluble group. And more preferably, at least members of the group consisting of the above $R_1$, $R_3$, $R_5$, and $R_7$, or members of the group consisting of $R_2$, $R_4$, $R_6$, and $R_8$ are each an oil-soluble group.

Preferably, at least one of $R_1$, $R_2$, $R_3$, $R_4$, $R_5$, $R_6$, $R_7$, and $R_8$ is an electron-attracting group. And more preferably, at least one of $R_1$, $R_2$, $R_3$, $R_4$, $R_5$, $R_6$, $R_7$, and $R_8$ is an oil-soluble electron-attracting group.

The oil-soluble group in the present invention has the purpose to fix the dye of the present invention in the binder of the added layer and indicates an effective substituent, in order to lose water solubility of dye practically. Specifically, the oil-soluble group is the group having 6 or more carbon atoms and not having a dissociation group. The oil-soluble group preferably has 8 or more carbon atoms, more preferably 10 or more carbon atoms, and even more preferably 12 or more carbon atoms. In the case where plural oil-soluble groups exist, the sum of numbers of carbon atom is 6 or more, preferably 8 or more, more preferably 10 or more, and even more preferably 12 or more. As specific examples of the oil-soluble group, an alkyl group (for example, an n-hexyl group, a n-octyl group, a 2-ethylhexyl group, a tert-octyl group, a decyl group, a dodecyl group, a hexadecyl group, a cyclohexyl group, a 3,3,5-trimethylcyclohexyl group, a benzyl group, a phenetyl group, a 2-norbornyl group, a 1-bicyclooctyl group, and the like are described. In the case where plural oil-soluble groups exist, a methyl group, an ethyl group, a n-propyl group, an iso-propyl group, a tert-butyl group, or the like also functions as an oil-soluble group), an alkenyl group (for example, an aryl group, a butenyl group, an octenyl group, a cyclohexenyl group, or the like), an aryl group (for example, a phenyl group, a naphthyl group, or the like), a heterocyclic group (for example, a pyridinyl group, a quinolinyl group, a pyyrolidyl group, an imidazolyl group, a pyrazolyl group, a piperidyl group, a triazolyl group, a thiazolyl group, or the like), an alkoxy group (the alkyl groups described above are described as an alkyl group part), an aryloxy group (the aryl groups described above are described as an aryl group part), an amino group (the alkyl groups or aryl groups described above are described as a substituent), an alkylthio group (the aryl groups described above are described as an aryl group part), and the like are described.

These groups may be substituted by a substituent such as a halogen atom, an alkyl group, an aryl group, an alkoxy group, an aryloxy group, an alkylthio group, an arylthio group, an amino group, an acyl group, an acyloxy group, an alkoxycarbonyl group, an amide group, a carbamoyl group, a sulfonyl group, a sulfonamide group, a sulfamoyl group, a cyano group, a nitro group, a heterocyclic group, a hydroxy group, a ureido group, a urethane group, or the like. These groups may either bond to a phthalocyanine skeleton directly, or through a divalent linking group. As the linking group, an oxygen atom, a sulfur atom, an amino group, a carbonyl group, an ester group, an amide group, a sulfonamide group, a ureido group, a urethane group, and a group where these are linked further are mentioned.

The oil-soluble group of the present invention preferably bond to a phthalocyanine skeleton through an electron-attracting linking group.

The electron-attracting group herein is selected from groups represented by a halogen atom, a cyano group, a nitro group, —C(═O)—R, —C(═O)—C(═O)—R, —S(═O)—R, —S(═O)$_2$—R, —C(═N—R')—R, —S(═NR')—R, —S(═NR')$_2$—R, —P(═O)$R_2$, —O—R", —S—R", —N(—R')—C(═O)—R, —N(—R')—S(═O)—R, —N(—R')—S(═O)$_2$—R, —N(—R')—C(═N—R')—R, —N(—R')—S(═NR')$_2$—R, and —N(—R')—P(═O)$R_2$. Herein R represents one selected from a hydrogen atom, an alkyl group, an aryl group, a heterocyclic group, an amino group, an alkyloxy group, an aryloxy group, a heterocyclic oxy group, an OH group, an alkylthio group, an arylthio group, a heterocyclic thio group, or an SH group. R' represents one selected from a hydrogen atom, an alkyl group, an aryl group, a heterocyclic group, an acyl group, a sulfonyl group, a sulfinyl group, or a phosphoryl group. R" represents one selected from a perfluoro alkyl group, a cyano group, an acyl group, a sulfonyl group, or a sulfinyl group.

The groups represented by R, R', and R" may be substituted by a substituent. Specific examples of the substituent include a halogen atom (a fluorine atom, a chlorine atom, a bromine atom, or an iodine atom), an alkyl group (including an aralkyl group, a cycloalkyl group, an active methine group, and the like), an alkenyl group, an alkynyl group, an aryl group, a heterocyclic group (at any substitution position), a heterocyclic group containing a quaternary nitrogen atom (for example, a pyridinio group, an imidazolio group, a quinolinio group, or an isoquinolinio group), an acyl group, an alkoxycarbonyl group, an aryloxycarbonyl group, a carbamoyl group, a carboxy group or a salt thereof, a sulfonylcarbamoyl group, an acylcarbamoyl group, a sulfamoylcarbamoyl group, a carbazoyl group, an oxalyl group, an oxamoyl group, a cyano group, a thiocarbamoyl group, a hydroxy group, an alkoxy group (including a group in which ethylene oxy group units or propylene oxy group units are repeated), an aryloxy group, a heterocyclic oxy group, an acyloxy group, an alkoxy carbonyloxy group, an aryloxy carbonyloxy group, a carbamoyloxy group, a sulfonyloxy group, an amino group, an alkylamino group, an arylamino group, a heterocyclic amino group, an acylamino group, a sulfonamide group, an ureido group, a thioureido group, an imide group, an alkoxycarbonylamino group, an aryloxycarbonylamino group, a sulfamoylamino group, a semicarbazide group, a thiosemicarbazide group, a hydrazino group, an ammonio group, an oxamoylamino group, an alkylsulfonylureido group, an arylsulfonylureido group, an acylureido group, an acylsulfamoylamino group, a nitro group, a mercapto group, an alkylthio group, an arylthio group, a heterocyclic thio group, an alkylsulfonyl group, an arylsulfonyl group, an alkylsulfinyl group, an arylsulfinyl group, a sulfo group or a salt thereof, a sulfamoyl group, an acylsulfamoyl group, a sulfonylsulfamoyl group or a salt thereof, a group containing a phosphoric amide structure or a phosphate ester structure), a silyloxy group (for example, trimethylsilyloxy, or t-butyldimethylsilyloxy), a silyl group (for example, trimethylsilyl, t-butyldimethylsilyl, or phenyldimethylsilyl), and the like. These substituents may be further substituted by these substituents.

$R^{17}$ is preferably substituted by an oil-soluble group.

As the oil-soluble electron-attracting group of the present invention, an acyl group, an alkoxycarbonyl group, an alkylcarbamoyl group, an alkylsulfonyl group, and an alkylsulfamoyl group, which have 4 or more carbon atoms; a benzoyl group, an aryloxycarbonyl group, an arylcarbamoyl group, an arylsulfonyl group, an arylsulfamoyl group, and a heterocyclic group, which have 6 or more carbon atoms are preferable. Among them, an alkylsulfonyl group, an alkylsulfamoyl group, and an arylsulfamoyl group are more preferable. In the case where plural oil-soluble electron-attracting groups are substituted, the sum of numbers of carbon atom is preferably 6 or more, more preferably 8 or more, and even more preferably 10 or more. These groups may further have a substituent.

<Specific Examples>

Examples of the metal phthalocyanine dye represented by formula (PC-1) used in the present invention are shown below. But, the present invention is not limited by these examples. Examples of compounds hereinafter are described as a single compound for a mixture of regioisomers.

1) Examples of Water-Soluble Compound

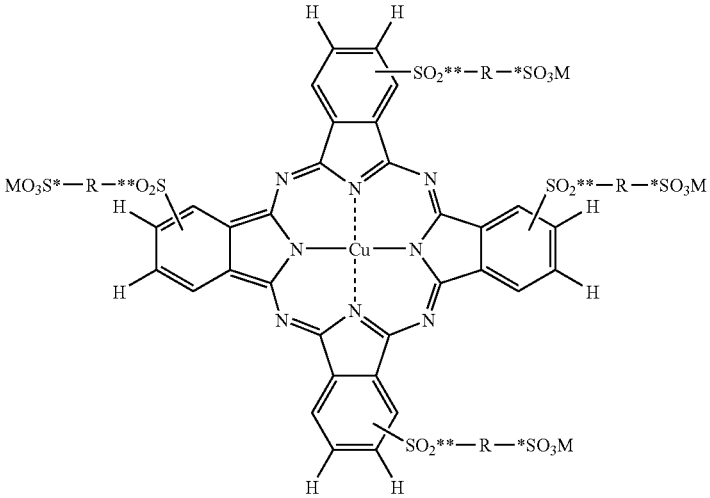

| | Compound No. | | |
|---|---|---|---|
| | M = Li | M = Na | M = K |
| **—R—* = | | | |
| **—$CH_2CH_2$—* | 1 | 10 | 19 |
| **—$CH_2CH_2CH_2$—* | 2 | 11 | 20 |
| **—$CH_2CH_2CH_2CH_2$—* | 3 | 12 | 21 |
| **—$CH_2CH_2CH_2CH_2CH_2$—* | 4 | 13 | 22 |
| **—$CH_2CH_2$—$(OCH_2CH_2)n$—* | | | |
| n = 1 | 5 | 14 | 23 |
| 2 | 6 | 15 | 24 |
| 3 | 7 | 16 | 25 |
| 4 | 8 | 17 | 26 |
| 5 | 9 | 18 | 27 |

| | Compound No. | | | Compound No. | |
|---|---|---|---|---|---|
| | M = Li | M = Na | | M = Li | M = Na |
| 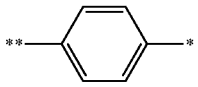 | 28 | 31 | 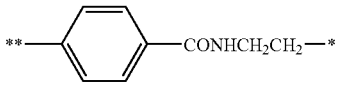 | 34 | 37 |
| 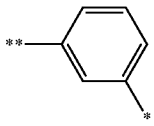 | 29 | 32 | 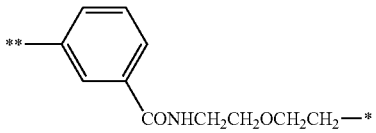 | 35 | 38 |
| 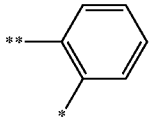 | 30 | 33 | 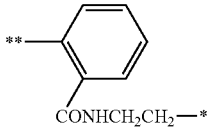 | 36 | 39 |

-continued

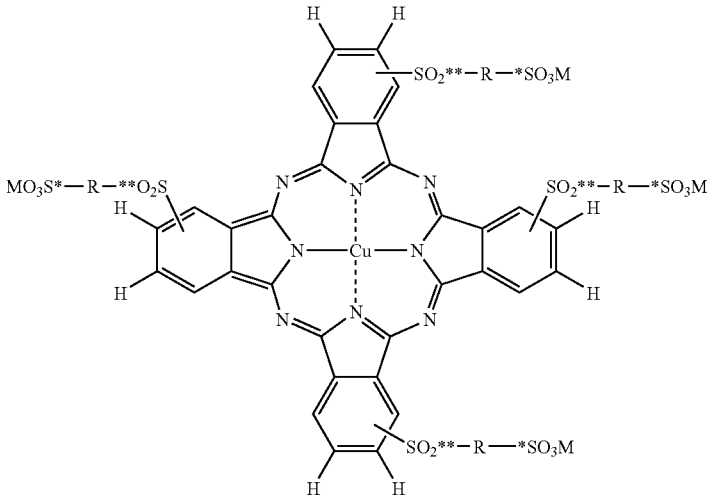

| | Compound No. | |
|---|---|---|
| **—R—* = | | |
| **—$CH_2CH_2$—* | 40 | M = Li&$NH_4$ (Li/$NH_4$ = 3/1) |
| | 41 | M = Li&$NH_4$ (Li/$NH_4$ = 2/2) |
| | 42 | M = Na&$NH_4$ (Na/$NH_4$ = 3/1) |
| | 43 | M = Na&$NH_4$ (Na/$NH_4$ = 2/2) |
| | 44 | M = Na&$NH_4$ (Na/$NH_4$ = 1/3) |
| **—$CH_2CH_2CH_2$—* | 45 | M = Li&$NH_4$ (Li/$NH_4$ = 3/1) |
| | 46 | M = Li&$NH_4$ (Li/$NH_4$ = 2/2) |
| | 47 | M = Li&$NH_4$ (Li/$NH_4$ = 1/3) |
| | 48 | M = Na&$NH_4$ (Na/$NH_4$ = 3/1) |
| | 49 | M = Na&$NH_4$ (Na/$NH_4$ = 2/2) |
| | 50 | M = Na&$NH_4$ (Na/$NH_4$ = 3/1) |
| | 51 | M = K&$NH_4$ (K/$NH_4$ = 3/1) |
| | 52 | M = K&$NH_4$ (K/$NH_4$ = 2/2) |
| | 53 | M = K&$NH_4$ (K/$NH_4$ = 1/3) |
| | 54 | M = $Et_4N$ |
| **—$CH_2CH_2CH_2CH_2$—* | 55 | M = Li&$NH_4$ (Li/$NH_4$ = 3/1) |
| | 56 | M = Li&$NH_4$ (Li/$NH_4$ = 2/2) |
| | 57 | M = Na&$NH_4$ (Na/$NH_4$ = 3/1) |
| | 58 | M = Na&$NH_4$ (Na/$NH_4$ = 2/2) |
| | 59 | M = Na&$NH_4$ (Na/$NH_4$ = 1/3) |

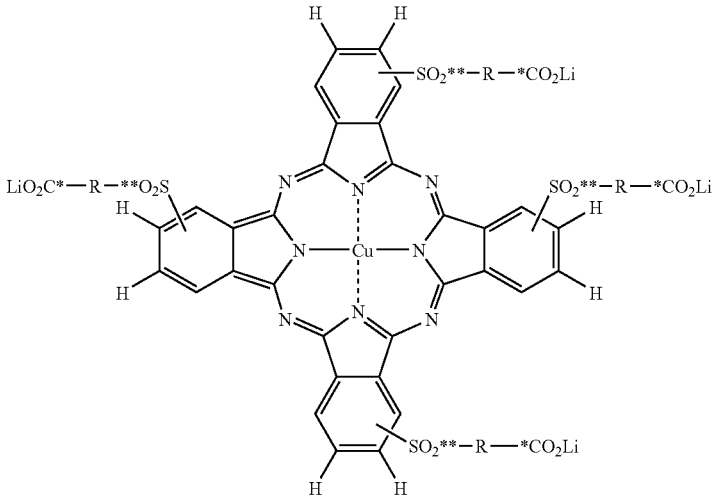

| | Compound No. |
|---|---|
| **—R—* = | |
| **—$CH_2CH_2$—* | 60 |
| **—$CH_2CH_2CH_2$—* | 61 |
| **—$CH_2CH_2CH_2CH_2$—* | 62 |
| **—$CH_2CH_2CH_2CH_2CH_2$—* | 63 |
| **—$CH_2CH_2$—$(OCH_2CH_2)_n$—* | 64 |
| n = 1 | 65 |
| 2 | 66 |
| 3 | 67 |
| 4 | 68 |
| 5 | 69 |

-continued
| | Compound No. | | Compound No. |
|---|---|---|---|
| 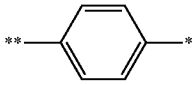 | 70 | 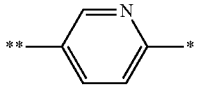 | 73 |
| 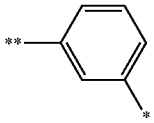 | 71 | 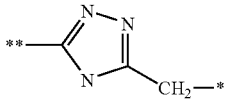 | 74 |
| 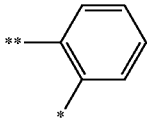 | 72 | 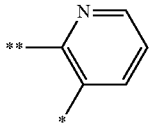 | 75 |
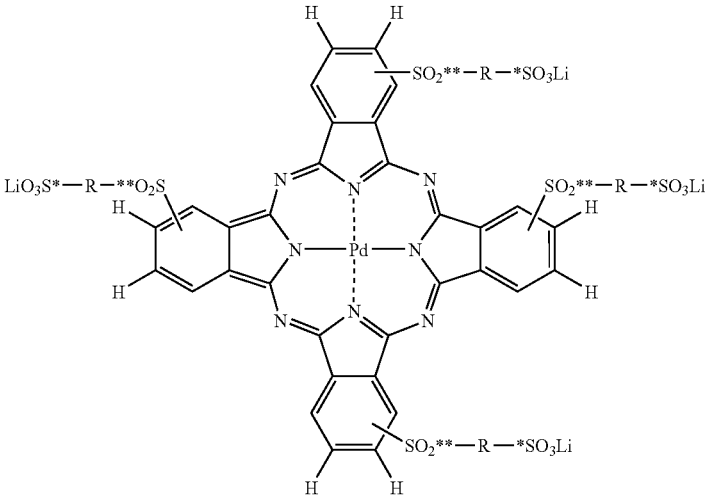
| **—R—* = | Compound No. |
|---|---|
| **—$CH_2CH_2$—* | 76 |
| **—$CH_2CH_2CH_2$—* | 77 |
| **—$CH_2CH_2CH_2CH_2$—* | 78 |
| **—$CH_2CH_2CH_2CH_2CH_2$—* | 79 |
| **—$CH_2CH_2$—$(OCH_2CH_2)n$—* | |
| n = 1 | 80 |
| 2 | 81 |
| 3 | 82 |
| 4 | 83 |
| 5 | 84 |
| | Compound No. | | Compound No. |
|---|---|---|---|
| 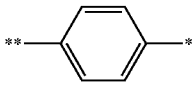 | 85 | 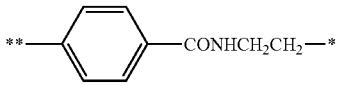 | 88 |
| 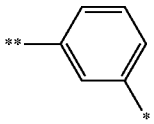 | 86 | 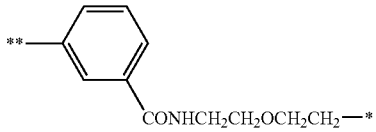 | 89 |
| 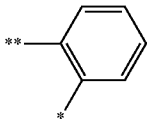 | 87 | 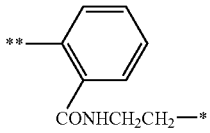 | 90 |

-continued
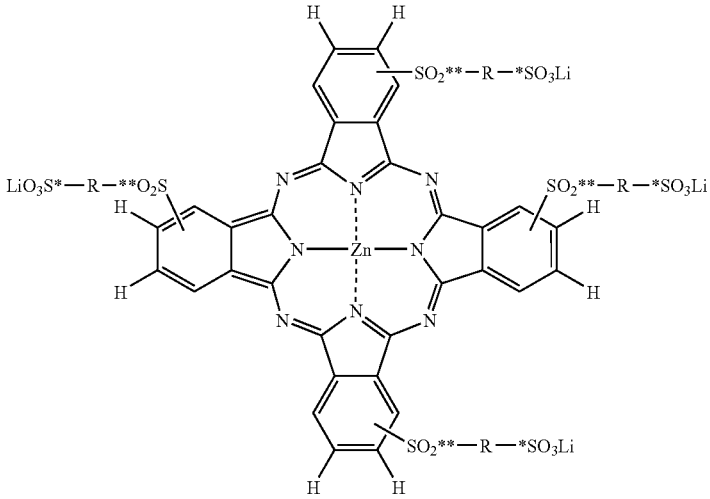
| **—R—* = | Compound No. |
|---|---|
| **—$CH_2CH_2$—* | 91 |
| **—$CH_2CH_2CH_2$—* | 92 |
| **—$CH_2CH_2CH_2CH_2$—* | 93 |
| **—$CH_2CH_2CH_2CH_2CH_2$—* | 94 |
| **—$CH_2CH_2$—$(OCH_2CH_2)n$—* | |
| n = 1 | 95 |
| 2 | 96 |
| 3 | 97 |
| 4 | 98 |
| 5 | 99 |
| | Compound No. | | Compound No. |
|---|---|---|---|
| 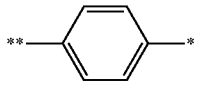 | 100 | 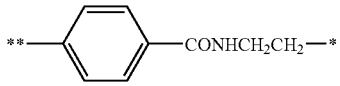 | 103 |
| 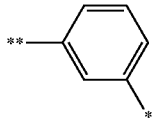 | 101 | 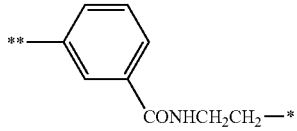 | 104 |
| 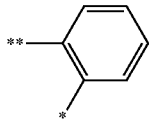 | 102 | 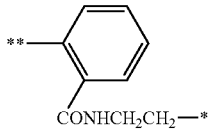 | 105 |
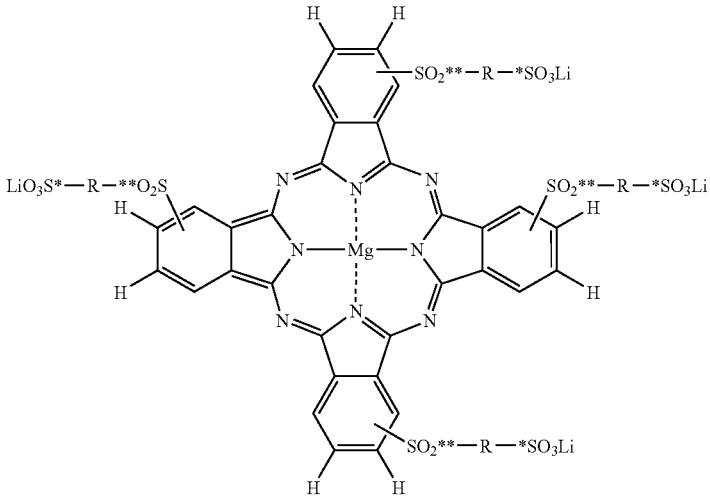
| **—R—* = | Compound No. |
|---|---|
| **—$CH_2CH_2$—* | 106 |
| **—$CH_2CH_2CH_2$—* | 107 |
| **—$CH_2CH_2CH_2CH_2$—* | 108 |
| **—$CH_2CH_2CH_2CH_2CH_2$—* | 109 |
| **—$CH_2CH_2$—$(OCH_2CH_2)n$—* | |
| n = 1 | 110 |
| 2 | 111 |
| 3 | 112 |
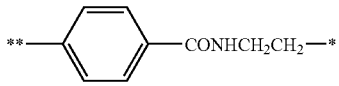 113
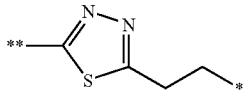 114
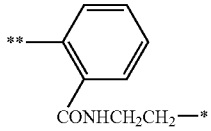 115

-continued
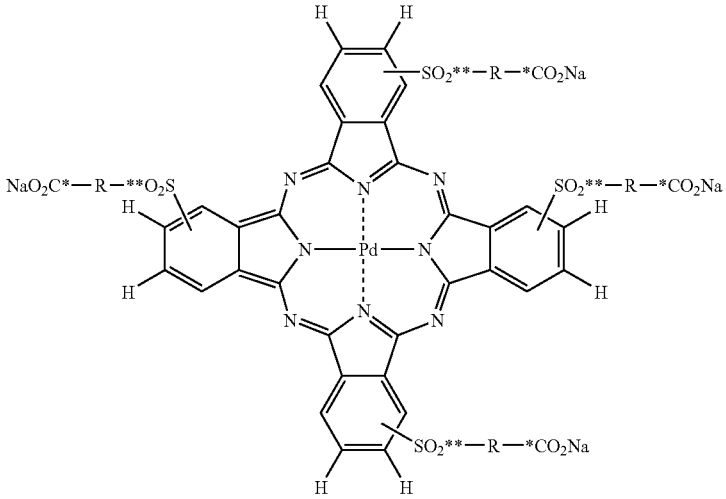
| | Compound No. |
|---|---|
| **—R—* = | |
| **—$CH_2CH_2CH_2$—* | 116 |
| **—$CH_2CH_2CH_2CH_2$—* | 117 |
| **—$CH_2CH_2CH_2CH_2CH_2$—* | 118 |
| **—$CH_2CH_2$—$(OCH_2CH_2)n$—* | |
| n = 1 | 119 |
| 2 | 120 |
| 3 | 121 |
| | Compound No. | | Compound No. |
|---|---|---|---|
| 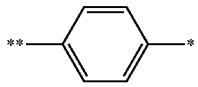 | 122 | 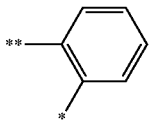 | 124 |
| 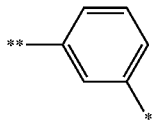 | 123 | 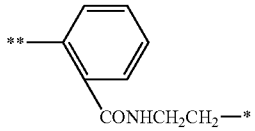 | 125 |
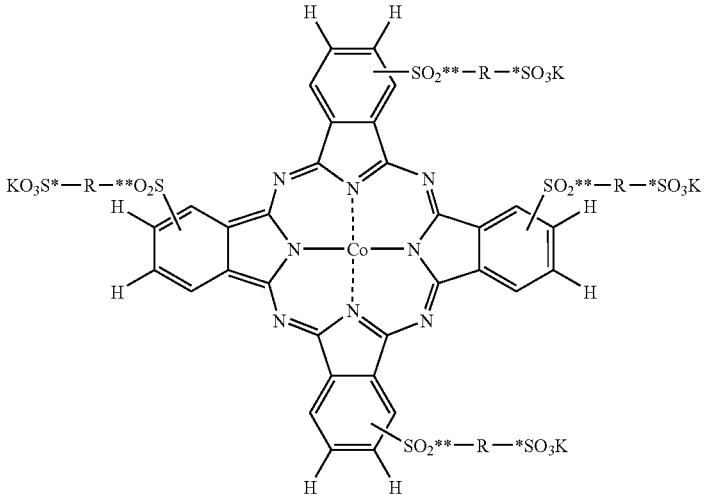
| | Compound No. |
|---|---|
| **—R—* = | |
| **—$CH_2CH_2CH_2$—* | 126 |
| **—$CH_2CH_2CH_2CH_2$—* | 127 |
| **—$CH_2CH_2CH_2CH_2CH_2$—* | 128 |
| **—$CH_2CH_2$—$(OCH_2CH_2)n$—* | |
| n = 1 | 129 |
| 2 | 130 |
| 3 | 131 |

-continued
| | Compound No. | | Compound No. |
|---|---|---|---|
| 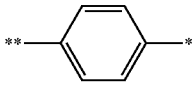 | 132 | 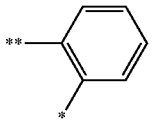 | 134 |
| 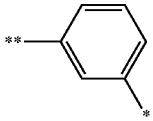 | 133 | 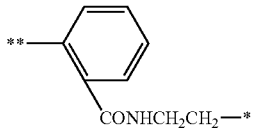 | 135 |
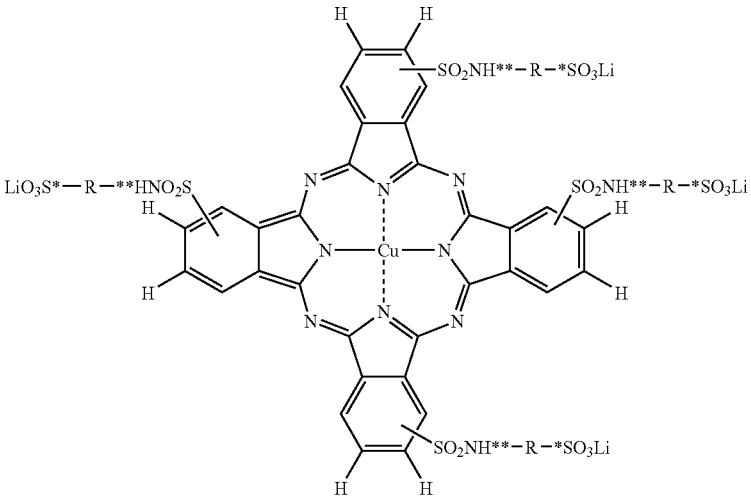
| **—R—* = | Compound No. |
|---|---|
| **—$CH_2CH_2$—* | 136 |
| **—$CH_2CH_2CH_2$—* | 137 |
| **—$CH_2CH_2CH_2CH_2$—* | 138 |
| **—$CH_2CH_2CH_2CH_2CH_2$—* | 139 |
| **—$CH_2CH_2$—$(OCH_2CH_2)n$—* | |
| n = 1 | 140 |
| 2 | 141 |
| 3 | 142 |
| | Compound No. | | Compound No. |
|---|---|---|---|
| 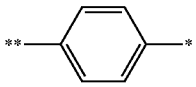 | 143 | 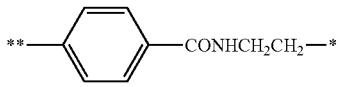 | 146 |
| 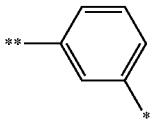 | 144 | 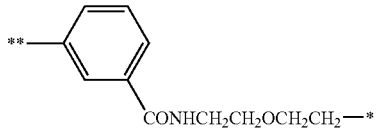 | 147 |
| 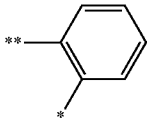 | 145 | 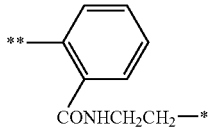 | 148 |

-continued
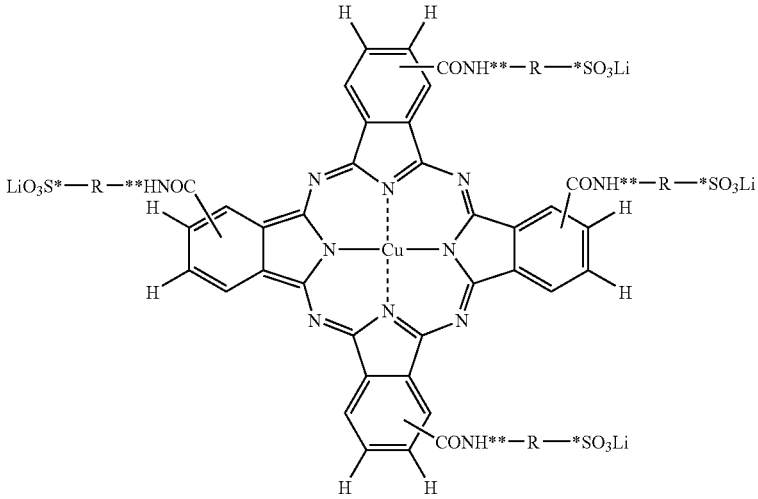
| **—R—* = | Compound No. |
|---|---|
| **—$CH_2CH_2$—* | 149 |
| **—$CH_2CH_2CH_2$—* | 150 |
| **—$CH_2CH_2CH_2CH_2$—* | 151 |
| **—$CH_2CH_2CH_2CH_2CH_2$—* | 152 |
| **—$CH_2CH_2$—$(OCH_2CH_2)n$—* | |
| n = 1 | 153 |
| 2 | 154 |
| 3 | 155 |
| | Compound No. | | Compound No. |
|---|---|---|---|
| 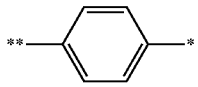 | 156 | 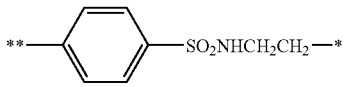 | 159 |
| 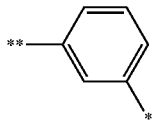 | 157 | 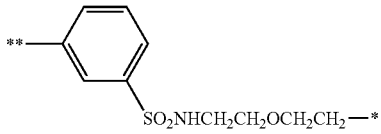 | 161 |
| 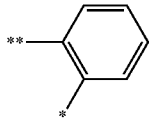 | 158 | 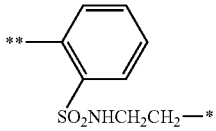 | 162 |
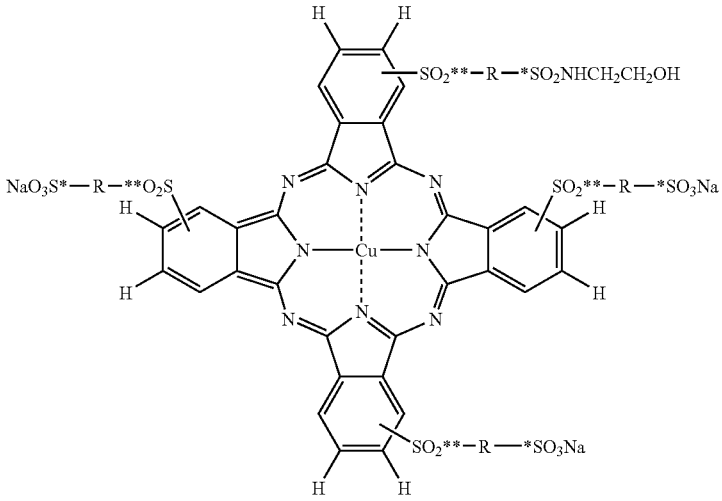
| **—R—* = | Compound No. |
|---|---|
| **—$CH_2CH_2CH_2$—* | 163 |
| **—$CH_2CH_2CH_2CH_2$—* | 164 |
| **—$CH_2CH_2CH_2CH_2CH_2$—* | 165 |
| **—$CH_2CH_2$—$(OCH_2CH_2)n$—* | |
| n = 1 | 166 |
| 2 | 167 |
| 3 | 168 |

-continued
| | Compound No. | | Compound No. |
|---|---|---|---|
| 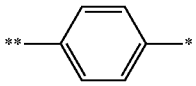 | 169 | 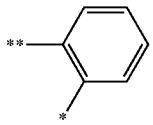 | 171 |
| 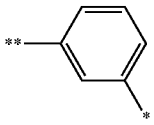 | 170 | 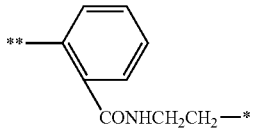 | 172 |
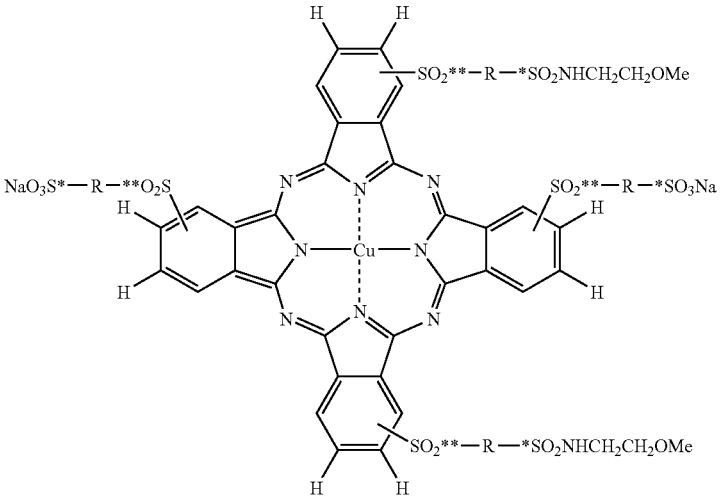
| **—R—* = | Compound No. |
|---|---|
| **—$CH_2CH_2CH_2$—* | 173 |
| **—$CH_2CH_2CH_2CH_2$—* | 174 |
| **—$CH_2CH_2CH_2CH_2CH_2$—* | 175 |
| **—$CH_2CH_2$—$(OCH_2CH_2)n$—* | |
| n = 1 | 176 |
| 2 | 177 |
| 3 | 178 |
| 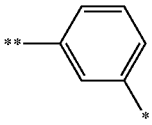 | 179 |
| 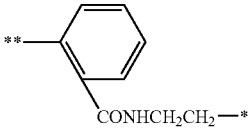 | 180 |
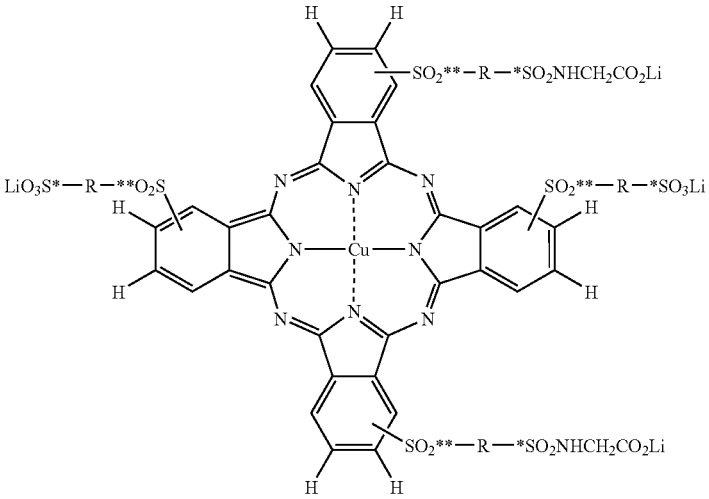
| **—R—* = | Compound No. |
|---|---|
| **—$CH_2CH_2CH_2$—* | 181 |
| **—$CH_2CH_2CH_2CH_2$—* | 182 |
| **—$CH_2CH_2CH_2CH_2CH_2$—* | 183 |
| **—$CH_2CH_2$—$(OCH_2CH_2)n$—* | |
| n = 1 | 184 |
| 2 | 185 |
| 3 | 186 |
| 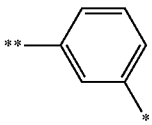 | 187 |
| 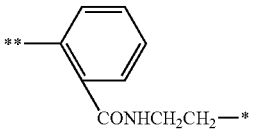 | 188 |

-continued
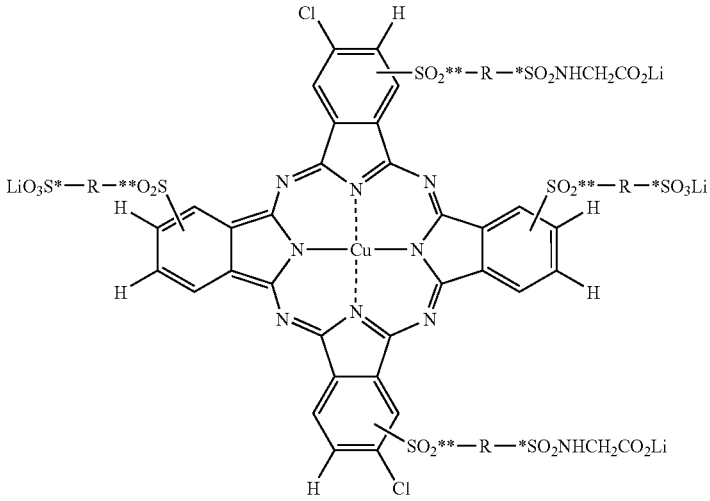
| **—R—* = | Compound No. |
|---|---|
| **—$CH_2CH_2CH_2$—* | 189 |
| **—$CH_2CH_2CH_2CH_2$—* | 190 |
| **—$CH_2CH_2CH_2CH_2CH_2$—* | 191 |
| ** 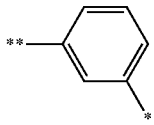 | 192 |
| ** 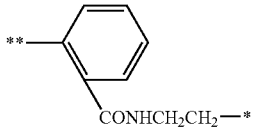 | 193 |
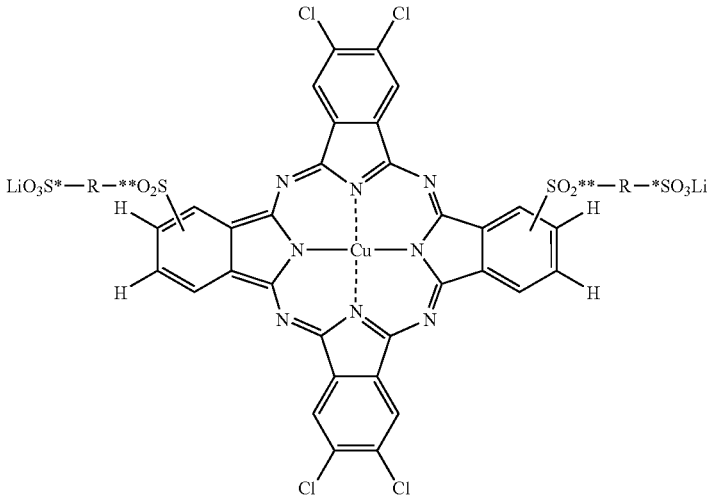
| **—R—* = | Compound No. |
|---|---|
| **—$CH_2CH_2CH_2$—* | 194 |
| **—$CH_2CH_2CH_2CH_2$—* | 195 |
| **—$CH_2CH_2CH_2CH_2CH_2$—* | 196 |
| ** 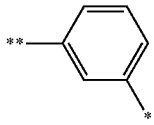 | 197 |
| ** 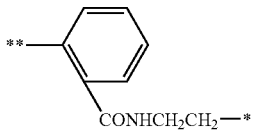 | 198 |
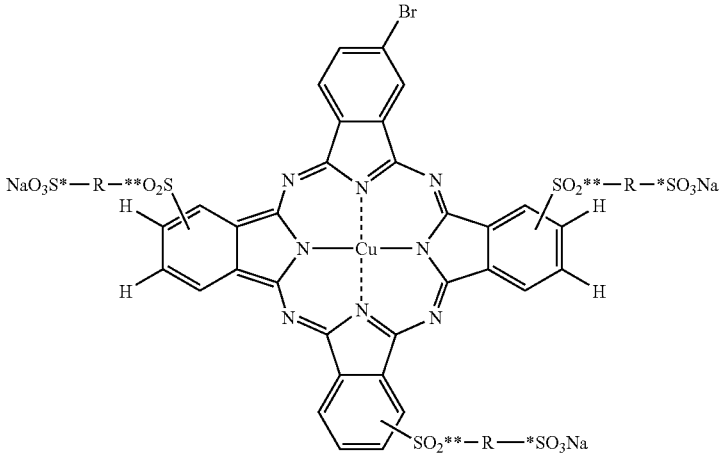
| **—R—* = | Compound No. |
|---|---|
| **—$CH_2CH_2CH_2$—* | 199 |
| **—$CH_2CH_2CH_2CH_2$—* | 200 |
| **—$CH_2CH_2CH_2CH_2CH_2$—* | 201 |

-continued
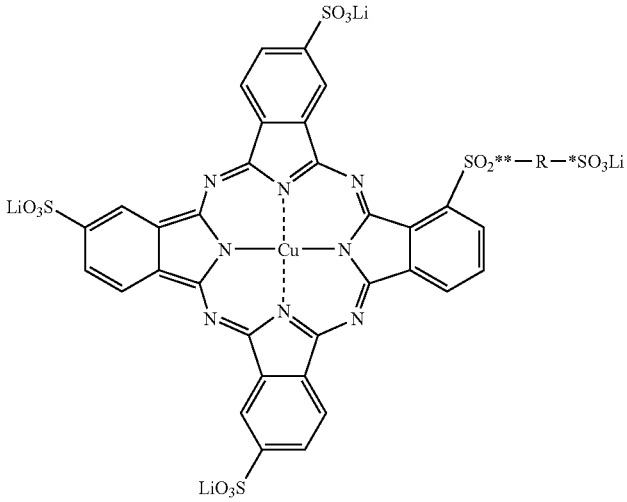
| **—R—* = | Compound No. |
|---|---|
| **—$CH_2CH_2CH_2$—* | 202 |
| **—$CH_2CH_2CH_2CH_2$—* | 203 |
| **—$CH_2CH_2CH_2CH_2CH_2$—* | 204 |
| ** 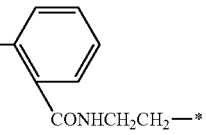 | 205 |
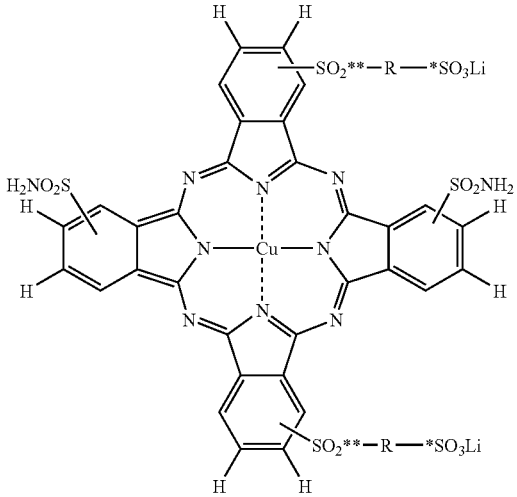
| **—R—* = | Compound No. |
|---|---|
| **—$CH_2CH_2$—* | 206 |
| **—$CH_2CH_2CH_2$—* | 207 |
| **—$CH_2CH_2CH_2CH_2$—* | 208 |
| **—$CH_2CH_2CH_2CH_2CH_2$—* | 209 |
| **—$CH_2CH_2$—$(OCH_2CH_2)n$—* | |
| n = 1 | 210 |
| 2 | 211 |
| 3 | 212 |
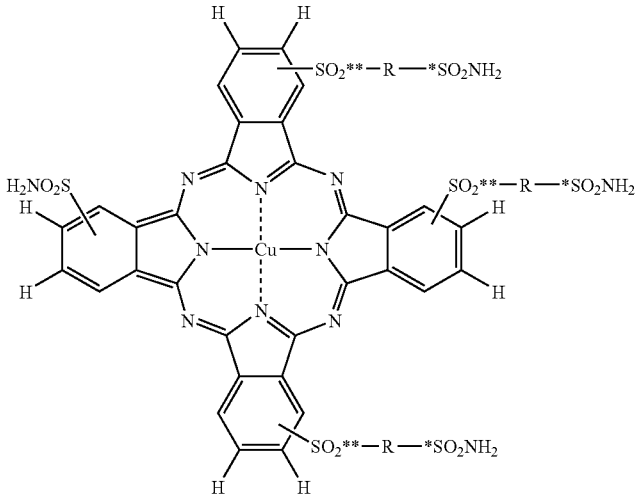
| **—R—* = | Compound No. |
|---|---|
| **—$CH_2CH_2$—* | 213 |
| **—$CH_2CH_2CH_2$—* | 214 |
| **—$CH_2CH_2CH_2CH_2$—* | 215 |
| **—$CH_2CH_2CH_2CH_2CH_2$—* | 216 |
| **—$CH_2CH_2$—$(OCH_2CH_2)n$—* | |
| n = 1 | 217 |
| 2 | 218 |
| 3 | 219 |

2) Examples of Oil-Soluble Compound

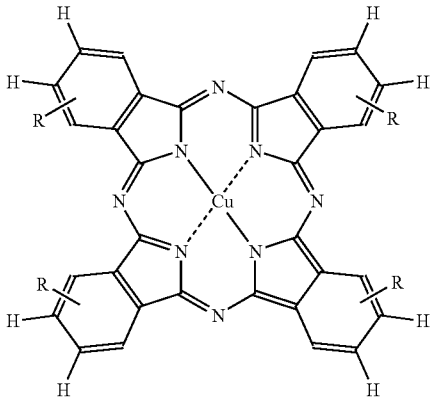

| Compound No. | Substituent |
|---|---|
| (1) | R: SO2C2H5 |
| (2) | R: SO2C4H9 |
| (3) | R: SO2C6H13 |
| (4) | R: SO2C8H17 |
| (5) | R: SO2NHC3H7 |
| (6) | R: SO2NHC6H13 |
| (7) | R: COOC4H9 |
| (8) | R: COOCH2CH(C2H5)C4H9 |
| (9) | R: COOC6H11(cyclo) |
| (10) | R: CONHC4H9(tert) |
| (11) | R: CONHC6H11 |
| (12) | R: COC5H11 |
| (13) | R: SO2C6H5 |
| (14) | R: SO2C6H4Cl(m) |
| (15) | R: SO2C6H4CH3(p) |
| (16) | R: SO2C6H4CN(p) |
| (17) | R: SO2C6H4(CH3)2(o, p) |
| (18) | R: NHCOC6H13 |
| (19) | R: NHSO2C6H13 |
| (20) | R: OC6H13 |
| (21) | R: SO2C2H4OC4H9 |
| (22) | R: SO2C2H4COOC4H9 |
| (23) | R: SO2C2H4OCOC4H9 |
| (24) | R: SO2C2H4SO2C4H9 |
| (25) | R: SO2N(C2H5)2 |
| (26) | R: COOCH2CH2OC4H9 |
| (27) | R: COOCH2CH2OCOC4H9 |
| (28) | R: COOCH2CH2COOC4H9 |
| (29) | R: C6H13 |
| (30) | R: CON(C4H9)2 |

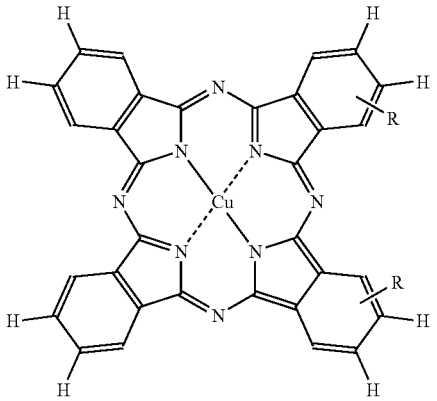

-continued

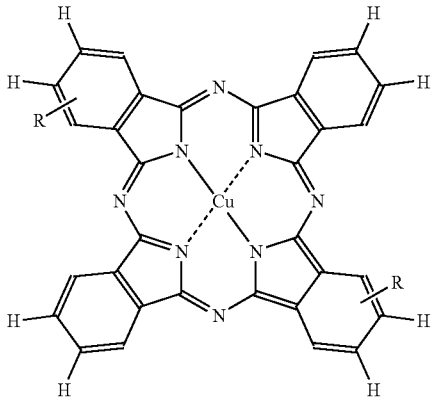

Mixture of the above structural isomers

| | |
|---|---|
| (31) | R: SO2C8H17 |
| (32) | R: SO2NHC8H17 |
| (33) | R: CONHC8H17 |
| (34) | R: COOC8H17 |
| (35) | R: SOC8H17 |
| (36) | R: SC8H17 |
| (37) | R: OCH2CH2C4F9 |
| (38) | R: OCH2C6F12H |
| (39) | R: SO2C6H5 |
| (40) | R: NHSO2C8H17 |

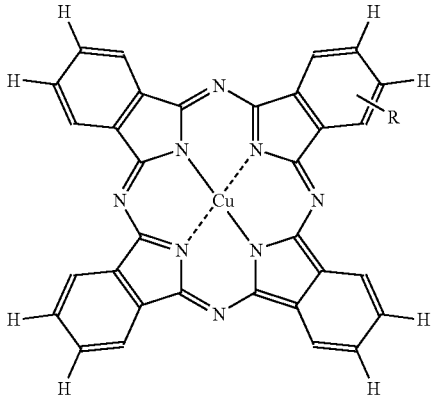

| | |
|---|---|
| (41) | R: SO2C8H17 |
| (42) | R: SO2C12H25 |
| (43) | R: SO2C3H6SO2C8H17 |
| (44) | R: SO2C2H4COOC8H17 |
| (45) | R: SO2C2H4CON(C4H9)2 |

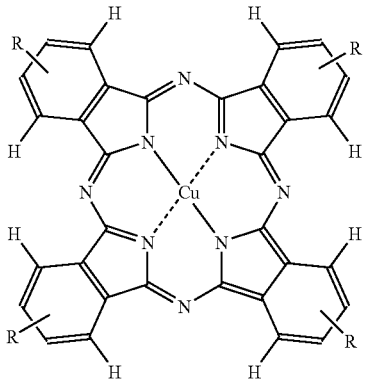

(46) R: SO2C4H9

-continued

| | |
|---|---|
| (47) | R: SO2NHC6H13 |
| (48) | R: COOC4H9 |
| (49) | R: CONHC6H11 |
| (50) | R: SO2C3H6SO2C8H17 |

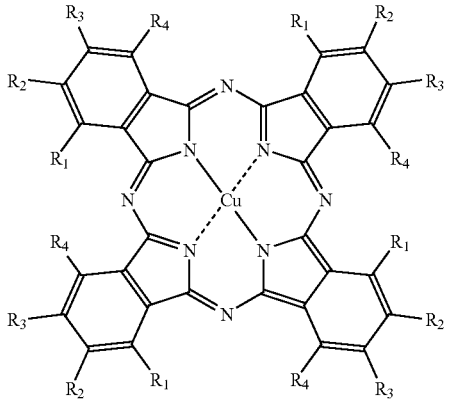

| | |
|---|---|
| (51) | R1, R4: one is SO2CH3 and the other is H<br>R2, R3: one is OC6H13 and the other is H |
| (52) | R1, R4: one is CN and the other is H<br>R2, R3: one is NHCOC6H13 and the other is H |
| (53) | R1, R4: one is SO2C8H17 and the other is H<br>R2, R3: Cl |
| (54) | R1, R4: SO2C3H7<br>R2, R3: H |
| (55) | R1, R4: H<br>R2, R3: SO2C3H7 |

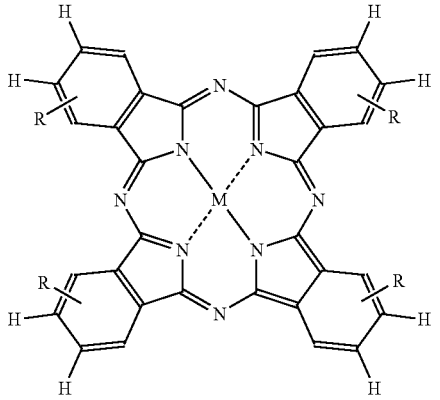

| | |
|---|---|
| (56) | R: SO2C2H4SO2C4H9, M: Cu |
| (57) | R: SO2C2H4SO2C4H9, M: Pd |
| (58) | R: SO2C2H4SO2C4H9, M: Zn |
| (59) | R: SO2C2H4SO2C4H9, M: Mg |
| (60) | R: SO2C2H4SO2C4H9, M: Co |
| (61) | R: SO2C2H4SO2C4H9, M: Ni |

<Synthetic Method>

The compound of the present invention can be synthesized by a method similar to that described in the specification of JP-A No. 8-302224.

<Adding Method of Dye>

In the case of the water-soluble dye, the dye can be added in the form of an aqueous solution.

In the case of the oil-soluble dye, the dye can be added in the form of an emulsified dispersion prepared by dissolving the dye in an organic solvent having a high boiling point and then dispersing in water, or in the form of a solid fine particle dispersion. The emulsified dispersion can be used as a fine particle dispersion prepared by a colloidal mill, homogenizer, Mantongaulin dispersing apparatus, or the like using a high boiling point-organic solvent which has a boiling point of 200° C. or higher under an ordinary pressure, dispersing agent such as a surfactant and a polymer, a protective colloid, and if necessary, an auxiliary solvent having a low boiling point. As the high boiling point-organic solvent, phosphate esters, phosphonate esters, phthalate esters, terephthalate esters, benzoate esters, torimellitate esters, aliphatic dicarboxylate esters, amidic oils, phenolic oils, etheric oils, and epoxy type oils are preferably used. Among them, phosphate esters, phthalate esters, and aliphatic dicarboxylate esters are preferable. As the surfactant, any of an anionic surfactant, a nonionic surfactant, a cationic surfactant, a betaine surfactant, and the like can be used, and particularly, a sulfonic anionic surfactant and a polyetheric nonionic surfactant are preferable. As the dispersing agent, polymers such as povals, modified povals, polyamides, and polyethers are preferable, and particularly, alkylthio modified poval, poly(vinyl pyrrolidone), and block copolymer of propylene oxide and ethylene oxide are preferable.

When the dye is added in the form of a solid fine particle dispersion, the powder of the dye can be dispersed by means of a ball mill such as ultra visco mill, super apex mill, or the like in the presence of a surfactant or a dispersing agent. As a surfactant, any of an anionic surfactant, a nonionic surfactant, a cationic surfactant, a betaine surfactant, and the like can be used, but particularly, a sulfonic anionic surfactant and a polyetheric nonionic surfactant are preferable. As the dispersing agent, polymers such as povals, modified povals, polyamides, and polyethers are preferable, and an alkylthio modified poval, poly(vinyl pyrrolidone), and a block copolymer of propylene oxide and ethylene oxide are particularly preferable.

<Layer to be Added>

The dye represented by formula (PC-1) of the present invention is added in at least one layer of an image forming layer or a non-photosensitive layer. Preferably, the dye presented by formula (PC-1) is added in the non-photosensitive layer. The non-photosensitive layer may be disposed on the same side of the support as the image forming layer, or may be a back layer disposed on the opposite side of the support from the image forming layer. As the layer disposed on the same side of the support as the image forming layer, it may be disposed farther from the support than the image forming layer or may be disposed between the support and the image forming layer. The dye of the present invention may be added on both sides of the support.

<Range of Addition Amount>

To adjust the image tone after thermal developing process in a preferable level, the addition amount of dye is determined by the combination with a color tone of developed silver image or a color tone obtained by other additives. Generally, the dye is used at an amount as such that the optical density does not exceed 1.5 when measured at the desired wavelength. The optical density is from 0.01 to 1.2, preferably from 0.05 to 1.0, and more preferably from 0.1 to 0.8. To obtain the above optical density, the addition amount of dye is generally from 0.5 $mg/m^2$ to 200 $mg/m^2$, preferably from 1 $mg/m^2$ to 160 $mg/m^2$, and more preferably from 5 $mg/m^2$ to 120 $mg/m^2$.

(Water-Insoluble Azomethine Dye)

The water-insoluble azomethine dye according to the present invention is preferably a compound represented by the following formula (I).

Formula (I)

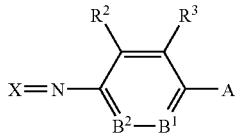

<Description of Substituents and the Like>

In formula (I), X represents a residual of a color photographic coupler, A represents —$NR^4R^5$ or a hydroxy group, $R^4$ and $R^5$ each independently represent one selected from a hydrogen group, an aliphatic group, an aromatic group, or a heterocyclic group. A is preferably —$NR^4R^5$. The above mentioned $R^4$ and $R^5$ are each independently, preferably, a hydrogen atom or an aliphatic group, more preferably a hydrogen atom, an alkyl group, or a substituted alkyl group, and even more preferably a hydrogen atom, an alkyl group having 1 to 18 carbon atoms, or a substituted alkyl group having 1 to 18 carbon atoms.

In more detail, most preferably, both of $R^4$ and $R^5$ are a methyl group or an ethyl group, or $R^4$ is an ethyl group and $R^5$ is a 2-hydroxyethyl group, or $R^4$ is an ethyl group and $R^5$ is a (2-methanesulfonyl amino)ethyl group.

In the aforementioned formula (I), $B^1$ represents =$C(R^6)$— or =N—, and $B^2$ represents —$C(R^7)$=or —N=. It is preferred that $B^1$ and $B^2$ are not —N= at the same time, and it is more preferred that $B^1$ is =$C(R^6)$— and $B^2$ is —$C(R^7)$=.

$R^2$, $R^3$, $R^6$, and $R^7$ are each independently a hydrogen atom, a halogen atom, an aliphatic group, an aromatic group, a heterocyclic group, a cyano group, —$OR^{51}$, —$SR^{52}$, —$CO_2R^{53}$, —$OCOR^{54}$, —$NR^{55}R^{56}$, —$CONR^{57}R^{58}$, —$SO_2R^{59}$, —$SO_2NR^{60}R^{61}$, —$NR^{62}CONR^{63}R^{64}$, —$NR^{65}CO_2R^{66}$, —$COR^{67}$, —$NR^{68}COR^{69}$, or —$NR^{70}SO_2R^{71}$. $R^{51}$, $R^{52}$, $R^{53}$, $R^{54}$, $R^{55}$, $R^{56}$, $R^{57}$, $R^{58}$, $R^{59}$, $R^{60}$, $R^{61}$, $R^{62}$, $R^{63}$, $R^{64}$, $R^{65}$, $R^{66}$, $R^{67}$, $R^{68}$, $R^{69}$, $R^{70}$, and $R^{71}$ are each independently a hydrogen atom, an aliphatic group, or an aromatic group.

The aforementioned $R^2$ and $R^7$ are each independently, preferably, a hydrogen atom, a halogen atom, an aliphatic group, —$OR^{51}$, —$NR^{62}CONR^{63}R^{64}$, —$NR^{65}CO_2R^{66}$, —$NR^{68}COR^{69}$, or —$NR^{70}SO_2R^{71}$; more preferably a hydrogen atom, a fluorine atom, a chlorine atom, an alkyl group, a substituted alkyl group, —$NR^{62}CONR^{63}R^{64}$, or —$NR^{68}COR^{69}$; even more preferably a hydrogen atom, a chlorine atom, an alkyl group having 1 to 10 carbon atoms, or a substituted alkyl group having 1 to 10 carbon atoms; and most preferably a hydrogen atom, an alkyl group having 1 to 4 carbon atoms, or a substituted alkyl group having 1 to 4 carbon atoms. In more detail, most preferably, $R^2$ is a hydrogen atom or a methyl group and $R^7$ is a hydrogen atom.

$R^3$ and $R^6$ are each independently, preferably, a hydrogen atom, a halogen atom, or an aliphatic group; more preferably a hydrogen atom, a fluorine atom, a chlorine atom, an alkyl group, or a substituted alkyl group; even more preferably a hydrogen atom, a chlorine atom, an alkyl group having 1 to 10 carbon atoms, or a substituted alkyl group having 1 to 10 carbon atoms; and most preferably a hydrogen atom, an alkyl group having 1 to 4 carbon atoms, or a substituted alkyl group having 1 to 4 carbon atoms. In more detail, most preferably, both of $R^3$ and $R^6$ are a hydrogen atom.

In the aforementioned formula (I), $R^2$ and $R^3$, $R^3$ and $R^4$, $R^4$ and $R^5$, $R^5$ and $R^6$, or $R^6$ and $R^7$ may bond to each other in each combination to form a ring. The preferable combination to form a ring is $R^3$ and $R^4$, $R^4$ and $R^5$, or $R^5$ and $R^6$. The ring which is formed by bonding the aforementioned $R^2$ and $R^3$, or $R^6$ and $R^7$, is preferably a 5- or 6-membered ring. The ring is preferably an aromatic ring (for example, a benzene ring) or unsaturated heterocycle (for example, a pyridine ring, an imidazole ring, a thiazole ring, a pyrimidine ring, a pyrole ring, or a furan ring).

The ring, which is formed by bonding the aforementioned $R^3$ and $R^4$, or $R^5$ and $R^6$, is preferably a 5- or 6-membered ring. Examples of the ring include a tetrahydroquinoline ring and a dihydroindole ring. The ring, which is formed by bonding the aforementioned $R^4$ and $R^5$, is preferably a 5- or 6-membered ring. Examples of the ring include a pyrrolidine ring, a piperidine ring, and a morpholine ring.

In the present description, the aliphatic group means an alkyl group, a substituted alkyl group, an alkenyl group, a substituted alkenyl group, an alkynyl group, a substituted alkynyl group, an aralkyl group, and a substituted aralkyl group. The aforementioned alkyl group may be branched or may form a ring.

The alkyl group preferably has from 1 to 150 carbon atoms, and more preferably from 1 to 100 carbon atoms.

The alkyl moiety in the aforementioned substituted alkyl group is similar to the above mentioned alkyl group.

The aforementioned alkenyl group may be branched or form a ring. The alkenyl group has preferably from 2 to 150 carbon atoms, and more preferably from 2 to 100 carbon atoms. The alkenyl moiety in the aforementioned substituted alkenyl group is similar to the above mentioned alkenyl group. The aforementioned alkynyl group may be branched or form a ring. The alkynyl group has preferably from 2 to 150 carbon atoms, and more preferably 2 to 100 carbon atoms. The alkynyl moiety in the aforementioned substituted alkynyl group is similar to the above mentioned alkynyl group.

The alkyl moieties in the aforementioned aralkyl group and substituted aralkyl group are similar to the above mentioned alkyl group. The aryl moieties in the aforementioned aralkyl group and substituted aralkyl group are similar to the aryl group mentioned below.

Examples of the substituent of the alkyl moieties in the aforementioned substituted alkyl group, substituted alkenyl group, substituted alkynyl group, and substituted aralkyl group include a halogen atom, a cyano group, a nitro group, a heterocyclic group, —$OR^{141}$, —$SR^{142}$, —$CO_2R^{143}$, —$NR^{144}R^{145}$, —$CONR^{146}R^{147}$, —$SO_2R^{148}$, —$SO_3R^{149}$, and —$SO_2NR^{150}R^{151}$. $R^{141}$, $R^{142}$, $R^{143}$, $R^{144}$, $R^{145}$, $R^{146}$, $R^{147}$, $R^{148}$, $R^{149}$, $R^{150}$, and $R^{151}$ are each independently a hydrogen atom, an aliphatic group, or an aromatic group. In addition to the above mentioned groups, $R^{143}$ and $R^{149}$ may be a metal atom selected from Li, Na, K, Mg, and Ca. Examples of the substituent of the aryl moiety in the aforementioned substituted aralkyl group are similar to the following examples of the substituent of the substituted aryl group.

In the present description, an aromatic group means an aryl group and a substituted aryl group. The aryl group is preferably phenyl or naphthyl. The aryl moiety in the aforementioned substituted aryl group is similar to the abovementioned aryl group. Examples of the substituent of the aforementioned substituted aryl group include a halogen atom, a cyano group, a nitro group, an aliphatic group, a heterocyclic group, —$OR^{161}$—$SR^{162}$, —$CO_2R^{163}$, —$NR^{164}R^{165}$, —$CONR^{166}R^{167}$, —$SO_2R^{168}$, —$SO_3R^{169}$, and $SO_2NR^{170}R^{171}$. $R^{161}$, $R^{162}$, $R^{163}$, $R^{164}$, $R^{165}$, $R^{166}$, $R^{167}$, $R^{168}$, $R^{169}$, $R^{170}$, and $R^{171}$ are each independently a hydrogen atom, an aliphatic group, or an aromatic group. In addition to the above mentioned groups, $R^{163}$ and $R^{169}$ may be a metal atom selected from Li, Na, K, Mg, and Ca.

In the present description, a heterocyclic group preferably contains a 5- or 6-membered saturated or unsaturated heterocycle. The heterocycle may be condensed with an aliphatic ring, aromatic ring or other heterocycle. Examples of the heteroatom in the heterocycle include B, N, O, S, Se, and Te. N, O, and S are preferable as a heteroatom. In the heterocycle, a carbon atom preferably has a free single valence (a heterocyclic group binds at a carbon atom).

Examples of the saturated heterocycle include pyrrolidine ring, a morpholine ring, 2-bora-1,3-dioxorane ring and 1,3-thiazoline ring. Examples of the unsaturated heterocycle include an imidazole ring, a thiazole ring, a benzothiazole ring, a benzoxazole ring, a benzotriazole ring, a benzoselenazole ring, a pyridine ring, a pyrimidine ring, and a quinoline ring. The heterocyclic group may have a substituent. Examples of the substituent include a halogen atom, a cyano group, a nitro group, an aliphatic group, an aromatic group, a heterocyclic group, $—OR^{171}$, $—SR^{172}$, $—CO_2R^{173}$, $—NR^{174}R^{175}$, $—CONR^{176}R^{177}$, $—SO_2R^{178}$, and $—SO_2NR^{179}R^{180}$.

$R^{171}$, $R^{172}$, $R^{173}$, $R^{174}$, $R^{175}$, $R^{176}$, $R^{177}$, $R^{178}$, $R^{179}$, and $R^{180}$ are each independently a hydrogen atom, an aliphatic group, or an aromatic group.

In the aforementioned formula (I), a coupler represented by X is preferably the coupler mentioned in the documents below. U.S. Pat. Nos. 4,310,619 and 4,351,897, European Patent (EP) No. 73,636, U.S. Pat. Nos. 3,061,432 and 3,725,067, Research Disclosure Nos. 24220 (1984, June), and 24230 (1984, June), JP-A Nos. 60-33552, 60-43659, 61-72238, 60-35730, 55-118034, and 60-185951, U.S. Pat. Nos. 4,500,630, 4,540,654, and 4,556,630, WO No. 88/04795, JP-A No. 3-39737 {L-57 (page 11, lower right), L-68 (page 12, lower right), L-77 (page 13, lower right)}, EP No. 456,257 {[A-4]-63 (page 134), [A-4]-73, -75 (page 139)}, EP No. 486,965 {M-4, -6 (page 26), M-7 (page 27)}, EP No. 571,959A {M-45 (page 19)}, JP-A No. 5-204106 {(M–1) (page 6)}, and 4-362631 {M-22 (paragraph No. 0237)}, U.S. Pat. Nos. 3,061,432 and 3,725,067.

Among the compounds represented by formula (I), the compound represented by the following formula (II) is preferable. Next, formula (II) is explained.

Formula (II)

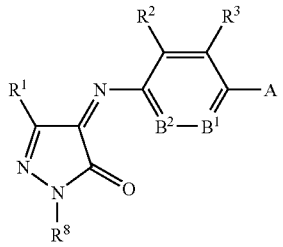

In formula (II), $R^1$ represents a halogen atom, an aliphatic group, an aromatic group, a heterocyclic group, a cyano group, $—OR^{81}$, $—SR^{82}$, $—CO_2R^{83}$, $—OCOR^{84}$, $—NR^{85}R^{86}$, $—CONR^{87}R^{88}$, $—SO_2R^{89}$, $—SO_2NR^{90}R^{91}$, $—NR^{92}CONR^{93}R^{94}$, $—NR^{95}CO_2R^{96}$, $—COR^{97}$, $NR^{98}COR^{99}$, or $—NR^{100}SO_2R^{101}$. $R^{81}$, $R^{82}$, $R^{83}$, $R^{84}$, $R^{85}$, $R^{86}$, $R^{87}$, $R^{88}R^{89}$, $R^{90}$, $R^{91}$, $R^{92}$, $R^{93}$, $R^{94}$, $R^{95}$, $R^{96}$, $R^{97}R^{98}$, $R^{99}$, $R^{100}$, and $R^{101}$ each independently represent one selected from a hydrogen atom, an aliphatic group, or an aromatic group. $R^8$ represents one selected from an aliphatic group or an aromatic group.

$R^2$, $R^3$, A, $B^1$, and $B^2$ each have the same meaning as in formula (I) described above, respectively, and those preferable ranges are also the same.

Among the compounds represented by formula (II) described above, A is more preferably $—NR^4R^5$.

Next, the compound represented by formula (II) described above is explained in more detail. $R^1$ described above is preferably an aliphatic group, an aromatic group, $—NR^{85}R^{86}$, $—NR^{92}CONR^{93}R^{94}$, $—NR^{95}CO_2R^{96}$, $—NR^{98}COR^{99}$, or $—NR^{100}SO_2R^{101}$, more preferably $—NR^{85}R^{86}$, $—NR^{98}COR^{99}$, or $—NR^{100}SO_2R^{101}$, and particularly preferably $—NR^{85}R^{86}$ or $—NR^{98}COR^{99}$.

$R^8$ described above is an aliphatic group or an aromatic group, and preferably an aromatic group.

Among the compounds represented by formula (I) described above, the compound represented by the following formula (III) is particularly preferable. Next, formula (III) is explained.

Formula (III)

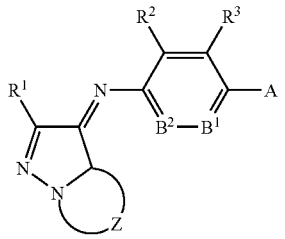

In formula (III), $R^9$ represents a hydrogen atom, an aliphatic group, an aromatic group, a heterocyclic group, a cyano group, $—OR^{11}$, $—SR^{12}$, $—CO_2R^{13}$, $—OCOR^{14}$, $—NR^{15}R^{16}$, $—CONR^{17}R^{18}$, $—SO_2R^{19}$, $—SO_2NR^{20}R^{21}$, $—NR^{22}CONR^{23}R^{24}$, $—NR^{25}CO_2R^{26}$, $—COR^{27}$, $—NR^{28}COR^{29}$, or $—NR^{30}SO_2R^{31}$. $R^{11}$, $R^{12}$, $R^{13}$, $R^{14}$, $R^{15}$, $R^{16}$, $R^{17}$, $R^{18}$, $R^{19}$, $R^{20}$, $R^{21}$, $R^{22}$, $R^{23}$, $R^{24}$, $R^{25}$, $R^{26}$, $R^{27}$, $R^{28}$, $R^{29}$, $R^{30}$, and $R^{31}$ each independently represent one selected from a hydrogen atom, an aliphatic group or an aromatic group.

Z represents an atomic group which forms a 5- or 6-membered nitrogen-containing heterocycle which may be substituted by at least one of an aliphatic group, an aromatic group, a heterocyclic group, a cyano group, $—OR^{111}$, $—SR^{112}$, $—CO_2R^{113}$, $—OCOR^{114}$, $NR^{115}R^{116}$, $—CONR^{117}R^{118}$, $SO_2R^{119}$, $—SO_2NR^{120}R^{121}$, $—NR^{122}CONR^{123}R^{124}$, $—NR^{125}CO_2R^{126}$, $—COR^{127}$, $—NR^{128}COR^{129}$, or $—NR^{130}SO_2R^{131}$. The heterocycle may further form a condensed ring with another ring.

$R^{111}$, $R^{112}$, $R^{113}$, $R^{114}$, $R^{115}$, $R^{116}$, $R^{117}$, $R^{118}$, $R^{119}$, $R^{120}$, $R^{121}$, $R^{122}$, $R^{123}$, $R^{124}$, $R^{125}$, $R^{126}$, $R^{127}$, $R^{128}$, $R^{129}$, $R^{130}$, and $R^{131}$ each independently represent a hydrogen atom, an aliphatic group, or an aromatic group. $R^2$, $R^3$, A, $B^1$ and $B^2$ each have the same meaning as in the above-mentioned formula (I) and those preferable ranges are also the same.

Among the compounds represented by formula (III) described above, A is more preferably $—NR^4R^5$.

Next, the compound represented by formula (III) described above is explained in more detail. $R^9$ described above is preferably a hydrogen atom, an aliphatic group, an aromatic group, $—OR^{11}$, $—SR^{12}$, $—NR^{15}R^{16}$, $—SO_2R^{19}$, $—NR^{22}CONR^{23}R^{24}$, $—NR^{25}CO_2R^{26}$, $—NR^{28}$ $COR^{29}$, or $—NR^{30}SO_2R^{31}$; more preferably a hydrogen atom, an aliphatic group, an aromatic group, $—OR^{11}$, or $—NR^{15}R^{16}$; even more preferably a hydrogen atom, an alkyl group, a substituted alkyl group, an aryl group, a substituted aryl group, an alkoxy group, a substituted alkoxy group, a phenoxy group, a substituted phenoxy group, a dialkylamino group, or a substituted dialkylamino group; further preferably a hydrogen atom, an alkyl group having 1 to 50 carbon atoms, a substituted alkyl group having 1 to 50 carbon atoms, an aryl group having 6 to 50 carbon atoms, or a substituted aryl group having 6 to 50 carbon atoms; and most preferably a hydrogen atom, an alkyl group having 1 to 30 carbon atoms, or a substituted alkyl group having 1 to 30 carbon atoms.

Z described above preferably forms a 5- or 6-membered nitrogen-containing heterocycle, and more preferably forms a 5-membered nitrogen-containing heterocycle. Examples of the 5-membered nitrogen-containing heterocycle include an imidazole ring, a triazole ring, and a tetrazole ring.

And, among the compounds represented by formula (I) described above, a pyrazolotriazole azomethine compound represented by the following formula (IV) is particularly preferable.

Formula (IV)

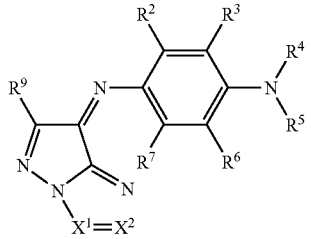

In formula (IV), $R^2$, $R^3$, $R^4$, $R^5$, $R^6$, $R^7$, and $R^9$ each have the same meaning as in formulae (I) and (III). And in formula (IV) described above, $X^1$ and $X^2$ each independently represent —C($R^{10}$)═ or —N═. $R^{10}$ represents one selected from a hydrogen atom, an aliphatic group, or an aromatic group. One of $X^1$ and $X^2$ is always —N═, and $X^1$ and $X^2$ are not simultaneously —N═.

At this time, $R^{10}$ described above is preferably a hydrogen atom, an alkyl group, a substituted alkyl group, an aryl group, or a substituted aryl group, more preferably a hydrogen atom, a substituted alkyl group having 1 to 100 carbon atoms, or a substituted aryl group having 1 to 100 carbon atoms, and particularly preferably a substituted alkyl group having 1 to 30 carbon atoms or a substituted aryl group having 1 to 30 carbon atoms.

In formula (IV) described above, more preferable is a pyrazolotriazole azomethine compound in which $X^1$ is —N═and $X^2$ is —C($R^{10}$)═.

The compound represented by formula (I) to (IV) used in the present invention may exist as a partial structure of polymer and the rule of carbon number in the above-mentioned substituent is not applied in this case.

Concerning the existence form as a partial structure of polymer, the compound represented by formula (I) to (IV) may be either the form existing in the main chain of polymer or the form existing as a side chain.

Specific examples of the compound according to the present invention are described below, but the invention is not limited thereto.

1

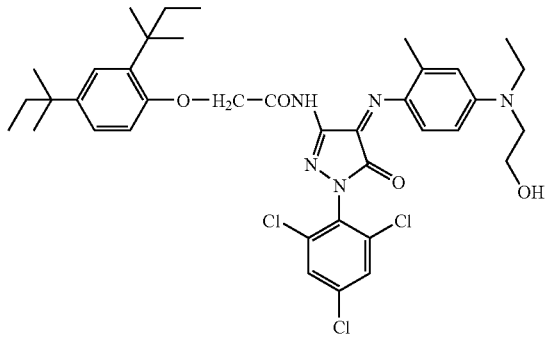

2

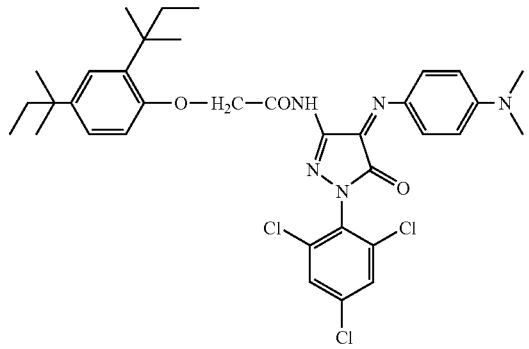

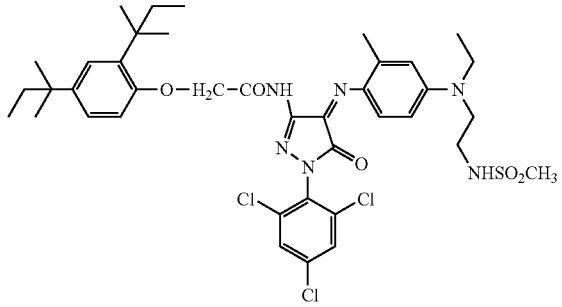

4

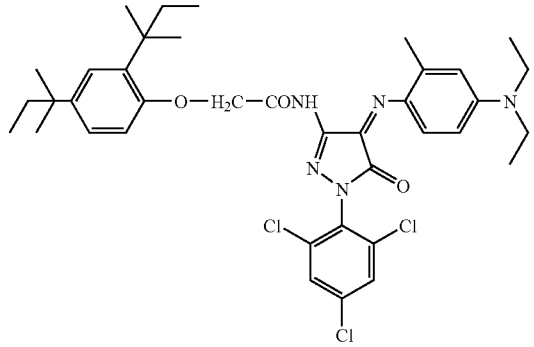

-continued
5
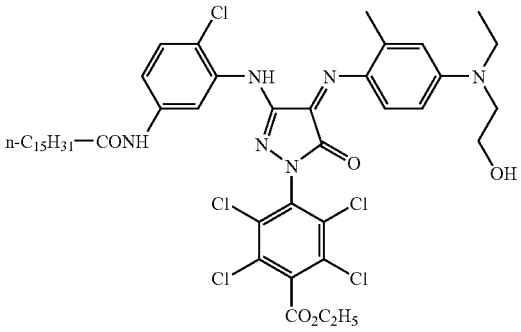
6
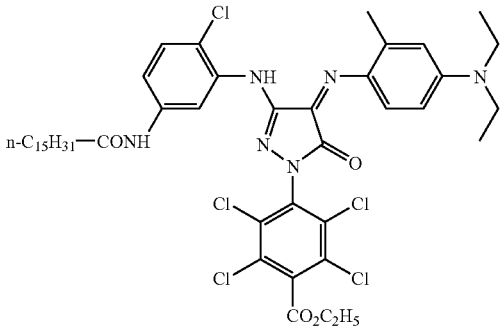
7
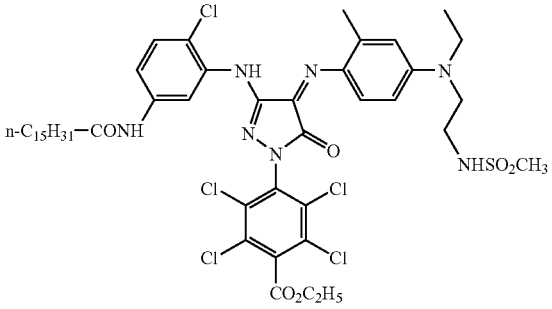
8
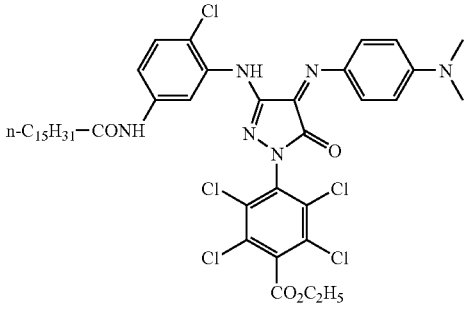
9
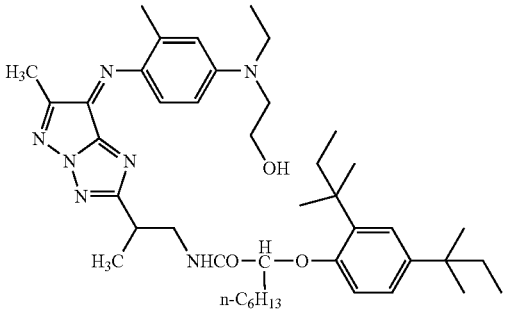
10
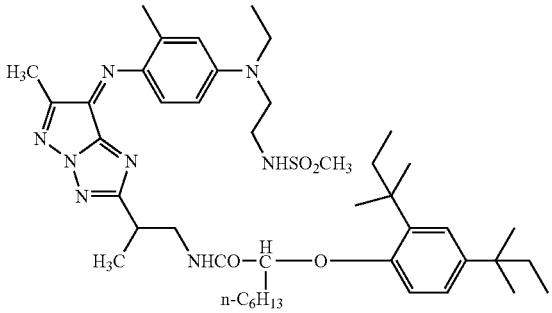
11
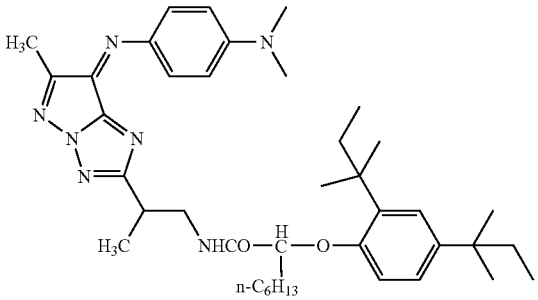
12
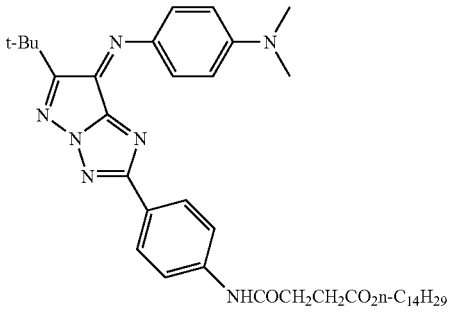

-continued
13
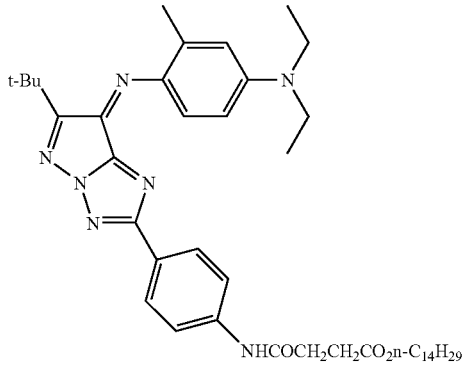
14
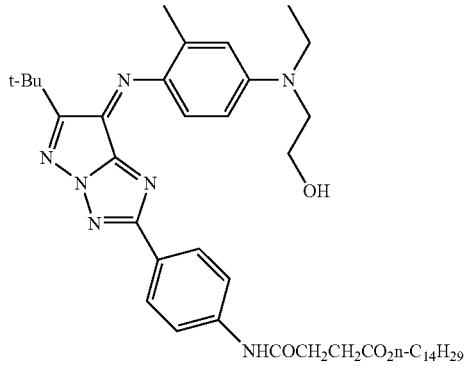
15
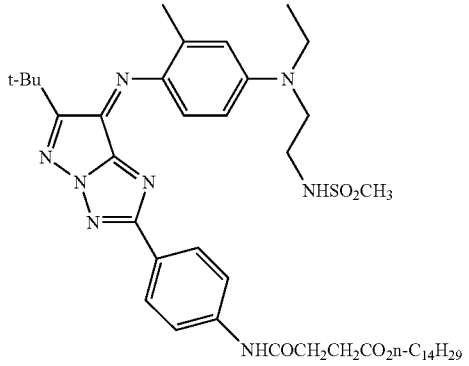
16
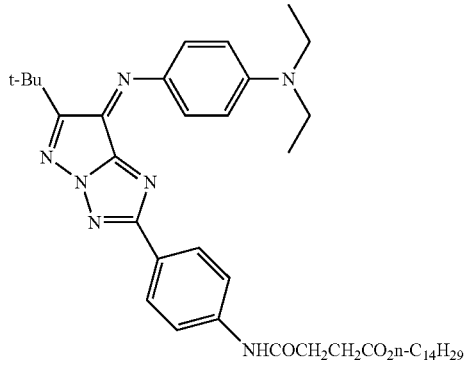
17
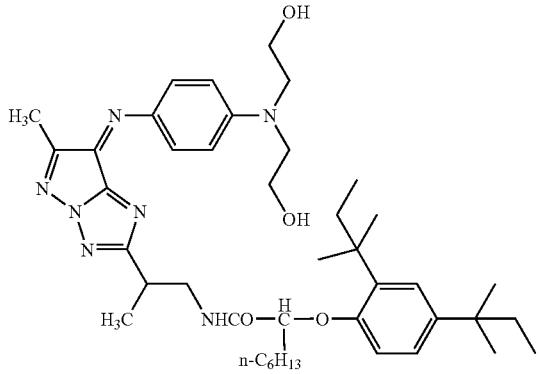
18
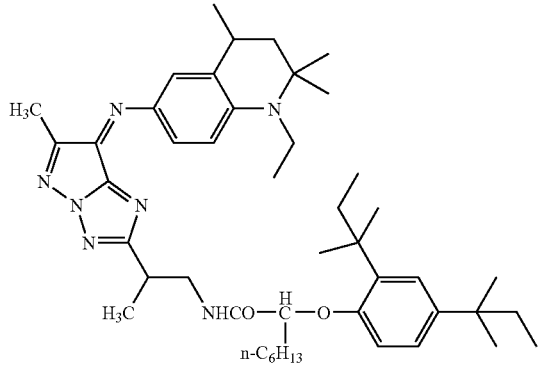
19
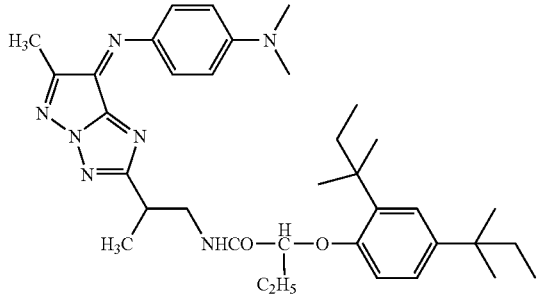
20
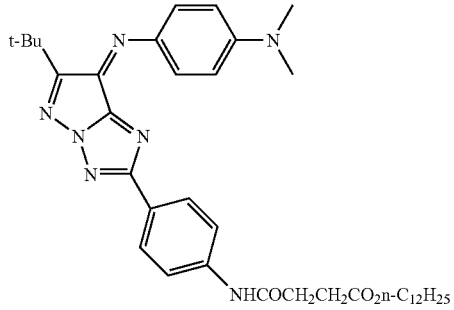

-continued
21
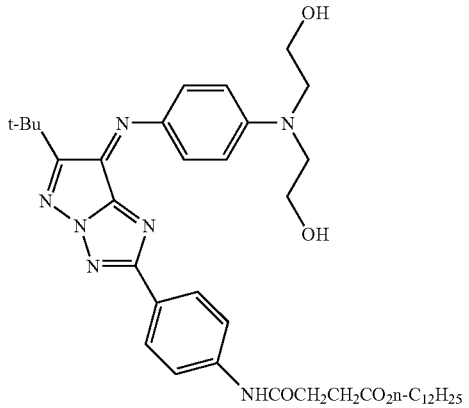
22
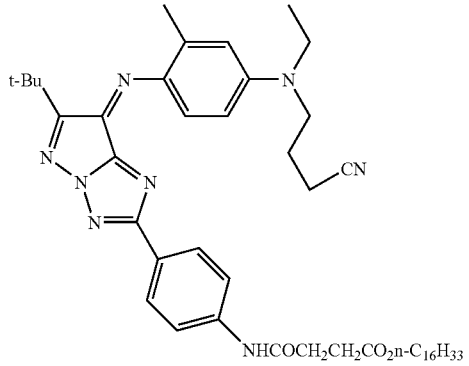
23
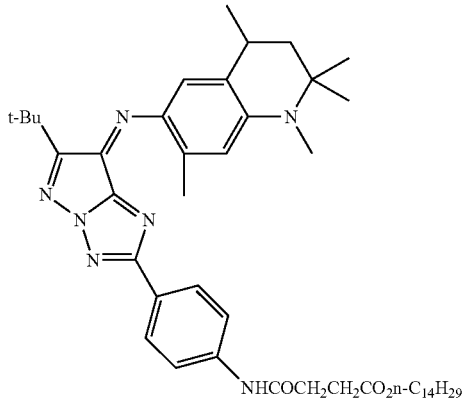
24
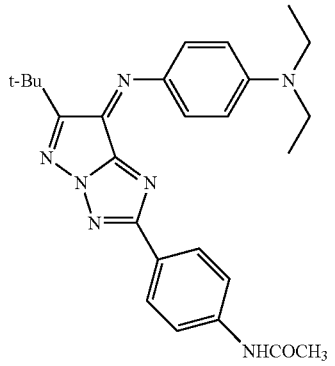
25
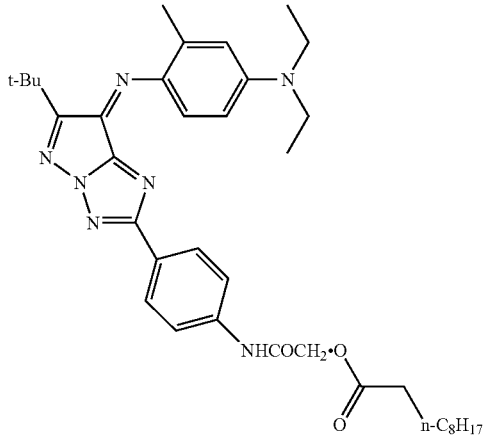
26
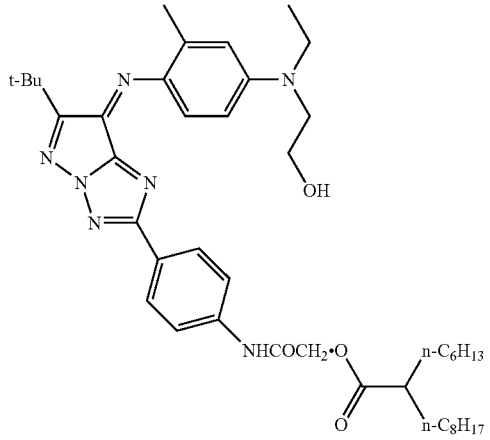

-continued
27
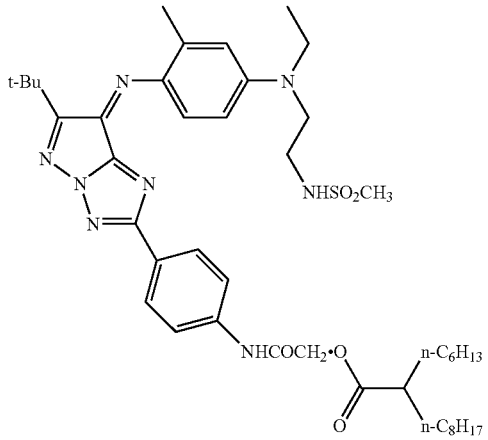
28
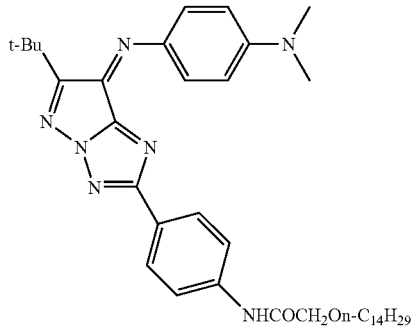
29
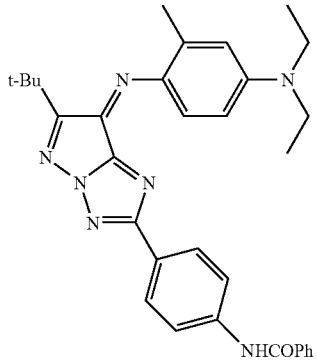
30
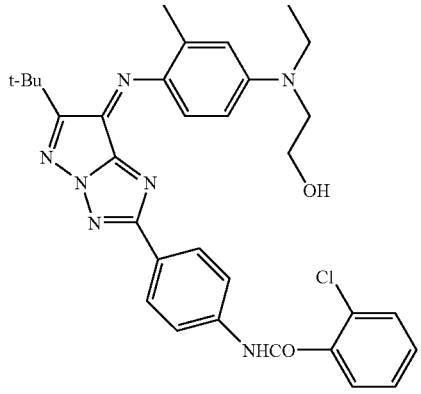
31
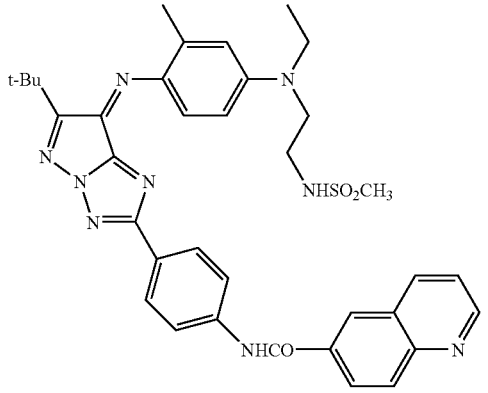
32
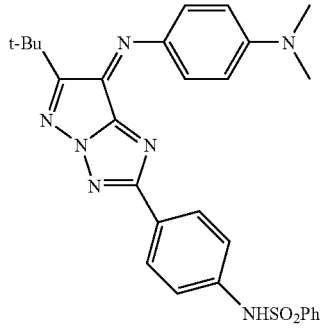
33
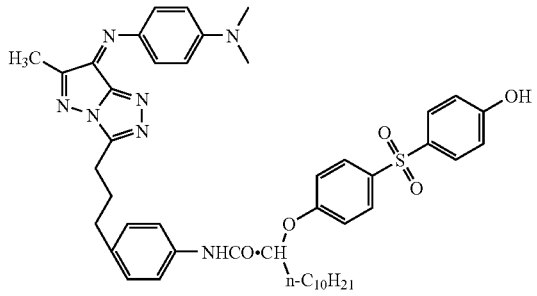
34
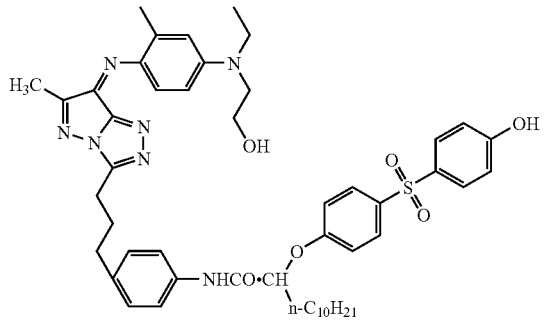

-continued
35
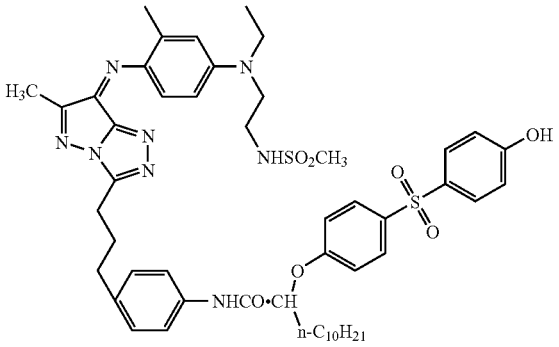
36
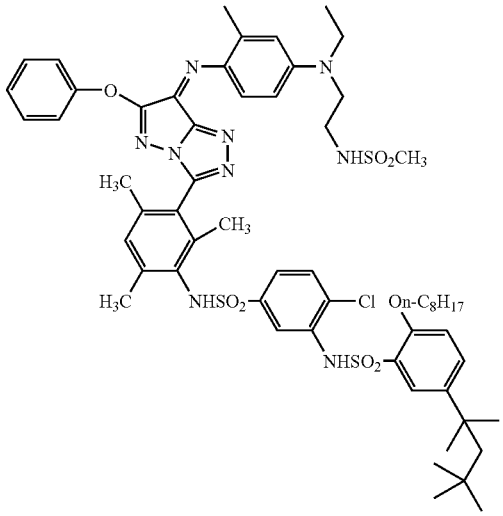
37
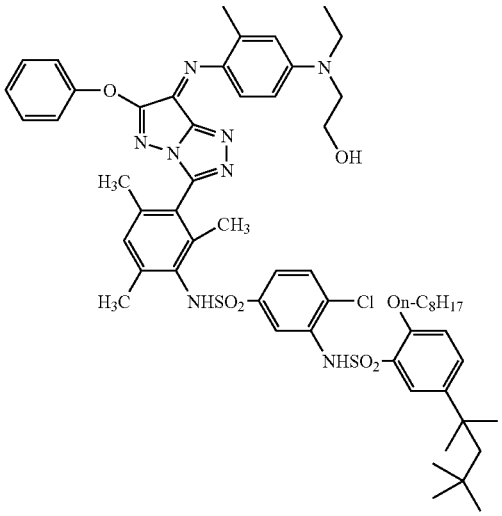
38
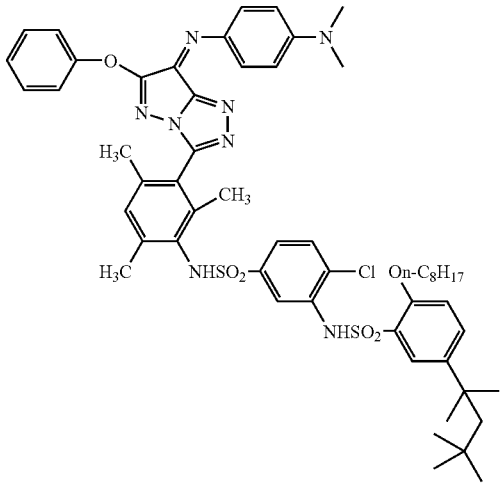
39
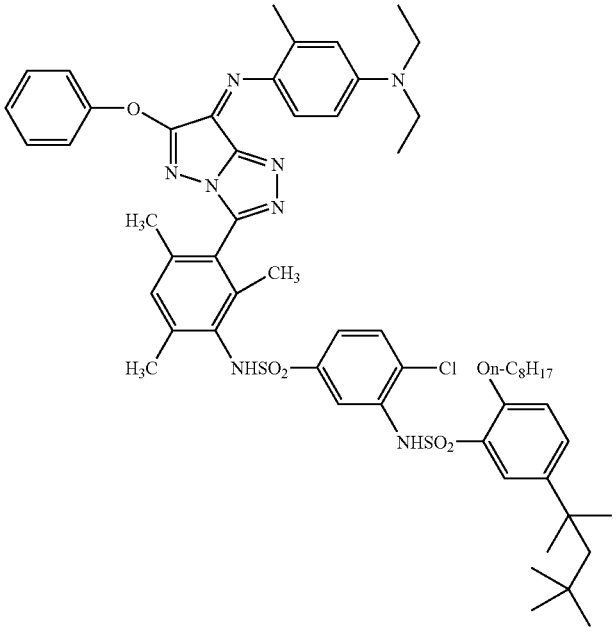

-continued

40

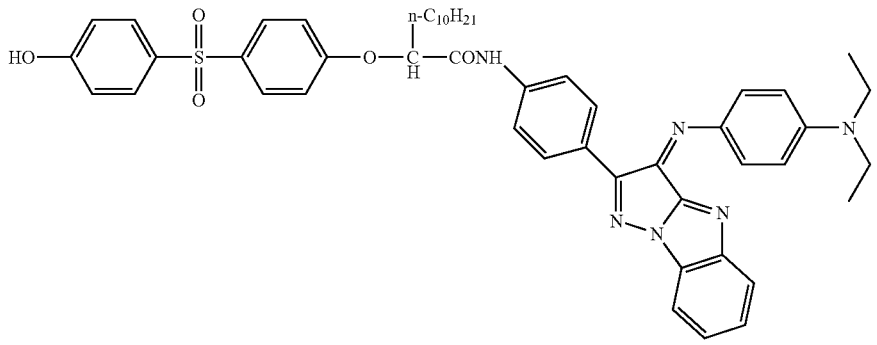

41

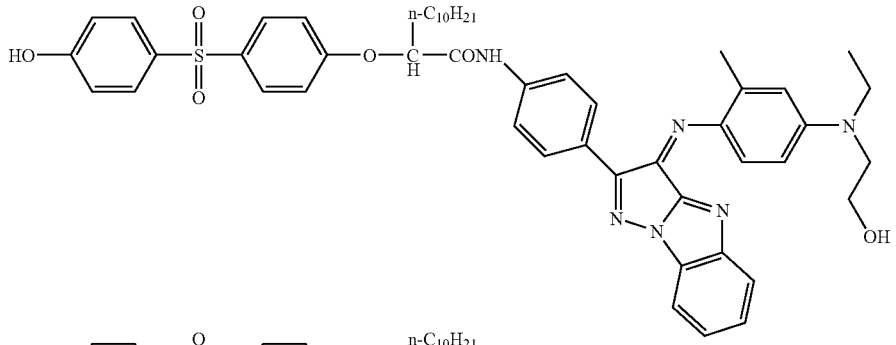

42

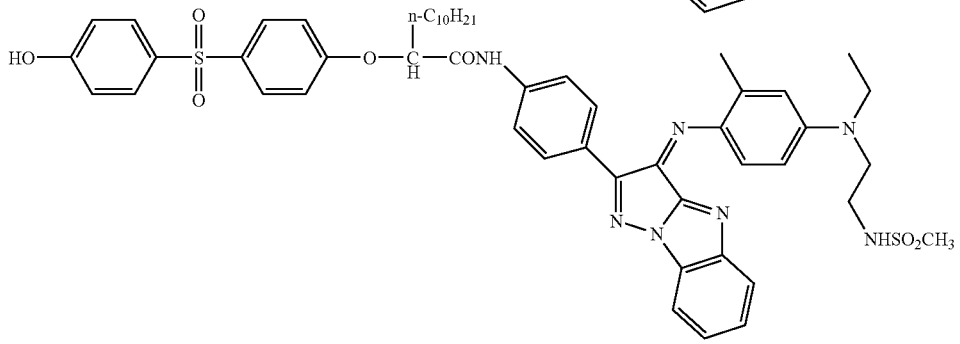

In addition, as azomethine dyes which can be used in the present invention, there can be mentioned the compounds of formula (I) described in JP-A No. 4-247449, formula (I) described in JP-A No. 63-145281, formula (I) described in JP-A No. 2002-256164, formula (I) described in JP-A No. 3-244593, formula (I) described in JP-A No. 3-7386, formulae (II), (III), and (IV) described in JP-A No. 2-252578, formulae (I), and (II) described in JP-A No. 4-359967, formulae (I) and (II) described in JP-A No. 4-359968, and the like. Dyes described in these patents can be also included as specific compounds.

<Synthetic Method and Synthetic Example>

The dyes represented by the aforementioned formula (I) can be synthesized based on the methods described in, for example, JP-A Nos. 60-32851 and 4-126772, and Japanese Patent Application Publication (JP-B) No. 7-94180.

Synthesis of the illustrated compound No. 15

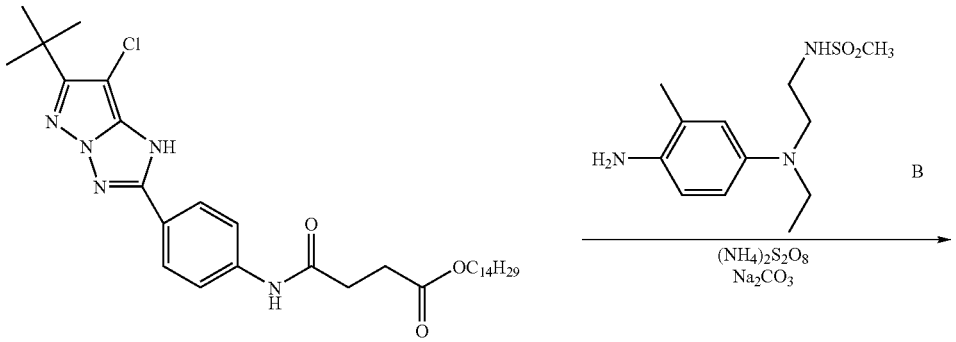

A B

-continued

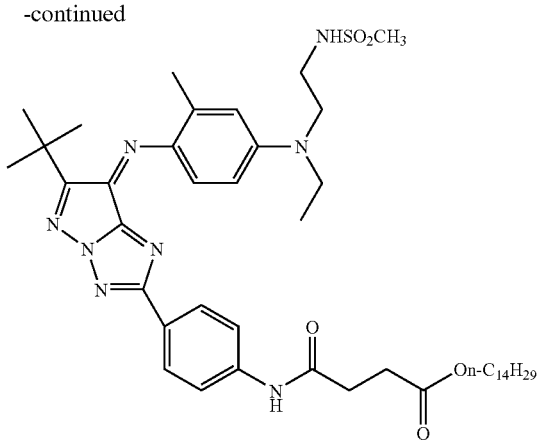

Illustrated compound No.15

To the mixture of compound A (14.7 g (25 mmol) synthesized by the method described in JP-A No. 7-316161), phenylenediamine derivative B containing 3/2 sulfate and 1 hydrate (16.4 g (44.4 mmol)), isopropanol (60 mL), water (100 mL), and $K_2CO_3$ (19 g (138 mmol)) was dropped an aqueous solution (250 mL) of ammonium persulfate (9.43 g (41.3 mmol)) over one hour at room temperature. After finishing the dropping, the reaction mixture was stirred for two hours at room temperature and the aqueous phase was removed after separating solution. The organic phase was washed with diluted hydrochloric acid, dried by sodium sulfate, and condensed.

The crude product obtained here was purified by column chromatography to obtain the illustrated compound No. 15 (14.1 g, yield of 69%). $^1$H NMR: (400 MHz, $CDCl_3$) δ: 9.02 (t, J=8.8 Hz, 1H), 8.13 (d, J=8.4 Hz, 2H), 7.95 (s, 1H), 7.63 (d, J=8.8 Hz, 2H), 6.57-6.60 (m, 2H), 5.27 (t, J=6.4 Hz, 1H), 4.11 (t, J=6.8 Hz, 2H) 3.67 (t, J=6.6 Hz, 2H), 3.59 (q, J=7.1 Hz, 2H), 3.47 (q, J=6.5 Hz, 2H), 3.03 (s, 3H), 2.68-2.80 (m, 4H), 2.28 (s, 3H), 1.2-1.7 (36H), and 0.87 (t, J=6.8 Hz, 3H).

<Adding Method of Dye>

The water-insoluble azomethine dye of the present invention can be added in the form of an emulsified dispersion prepared by dissolving the dye in an organic solvent having a high boiling point and then dispersing in water, or in the form of a solid fine particle dispersion. The emulsified dispersion can be used as a fine particle dispersion prepared by a colloidal mill, homogenizer, Manton-gaulin dispersing apparatus, or the like using a high boiling point-organic solvent which has a boiling point of 200° C. or higher under an ordinary pressure, dispersing agent such as a surfactant and a polymer, a protective colloid, and if necessary, an auxiliary solvent having a low boiling point. As the high boiling point-organic solvent, phosphate esters, phosphonate esters, phthalate esters, terephthalate esters, benzoate esters, torimellitate esters, aliphatic dicarboxylate esters, amidic oils, phenolic oils, etheric oils, and epoxy type oils are preferably used. Among them, phosphate esters, phthalate esters, and aliphatic dicarboxylate esters are preferable. As the surfactant, any of an anionic surfactant, a nonionic surfactant, a cationic surfactant, a betaine surfactant, and the like can be used, and particularly, a sulfonic anionic surfactant and a polyetheric nonionic surfactant are preferable. As the dispersing agent, polymers such as povals, modified povals, polyamides, and polyethers are preferable, and particularly, alkylthio modified poval, poly(vinyl pyrrolidone), and block copolymer of propylene oxide and ethylene oxide are preferable.

When the dye is added in the form of a solid fine particle dispersion, the powder of the dye can be dispersed by means of a ball mill such as ultra visco mill, super apex mill, or the like in the presence of a surfactant or a dispersing agent. As the surfactant, any of an anionic surfactant, a nonionic surfactant, a cationic surfactant, a betaine surfactant, and the like can be used, but particularly, a sulfonic anionic surfactant and a polyetheric nonionic surfactant are preferable. As the dispersing agent, polymers such as povals, modified povals, polyamides, and polyethers are preferable, and an alkylthio modified poval, poly(vinyl pyrrolidone), and a block copolymer of propylene oxide and ethylene oxide are particularly preferable.

The water-insoluble azomethine dye of the present invention is more preferably added as a solid fine particle dispersion which can be dispersed and added without using an auxiliary solvent having a low boiling point and an organic solvent having a high boiling point.

<Layer to be Added>

The water-insoluble azomethine dye represented of the present invention is added in at least one layer of an image forming layer and a non-photosensitive layer. When the dye is added in the non-photosensitive layer, the non-photosensitive layer may be disposed on the same side of the support as the image forming layer, or may be a back layer disposed on the opposite side of the support from the image forming layer. As the layer disposed on the same side of the support as the image forming layer, it may be disposed farther from the support than the image forming layer or may be disposed between the support and the image forming layer. The dye of the present invention may be added on both sides of the support. Preferably, the dye is added in the image forming layer.

<Range of Addition Amount>

To adjust the image tone after thermal developing process in a preferable level, the addition amount of the water-insoluble azomethine dye is determined by the combination with a color tone of developed silver image or a color tone obtained by other additives. The dye is used at an amount as such that the optical density does not exceed 1.0 when measured at the desired wavelength. The optical density is from 0.01 to 0.5, preferably from 0.02 to 0.3, and more preferably from 0.05 to 0.2. To obtain the above optical density, the addition amount of the water-insoluble azomethine dye is from 1 mg/m$^2$ to 50 mg/m$^2$, preferably from 2 mg/m$^2$ to 30 mg/m$^2$, and more preferably from 5 mg/m$^2$ to 20 mg/m$^2$.

<Using Ratio with Phthalocyanine Dye>

A preferable base color tone and an image color tone can be obtained in a balance of the coating amount of phthalocyanine dye and water-insoluble azomethine dye. Although using ratio of them are not particularly limited, it is desirable to use by adjusting the mass ratio of [phthalocyanine dye: water-insoluble azomethine dye] to be in a range of from 100:1 to 1:1, more preferably from 50:1 to 2:1, and even more preferably from 25:1 to 5:1.

(Non-Photosensitive Organic Silver Salt)

1) Composition

The organic silver salt which can be used in the present invention is relatively stable to light but serves as to supply silver ions and forms silver images when heated to 80° C. or higher in the presence of an exposed photosensitive silver halide and a reducing agent. The organic silver salt may be any material containing a source supplying silver ions that are reducible by a reducing agent. Such a non-photosensitive organic silver salt is disclosed, for example, in JP-A No. 10-62899 (paragraph Nos. 0048 to 0049), EP No. 0803764A1 (page 18, line 24 to page 19, line 37), EP No. 0962812A1, JP-A Nos. 11-349591, 2000-7683, and 2000-72711, and the like. A silver salt of an organic acid, particularly, a silver salt of a long chained aliphatic carboxylic acid (having 10 to 30 carbon atoms, and preferably having 15 to 28 carbon atoms) is preferable. Preferred examples of the silver salt of a fatty acid can include, for example, silver lignocerate, silver behenate, silver arachidinate, silver stearate, silver oleate, silver laurate, silver capronate, silver myristate, silver palmitate, silver erucate, and mixtures thereof.

In the invention, among these silver salts of a fatty acid, it is preferred to use a silver salt of a fatty acid with a silver behenate content of 50 mol % or higher, more preferably, 85 mol % or higher, and even more preferably, 95 mol % or higher. Further, it is preferred to use a silver salt of a fatty acid with a silver erucate content of 2 mol % or lower, more preferably, 1 mol % or lower, and even more preferably, 0.1 mol % or lower.

It is preferred that the content of silver stearate is 1 mol % or lower. When the content of silver stearate is 1 mol % or lower, a silver salt of an organic acid having low fog, high sensitivity and excellent image storability can be obtained. The above-mentioned content of silver stearate is preferably 0.5 mol % or lower, and particularly preferably, silver stearate is not substantially contained.

Further, in the case where the silver salt of an organic acid includes silver arachidinate, it is preferred that the content of silver arachidinate is 6 mol % or lower in order to obtain a silver salt of an organic acid having low fog and excellent image storability. The content of silver arachidinate is more preferably 3 mol % or lower.

2) Shape

There is no particular restriction on the shape of the organic silver salt usable in the invention and it may be needle-like, bar-like, tabular, or flake shaped.

In the invention, a flake shaped organic silver salt is preferred. Short needle-like, rectangular, cubic, or potato-like indefinite shaped particles with the major axis to minor axis ratio being 5 or lower are also used preferably. Such organic silver salt particles suffer less from fogging during thermal development compared with long needle-like particles with the major axis to minor axis length ratio of higher than 5. Particularly, a particle with the major axis to minor axis ratio of 3 or lower is preferred since it can improve the mechanical stability of the coating film. In the present specification, the flake shaped organic silver salt is defined as described below. When an organic silver salt is observed under an electron microscope, calculation is made while approximating the shape of an organic silver salt particle to a rectangular body and assuming each side of the rectangular body as a, b, c from the shorter side (c may be identical with b) and determining x based on numerical values a, b for the shorter side as below.

$$x=b/a$$

As described above, x is determined for the particles by the number of about 200 and those capable of satisfying the relation: x (average)≧1.5 as an average value x is defined as a flake shape. The relation is preferably: 30≧x (average)≧1.5 and, more preferably, 15≧x (average)≧1.5. By the way, needle-like is expressed as 1≦x (average)<1.5.

In the flake shaped particle, a can be regarded as a thickness of a tabular particle having a major plane with b and c being as the sides. a in average is preferably from 0.01 μm to 0.3 μm and, more preferably, from 0.1 μm to 0.23 μm. c/b in average is preferably from 1 to 9, more preferably from 1 to 6, even more preferably from 1 to 4 and, most preferably from 1 to 3.

By controlling the equivalent spherical diameter being from 0.05 μm to 1 μm, it causes less agglomeration in the photothermographic material and image storability is improved. The equivalent spherical diameter is preferably from 0.1 μm to 1 μm.

In the invention, an equivalent spherical diameter can be measured by a method of photographing a sample directly by using an electron microscope and then image processing the negative images.

In the flake shaped particle, the equivalent spherical diameter of the particle/a is defined as an aspect ratio. The aspect ratio of the flake particle is preferably from 1.1 to 30 and, more preferably, from 1.1 to 15 with a viewpoint of causing less agglomeration in the photothermographic material and improving the image storability.

As the particle size distribution of the organic silver salt, monodispersion is preferred. In the monodispersion, the percentage for the value obtained by dividing the standard deviation for the length of minor axis and major axis by the minor axis and the major axis respectively is, preferably, 100% or less, more preferably, 80% or less and, even more preferably, 50% or less. The shape of the organic silver salt can be measured by analyzing a dispersion of an organic silver salt as transmission type electron microscopic images. Another method of measuring the monodispersion is a method of determining of the standard deviation of the volume weighted mean diameter of the organic silver salt in which the percentage for the value defined by the volume weight mean diameter (variation coefficient), is preferably, 100% or less, more preferably, 80% or less and, even more preferably, 50% or less. The monodispersion can be determined from particle size (volume weighted mean diameter) obtained, for example, by a measuring method of irradiating a laser beam to organic silver salts dispersed in a liquid, and determining a self correlation function of the fluctuation of scattered light to the change of time.

3) Preparation

Methods known in the art can be applied to the method for producing the organic silver salt used in the invention and to the dispersing method thereof. For example, reference can be made to JP-A No. 10-62899, EP Nos. 0803763A 1 and 0962812A 1, JP-A Nos. 11-349591, 2000-7683, 2000-72711, 2001-163889, 2001-163890, 2001-163827, 2001-33907, 2001-188313, 2001-83652, 2002-6442, 2002-49117, 2002-31870, and 2002-107868, and the like.

When a photosensitive silver salt is present together during dispersion of the organic silver salt, fog increases and sensitivity becomes remarkably lower, so that it is more preferred that the photosensitive silver salt is not substantially contained during dispersion. In the invention, the amount of the photosensitive silver salt to be dispersed in the aqueous dispersion is preferably 1 mol % or less, more preferably 0.1 mol % or less, per 1 mol of the organic silver salt in the solution and, even more preferably, positive addition of the photosensitive silver salt is not conducted.

In the invention, the photothermographic material can be prepared by mixing an aqueous dispersion of the organic silver salt and an aqueous dispersion of a photosensitive silver salt and the mixing ratio between the organic silver salt and the photosensitive silver salt can be selected depending on the purpose. The ratio of the photosensitive silver salt relative to the organic silver salt is preferably in a range of from 1 mol % to 30 mol %, more preferably, from 2 mol % to 20 mol % and, particularly preferably, 3 mol % to 15 mol %. A method of mixing two or more aqueous dispersions of organic silver salts and two or more aqueous dispersions of photosensitive silver salts upon mixing is used preferably for controlling the photographic properties.

4) Addition Amount

While the organic silver salt according to the invention can be used in a desired amount, a total amount of coated silver including silver halide is preferably in a range of from 0.1 $g/m^2$ to 3.0 $g/m^2$, more preferably from 0.5 $g/m^2$ to 2.0 $g/m^2$, and even more preferably from 0.8 $g/m^2$ to 1.7 $g/m^2$. In particular, in order to improve image storability, the total amount of coated silver is preferably 1.5 $mg/m^2$ or less, and more preferably 1.3 $mg/m^2$ or less.

In the case where a preferable reducing agent of the invention is used, it is possible to obtain a sufficient image density by even such a low amount of silver.

(Reducing Agent)

The photothermographic material of the present invention preferably contains a reducing agent for organic silver salts as a thermal developing agent. The reducing agent for organic silver salts can be any substance (preferably, organic substance) which reduces silver ions into metallic silver. Examples of the reducing agent are described in JP-A No. 11-65021 (column Nos. 0043 to 0045) and EP No. 0803764 (p. 7, line 34 to p. 18, line 12).

The reducing agent according to the invention is preferably a so-called hindered phenolic reducing agent or a bisphenol agent having a substituent at the ortho-position to the phenolic hydroxy group. It is more preferably a reducing agent represented by the following formula (R).

Formula (R)

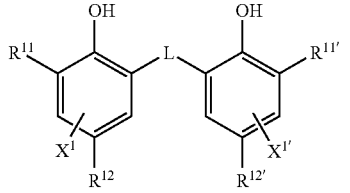

In formula (R), $R^{11}$ and $R^{11'}$ each independently represent an alkyl group having 1 to 20 carbon atoms. $R^{12}$ and $R^{12'}$ each independently represent a hydrogen atom or a group substituting for a hydrogen atom on a benzene ring. L represents an —S— group or a —$CHR^{13}$— group. $R^{13}$ represents a hydrogen atom or an alkyl group having 1 to 20 carbon atoms. $X^1$ and $X^{1'}$ each independently represent a hydrogen atom or a group substituting for a hydrogen atom on a benzene ring.

Formula (R) is to be described in detail.

1) $R^{11}$ and $R^{11'}$ $R^{11}$ and $R^{11'}$ each independently represent a substituted or unsubstituted alkyl group having 1 to 20 carbon atoms. The substituent for the alkyl group has no particular restriction and can include, preferably, an aryl group, a hydroxy group, an alkoxy group, an aryloxy group, an alkylthio group, an arylthio group, an acylamino group, a sulfonamide group, a sulfonyl group, a phosphoryl group, an acyl group, a carbamoyl group, an ester group, a ureido group, a urethane group, a halogen atom, and the like.

2) $R^{12}$ and $R^{12'}$, $X^1$ and $X^{1'}$ $R^{12}$ and $R^{12'}$ each independently represent a hydrogen atom or a group substituting for a hydrogen atom on a benzene ring. $X^1$ and $X^{1'}$ each independently represent a hydrogen atom or a group substituting for a hydrogen atom on a benzene ring. As each of the groups substituting for a hydrogen atom on the benzene ring, an alkyl group, an aryl group, a halogen atom, an alkoxy group, and an acylamino group are described preferably.

3) L

L represents an —S— group or a —$CHR^{13}$— group. $R^{13}$ represents a hydrogen atom or an alkyl group having 1 to 20 carbon atoms in which the alkyl group may have a substituent. Specific examples of the unsubstituted alkyl group for $R^{13}$ can include, for example, a methyl group, an ethyl group, a propyl group, a butyl group, a heptyl group, an undecyl group, an isopropyl group, a 1-ethylpentyl group, a 2,4,4-trimethylpentyl group, cyclohexyl group, 2,4-dimethyl-3-cyclohexenyl group, 3,5-dimethyl-3-cyclohexenyl group, and the like. Examples of the substituent for the alkyl group can include, similar to the substituent of $R^{11}$, a halogen atom, an alkoxy group, an alkylthio group, an aryloxy group, an arylthio group, an acylamino group, a sulfonamide group, a sulfonyl group, a phosphoryl group, an oxycarbonyl group, a carbamoyl group, a sulfamoyl group, and the like.

4) Preferred Substituents $R^{11}$ and $R^{11'}$ are preferably a primary, secondary, or tertiary alkyl group having 1 to 15 carbon atoms and can include, specifically, a methyl group, an isopropyl group, a t-butyl group, a t-amyl group, a t-octyl group, a cyclohexyl group, a cyclopentyl group, a 1-methylcyclohexyl group, a 1-methylcyclopropyl group, and the like. $R^{11}$ and $R^{11'}$ each represent, more preferably, an alkyl group having 1 to 8 carbon atoms and, among them, a methyl group, a t-butyl group, a t-amyl group, and a 1-methylcyclohexyl group are further preferred and, a methyl group and a t-butyl group being most preferred.

$R^{12}$ and $R^{12'}$ are preferably an alkyl group having 1 to 20 carbon atoms and can include, specifically, a methyl group, an ethyl group, a propyl group, a butyl group, an isopropyl group, a t-butyl group, a t-amyl group, a cyclohexyl group, a 1-methylcyclohexyl group, a benzyl group, a methoxymethyl group, a methoxyethyl group, and the like. More preferred are a methyl group, an ethyl group, a propyl group, an isopropyl group, and a t-butyl group, and particularly preferred are a methyl group and an ethyl group.

$X^1$ and $X^{1'}$ are preferably a hydrogen atom, a halogen atom, or an alkyl group, and more preferably a hydrogen atom.

L is preferably a —$CHR^{13}$— group.

$R^{13}$ is preferably a hydrogen atom or an alkyl group having 1 to 15 carbon atoms. The alkyl group is preferably a chain or a cyclic alkyl group. And, a group which has a C═C bond in these alkyl group is also preferably used. Preferable examples of the alkyl group can include a methyl group, an ethyl group, a propyl group, an isopropyl group, a 2,4,4-trimethylpentyl group, a cyclohexyl group, a 2,4-dimethyl-3-cyclohexenyl group, a 3,5-dimetyl-3-cyclohexenyl group and the like. Particularly preferable $R^{13}$ is a hydrogen atom, a methyl group, an ethyl group, a propyl group, an isopropyl group, or a 2,4-dimethyl-3-cyclohexenyl group.

In the case where $R^{11}$ and $R^{11'}$ are a tertiary alkyl group and $R^{12}$ and $R^{12'}$ are a methyl group, $R^{13}$ preferably is a primary or secondary alkyl group having 1 to 8 carbon atoms (a methyl group, an ethyl group, a propyl group, an isopropyl group, a 2,4-dimethyl-3-cyclohexenyl group, or the like).

In the case where $R^{11}$ and $R^{11'}$ are a tertiary alkyl group and $R^{12}$ and $R^{12'}$ are an alkyl group other than a methyl group, $R^{13}$ preferably is a hydrogen atom.

In the case where $R^{11}$ and $R^{11'}$ are not a tertiary alkyl group, $R^{13}$ preferably is a hydrogen atom or a secondary alkyl group, and particularly preferably a secondary alkyl group. As the secondary alkyl group for $R^{13}$, an isopropyl group and a 2,4-dimethyl-3-cyclohexenyl group are preferred.

The reducing agent described above shows different thermal developing performances, color tones of developed silver images, or the like depending on the combination of $R^{11}$, $R^{11'}$, $R^{12}$, $R^{12'}$, and $R^{13}$. Since these performances can be controlled by using two or more reducing agents in combination, it is preferred to use two or more reducing agents in combination depending on the purpose.

Specific examples of the reducing agents of the invention including the compounds represented by formula (R) according to the invention are shown below, but the invention is not restricted to these.

R-1

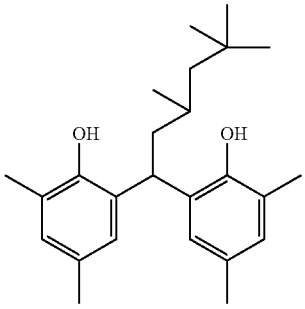

-continued

R-2

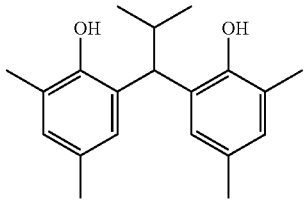

R-3

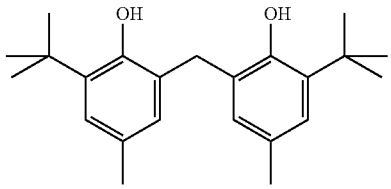

R-4

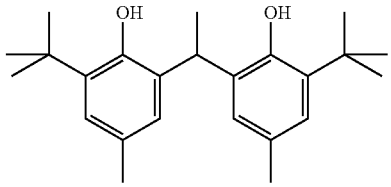

R-5

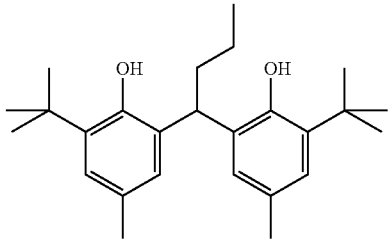

R-6

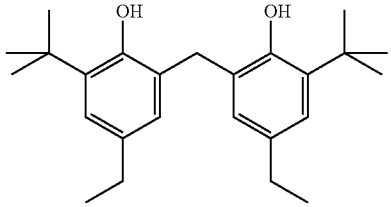

R-7

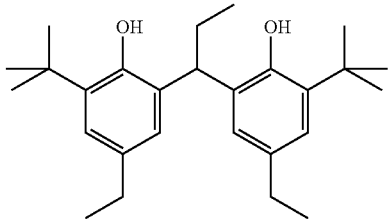

R-8

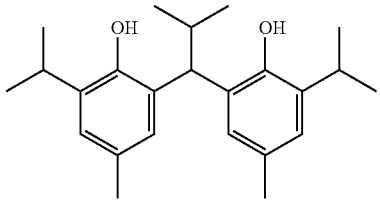

-continued

R-9

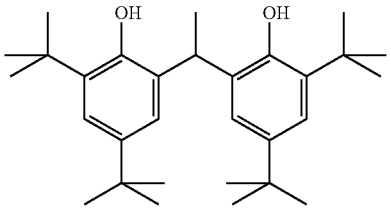

R-10

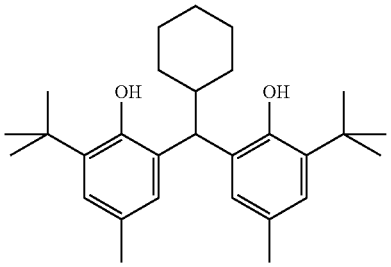

R-11

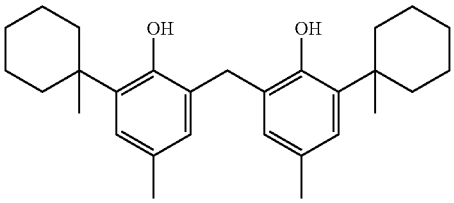

R-12

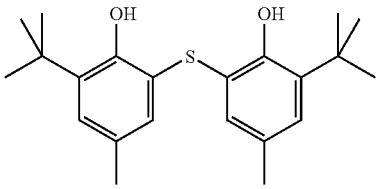

R-13

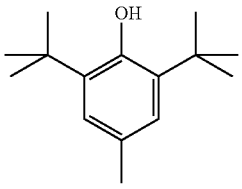

R-14

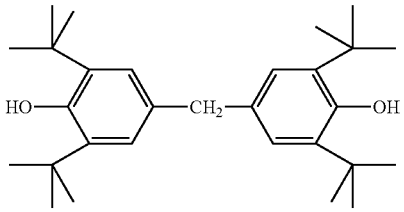

R-15

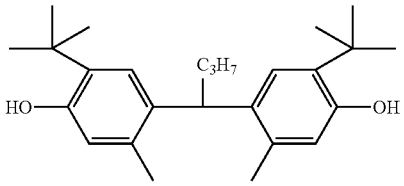

-continued

R-16

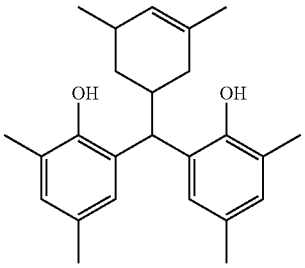

R-17

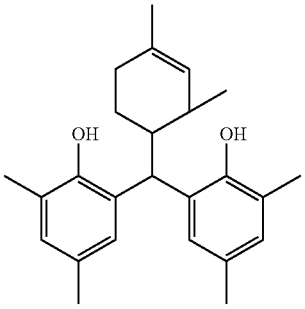

R-18

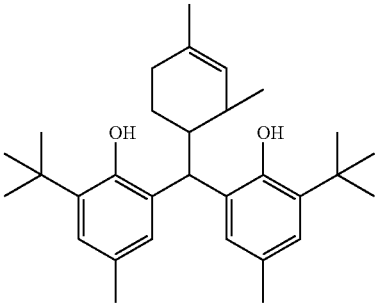

As preferred reducing agents of the invention other than those above, there can be mentioned compounds disclosed in JP-A Nos. 2001-188314, 2001-209145, 2001-350235, and 2002-156727, and EP No. 1278101A2.

The addition amount of the reducing agent is preferably from 0.1 g/m$^2$ to 3.0 g/m$^2$, more preferably from 0.2 g/m$^2$ to 1.5 g/m$^2$ and, even more preferably from 0.3 g/m$^2$ to 1.0 g/m$^2$. It is preferably contained in a range of from 5 mol % to 50 mol %, more preferably from 8 mol % to 30 mol % and, even more preferably from 10 mol % to 20 mol %, per 1 mol of silver in the image forming layer. The reducing agent is preferably contained in the image forming layer.

In the invention, the reducing agent may be incorporated into a photothermographic material by being added into the coating solution, such as in the form of a solution, an emulsified dispersion, a solid fine particle dispersion, or the like.

As a well known emulsified dispersing method, there can be mentioned a method comprising dissolving the reducing agent using an oil such as dibutyl phthalate, tricresyl phosphate, glyceryl triacetate, diethyl phthalate, or the like, as well as an auxiliary solvent such as ethyl acetate, cyclohexanone, or the like; from which an emulsified dispersion is mechanically produced.

As a solid particle dispersing method, there can be mentioned a method comprising dispersing the powder of the reducing agent in a proper solvent such as water or the like, by means of bail mill, colloid mill, vibrating ball mill, sand mill, jet mill, roller mill, or ultrasonics, thereby obtaining solid dispersion. In this case, there may be used a protective colloid (such as poly(vinyl alcohol)), or a surfactant (for instance, an anionic surfactant such as sodium triisopropylnaphthalenesulfonate (a mixture of compounds having the three isopropyl groups in different substitution sites)). In the mills enumerated above, generally used as the dispersion media are beads made of zirconia or the like, and Zr or the like eluting from the beads may be incorporated in the dispersion. Although depending on the dispersing conditions, the amount of Zr or the like incorporated in the dispersion is generally in a range of from 1 ppm to 1000 ppm. It is practically acceptable so long as Zr is incorporated in an amount of 0.5 mg or less per 1 g of silver.

Preferably, an antiseptic (for instance, benzisothiazolinone sodium salt) is added in an aqueous dispersion.

The reducing agent is particularly preferably used as solid particle dispersion, and is added in the form of fine particles having average particle size of from 0.01 μm to 10 μm, preferably from 0.05 μm to 5 μm and, more preferably from 0.1 μm to 2 μm. In the invention, other solid dispersions are preferably used with this particle size range.

(Photosensitive Silver Halide)

1) Halogen Composition

For the photosensitive silver halide used in the invention, there is no particular restriction on the halogen composition and silver chloride, silver bromochloride, silver bromide, silver iodobromide, silver iodochlorobromide, and silver iodide can be used. Among them, silver bromide, silver iodobromide, and silver iodide are preferred. The distribution of the halogen composition in a grain may be uniform or the halogen composition may be changed stepwise, or it may be changed continuously. Further, a silver halide grain having a core/shell structure can be used preferably. Preferred structure is a twofold to fivefold structure and, more preferably, a core/shell grain having a twofold to fourfold structure can be used. Further, a technique of localizing silver bromide or silver iodide to the surface of a silver chloride, silver bromide or silver chlorobromide grains can also be used preferably.

2) Method of Grain Formation

The method of forming photosensitive silver halide is well-known in the relevant art and, for example, methods described in Research Disclosure No. 10729, June 1978 and U.S. Pat. No. 3,700,458 can be used. Specifically, a method of preparing a photosensitive silver halide by adding a silver-supplying compound and a halogen-supplying compound in a gelatin or other polymer solution and then mixing them with an organic silver salt is used. Further, a method described in JP-A No. 11-119374 (paragraph Nos. 0217 to 0224) and methods described in JP-A Nos. 11-352627 and 2000-347335 are also preferred.

3) Grain Size

The grain size of the photosensitive silver halide is preferably small with an aim of suppressing clouding after image formation and, specifically, it is 0.20 μm or less, more preferably, in a range of from 0.01 μm to 0.15 μm and, even more preferably, from 0.02 μm to 0.12 μm. The grain size as used herein means an average diameter of a circle converted such that it has a same area as a projected area of the silver halide grain (projected area of a major plane in a case of a tabular grain).

4) Grain Shape

The shape of the silver halide grain can include, for example, cubic, octahedral, tabular, spherical, rod-like, or potato-like shape. The cubic grain is particularly preferred in the invention. A silver halide grain rounded at corners can also be used preferably. The surface indices (Miller indices) of the outer surface of a photosensitive silver halide grain is not particularly restricted, and it is preferable that the ratio occupied by the {100} face is large, because of showing high spectral sensitization efficiency when a spectral sensitizing dye is adsorbed. The ratio is preferably 50% or higher, more preferably, 65% or higher and, even more preferably, 80% or higher. The ratio of the {100} face, Miller indices, can be determined by a method described in T. Tani; J. Imaging Sci., vol. 29, page 165, (1985) utilizing adsorption dependency of the {111} face and {100} face in adsorption of a sensitizing dye.

5) Heavy Metal

The photosensitive silver halide grain of the invention can contain metals or complexes of metals belonging to groups 6 to 13 of the periodic table (showing groups 1 to 18). Preferred are metals or complexes of metals belonging to groups 6 to 10. The metal or the center metal of the metal complex from groups 6 to 10 of the periodic table is preferably ferrum, rhodium, ruthenium, or iridium. The metal complex may be used alone, or two or more complexes comprising identical or different species of metals may be used together. A preferred content is in a range from $1\times10^{-9}$ mol to $1\times10^{-3}$ mol per 1 mol of silver. The heavy metals, metal complexes and the adding method thereof are described in JP-A No. 7-225449, in paragraph Nos. 0018 to 0024 of JP-A No. 11-65021 and in paragraph Nos. 0227 to 0240 of JP-A No. 11-119374.

In the present invention, a silver halide grain having a hexacyano metal complex present on the outermost surface of the grain is preferred. The hexacyano metal complex includes, for example, $[Fe(CN)_6]^{4-}$, $[Fe(CN)_6]^{3-}$, $[Ru(CN)_6]^{4-}$, $[Os(CN)_6]^{4-}$, $[Co(CN)_6]^{3-}$, $[Rh(CN)_6]^{3-}$, $[Ir(CN)_6]^{3-}$, $[Cr(CN)_6]^{3-}$, and $[Re(CN)_6]^{3-}$.

In the invention, hexacyano Fe complex is preferred.

Since the hexacyano complex exists in ionic form in an aqueous solution, paired cation is not important and alkali metal ion such as sodium ion, potassium ion, rubidium ion, cesium ion and lithium ion, ammonium ion, alkyl ammonium ion (for example, tetramethyl ammonium ion, tetraethyl ammonium ion, tetrapropyl ammonium ion, and tetra (n-butyl)ammonium ion), which are easily miscible with water and suitable to precipitation operation of a silver halide emulsion are preferably used.

The hexacyano metal complex can be added while being mixed with water, as well as a mixed solvent of water and an appropriate organic solvent miscible with water (for example, alcohols, ethers, glycols, ketones, esters, amides, or the like) or gelatin.

The addition amount of the hexacyano metal complex is preferably from $1\times10^{-5}$ mol to $1\times10^{-2}$ mol and, more preferably, from $1\times10^{-4}$ mol to $1\times10^{-3}$ mol, per 1 mol of silver in each case.

In order to allow the hexacyano metal complex to be present on the outermost surface of a silver halide grain, the hexacyano metal complex is directly added in any stage of: after completion of addition of an aqueous solution of silver nitrate used for grain formation, before completion of an emulsion formation step prior to a chemical sensitization step, of conducting chalcogen sensitization such as sulfur sensitization, selenium sensitization and tellurium sensitization or noble metal sensitization such as gold sensitization, during a washing step, during a dispersion step and before a chemical sensitization step. In order not to grow fine silver halide grains, the hexacyano metal complex is rapidly added preferably after the grain is formed, and it is preferably added before completion of the emulsion formation step.

Addition of the hexacyano complex may be started after addition of 96% by weight of an entire amount of silver nitrate to be added for grain formation, more preferably started after addition of 98% by weight and, particularly preferably, started after addition of 99% by weight.

When any of the hexacyano metal complex is added after addition of an aqueous silver nitrate just before completion of grain formation, it can be adsorbed to the outermost surface of the silver halide grain and most of them form an insoluble salt with silver ions on the surface of the grain. Since the hexacyano iron (II) silver salt is a less soluble salt than AgI, re-dissolution with fine grains can be prevented and fine silver halide grains with smaller grain size can be prepared.

6) Gelatin

As the gelatin contained in the photosensitive silver halide emulsion used in the invention, various kinds of gelatins can be used. It is necessary to maintain an excellent dispersion state of a photosensitive silver halide emulsion in an organic silver salt containing coating solution, and gelatin having a molecular weight of 10,000 to 1,000,000 is preferably used. Phthalated gelatin is also preferably used. These gelatins may be used at grain formation step or at the time of dispersion after desalting treatment and it is preferably used at grain formation step.

7) Sensitizing Dye

As the sensitizing dye applicable in the invention, those capable of spectrally sensitizing silver halide grains in a desired wavelength region upon adsorption to silver halide grains having spectral sensitivity suitable to the spectral characteristic of an exposure light source can be advantageously selected. The sensitizing dyes and the adding method are disclosed, for example, JP-A No. 11-65021 (paragraph Nos. 0103 to 0109), as a compound represented by the formula (II) in JP-A No. 10-186572, dyes represented by the formula (I) in JP-A No. 11-119374 (paragraph No. 0106), dyes described in U.S. Pat. Nos. 5,510,236 and 3,871,887 (Example 5), dyes disclosed in JP-A Nos. 2-96131 and 59-48753, as well as in page 19, line 38 to page 20, line 35 of EP No. 0803764A1, and in JP-A Nos. 2001-272747, 2001-290238 and 2002-23306. The sensitizing dyes described above may be used alone or two or more of them may be used in combination. In the invention, sensitizing dye can be added preferably after a desalting step and before coating, and more preferably after a desalting step and before the completion of chemical ripening.

In the invention, the sensitizing dye may be added at any amount according to the property of sensitivity and fogging, but it is preferably added in an amount of from $10^{-6}$ mol to 1 mol, and more preferably from $10^{-4}$ mol to $10^{-1}$ mol, per 1 mol of silver halide in the image forming layer.

The photothermographic material of the invention can contain super sensitizers in order to improve the spectral sensitizing effect.

The super sensitizers usable in the invention can include those compounds described in EP-A No. 587338, U.S. Pat. Nos. 3,877,943 and 4,873,184, JP-A Nos. 5-341432, 11-109547, and 10-111543, and the like.

8) Chemical Sensitization

The photosensitive silver halide grain in the invention is preferably chemically sensitized by sulfur sensitizing method, selenium sensitizing method or tellurium sensitizing method. As the compound used preferably for sulfur sensitizing method, selenium sensitizing method and tellurium sensitizing method, known compounds, for example, compounds described in JP-A No. 7-128768 can be used. Particularly, tellurium sensitization is preferred in the invention and compounds described in the literature cited in paragraph No. 0030 in JP-A No. 11-65021 and compounds shown by formulae (II), (III), and (IV) in JP-A No. 5-313284 are preferred.

The photosensitive silver halide grain in the invention is preferably chemically sensitized by gold sensitizing method alone or in combination with the chalcogen sensitization described above. As the gold sensitizer, those having an oxidation number of gold of either +1 or +3 are preferred and those gold compounds used usually as the gold sensitizer are preferred. As typical examples, chloroauric acid, bromoauric acid, potassium chloroaurate, potassium bromoaurate, auric trichloride, potassium auric thiocyanate, potassium iodoaurate, tetracyanoauric acid, ammonium aurothiocyanate and pyridyl trichloro gold are preferred. Further, gold sensitizers described in U.S. Pat. No. 5,858,637 and JP-A No. 2002-278016 are also used preferably.

In the invention, chemical sensitization can be applied at any time so long as it is after grain formation and before coating and it can be applied, after desalting, (1) before spectral sensitization, (2) simultaneously with spectral sensitization, (3) after spectral sensitization, (4) just before coating, or the like.

The amount of sulfur, selenium, or tellurium sensitizer used in the invention may vary depending on the silver halide grain used, the chemical ripening condition and the like and it is used by about $10^{-8}$ mol to $10^{-2}$ mol, preferably, $10^{-7}$ mol to $10^{-3}$ mol, per 1 mol of silver halide.

The addition amount of the gold sensitizer may vary depending on various conditions and it is generally from $10^{-7}$ mol to $10^{-3}$ mol and, preferably from $10^{-6}$ mol to $5\times10^{-4}$ mol, per 1 mol of silver halide.

There is no particular restriction on the condition for the chemical sensitization in the invention and, appropriately, the pH is from 5 to 8, the pAg is from 6 to 11, and the temperature is from 40° C. to 95° C.

In the silver halide emulsion used in the invention, a thiosulfonic acid compound may be added by the method shown in EP-A No. 293,917.

A reductive compound is preferably used for the photosensitive silver halide grain in the invention. As the specific compound for the reduction sensitization, ascorbic acid or thiourea dioxide is preferred, as well as use of stannous chloride, aminoimino methane sulfonic acid, hydrazine derivatives, borane compounds, silane compounds and polyamine compounds are preferred. The reduction sensitizer may be added at any stage in the photosensitive emulsion producing process from crystal growth to the preparation step just before coating. Further, it is preferred to apply reduction sensitization by ripening while keeping the pH to 7 or higher or the pAg to 8.3 or lower for the emulsion, and it is also preferred to apply reduction sensitization by introducing a single addition portion of silver ions during grain formation.

9) Compound that is One-Electron-Oxidized to Provide a One-Electron Oxidation Product which Releases One or More Electrons The photothermographic material of the invention preferably contains a compound that is one-electron-oxidized to provide a one-electron oxidation product which releases one or more electrons. The said compound can be used alone or in combination with various chemical sensitizers described above to increase the sensitivity of silver halide.

As the compound that is one-electron-oxidized to provide a one-electron oxidation product which releases one or more electrons is preferably a compound selected from the following Groups 1 or 2.

(Group 1) a compound that is one-electron-oxidized to provide a one-electron oxidation product which further releases one or more electrons, due to being subjected to a subsequent bond cleavage reaction;

(Group 2) a compound that is one-electron-oxidized to provide a one-electron oxidation product, which further releases one or more electrons after being subjected to a subsequent bond formation reaction.

The compound of Group will be explained below.

In the compound of Group 1, as a compound that is one-electron-oxidized to provide a one-electron oxidation product which further releases one electron, due to being subjected to a subsequent bond cleavage reaction, specific examples include examples of compound referred to as "one photon two electrons sensitizer" or "deprotonating electron-donating sensitizer" described in JP-A No. 9-211769 (Compound PMT-1 to S-37 in Tables E and F, pages 28 to 32); JP-A No. 9-211774; JP-A No. 11-95355 (Compound INV 1 to 36); JP-W No. 2001-500996 (Compound 1 to 74, 80 to 87, and 92 to 122); U.S. Pat. Nos. 5,747,235 and 5,747,236; EP No. 786692A1 (Compound INV 1 to 35); EP No. 893732A1; U.S. Pat. Nos. 6,054,260 and 5,994,051; etc. Preferred ranges of these compounds are the same as the preferred ranges described in the quoted specifications.

In the compound of Group 1, as a compound that is one-electron-oxidized to provide a one-electron oxidation product which further releases one or more electrons, due to being subjected to a subsequent bond cleavage reaction, specific examples include the compounds represented by formula (1) (same as formula (1) described in JP-A No. 2003-114487), formula (2) (same as formula (2) described in JP-A No. 2003-114487), formula (3) (same as formula (1) described in JP-A No. 2003-114488), formula (4) (same as formula (2) described in JP-A No. 2003-114488), formula (5) (same as formula (3) described in JP-A No. 2003-114488), formula (6) (same as formula (1) described in JP-A No. 2003-75950), formula (7) (same as formula (2) described in JP-A No. 2003-75950), and formula (8) (same as formula (1) described in JP-A No. 2004-239943), and the compound represented by formula (9) (same as formula (3) described in JP-A No. 2004-245929) among the compounds which can undergo the chemical reaction represented by chemical reaction formula (1) (same as chemical reaction formula (1) described in JP-A No. 2004-245929).

And the preferable ranges of these compounds are the same as the preferable ranges described in the quoted specifications.

Formula (1)

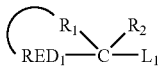

Formula (2)

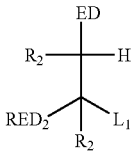

Formula (3)

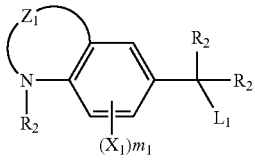

-continued

Formula (4)

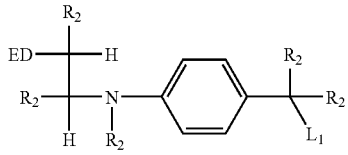

Formula (5)

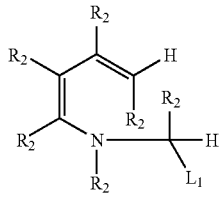

Formula (6)

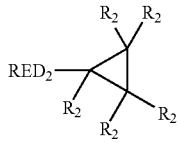

Formula (7)

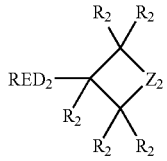

Formula (8)

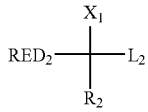

Reaction formula (1)

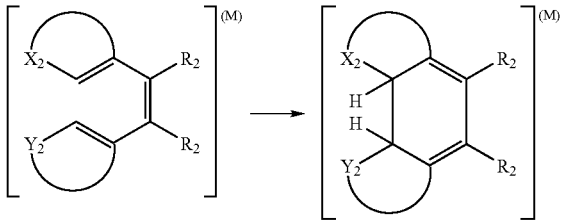

Formula (9)

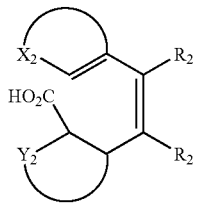

In the formulae, $RED_1$ and $RED_2$ represent a reducing group. $R_1$ represents a nonmetallic atomic group forming a cyclic structure equivalent to a tetrahydro derivative or an octahydro derivative of a 5 or 6-membered aromatic ring (including a hetero aromatic ring) with a carbon atom (C) and $RED_1$. $R_2$ represents a hydrogen atom or a substituent. In the case where plural $R_2$s exist in a same molecule, these may be identical or different from each other. $L_1$ represents a leaving group. ED represents an electron-donating group. $Z_1$ represents an atomic group capable to form a 6-membered ring with a nitrogen atom and two carbon atoms of a benzene ring. $X_1$ represents a substituent, and $m_1$ represents an integer of from 0 to 3. $Z_2$ represents one selected from —$CR_{11}R_{12}$—, —$NR_{13}$—, or —O—. $R_{11}$ and $R_{12}$ each independently represent a hydrogen atom or a substituent. $R_{13}$ represents one selected from a hydrogen atom, an alkyl group, an aryl group, or a heterocyclic group. $X_1$ represents one selected from an alkoxy group, an aryloxy group, a heterocyclic oxy group, an alkylthio group, an arylthio group, a heterocyclic thio group, an alkylamino group, an arylamino group, or a heterocyclic amino group. $L_2$ represents a carboxy group or a salt thereof, or a hydrogen atom. $X_2$ represents a group to form a 5-membered heterocycle with C═C. $Y_2$ represents a group to form a 5-membered aryl group or heterocyclic group with C═C. M represents one selected from a radical, a radical cation, or a cation.

Next, the compound of Group 2 is explained.

In the compound of Group 2, as a compound that is one-electron-oxidized to provide a one-electron oxidation product which further releases one or more electrons, after being subjected to a subsequent bond cleavage reaction, specific examples can include the compound represented by formula (10) (same as formula (1) described in JP-A No. 2003-140287), and the compound represented by formula (11) (same as formula (2) described in JP-A No. 2004-245929) which can undergo the chemical reaction represented by reaction formula (1) (same as chemical reaction formula (1) described in JP-A No. 2004-245929). The preferable ranges of these compounds are the same as the preferable ranges described in the quoted specifications.

Formula (10)

$RED_6$—Q—Y

Reaction formula (1)

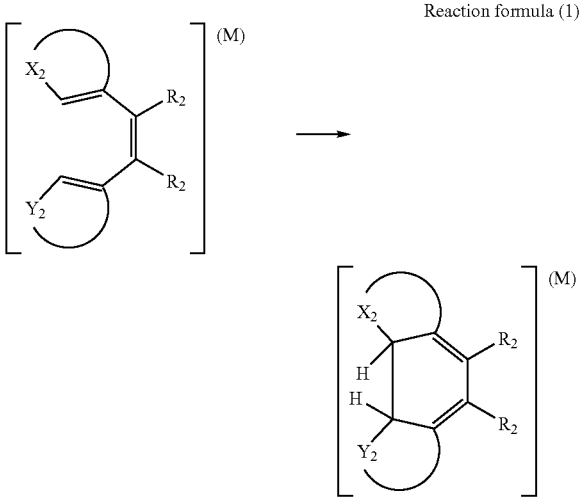

Formula (11)

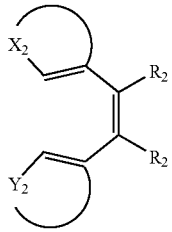

In the formulae described above, X represents a reducing group which can be one-electron-oxidized. Y represents a reactive group containing a carbon-carbon double bond part, a carbon-carbon triple bond part, an aromatic group part or benzo-condensed nonaromatic heterocyclic group which can react with one-electron-oxidized product formed by one-electron-oxidation of X to form a new bond. $L_2$ represents a linking group to link X and Y. $R_2$ represents a hydrogen atom or a substituent. In the case where plural $R_2$s exist in a same molecule, these may be identical or different from each other. $X_2$ represents a group to form a 5-membered heterocycle with C═C. $Y_2$ represents a group to form a 5 or 6-membered aryl group or heterocyclic group with C═C. M represents one selected from a radical, a radical cation, or a cation.

The compounds of Groups 1 or 2 preferably are "the compound having an adsorptive group to silver halide in a molecule" or "the compound having a partial structure of a spectral sensitizing dye in a molecule". The representative adsorptive group to silver halide is the group described in JP-A No. 2003-156823, page 16 right, line 1 to page 17 right, line 12. A partial structure of a spectral sensitizing dye is the structure described in JP-A No. 2003-156823, page 17 right, line 34 to page 18 right, line 6.

As the compound of Groups 1 or 2, "the compound having at least one adsorptive group to silver halide in a molecule" is more preferred, and "the compound having two or more adsorptive groups to silver halide in a molecule" is further preferred. In the case where two or more adsorptive groups exist in a single molecule, those adsorptive groups may be identical or different from one another.

As preferable adsorptive group, a mercapto-substituted nitrogen-containing heterocyclic group (e.g., a 2-mercaptothiazole group, a 3-mercapto-1,2,4-triazole group, a 5-mercaptotetrazole group, a 2-mercapto-1,3,4-oxadiazole group, a 2-mercaptobenzoxazole group, a 2-mercaptobenzothiazole group, a 1,5-dimethyl-1,2,4-triazolium-3-thiolate group, or the like) or a nitrogen-containing heterocyclic group having —NH— group as a partial structure of heterocycle forming silver iminate (—N(Ag)—) (e.g., a benzotriazole group, a benzimidazole group, an indazole group, or the like) are described. A 5-mercaptotetrazole group, a 3-mercapto-1,2,4-triazole group and a benzotriazole group are particularly preferable and a 3-mercapto-1,2,4-triazole group and a 5-mercaptotetrazole group are most preferable.

As an adsorptive group, the group which has two or more mercapto groups as a partial structure in a molecule is also particularly preferable. Herein, a mercapto group (—SH) may become a thione group in the case where it can tautomerize. Preferred examples of an adsorptive group having two or more mercapto groups as a partial structure (dimercapto-substituted nitrogen-containing heterocyclic group and the like) are a 2,4-dimercaptopyrimidine group, a 2,4-dimercaptotriazine group and a 3,5-dimercapto-1,2,4-triazole group.

Further, a quaternary salt structure of nitrogen or phosphorus is also preferably used as an adsorptive group. As typical quaternary salt structure of nitrogen, an ammonio group (a trialkylammonio group, a dialkylarylammonio group, a dialkylheteroarylammonio group, an alkyldiarylammonio group, an alkyldiheteroarylammonio group, or the like) and a nitrogen-containing heterocyclic group containing quaternary nitrogen atom can be used. As a quaternary salt structure of phosphorus, a phosphonio group (a trialkylphosphonio group, a dialkylarylphosphonio group, a dialkylheteroarylphosphonio group, an alkyldiarylphosphonio group, an alkyldiheteroarylphosphonio group, a triarylphosphonio group, a triheteroarylphosphonio group, or the like) is described. A quaternary salt structure of nitrogen is more preferably used and a 5- or 6-membered aromatic heterocyclic group containing a quaternary nitrogen atom is further preferably used.

Particularly preferably, a pyrydinio group, a quinolinio group and an isoquinolinio group are used. These nitrogen-containing heterocyclic groups containing a quaternary nitrogen atom may have any substituent.

Examples of counter anions of quaternary salt are a halogen ion, carboxylate ion, sulfonate ion, sulfate ion, perchlorate ion, carbonate ion, nitrate ion, $BF_4^-$, $PF_6^-$, $Ph_4B^-$, and the like. In the case where the group having negative charge at carboxylate group and the like exists in a molecule, an inner salt may be formed with it. As a counter ion outside of a molecule, chloro ion, bromo ion, and methanesulfonate ion are particularly preferable.

The preferred structure of the compound represented by Groups 1 or 2 having a quaternary salt of nitrogen or phosphorus as an adsorptive group is represented by formula (X).

$$(P—Q_1)_i—R(—Q_2—S)_j \qquad \text{Formula (X)}$$

In formula (X), P and R each independently represent a quaternary salt structure of nitrogen or phosphorus, which is not a partial structure of a spectral sensitizing dye. $Q_1$ and $Q_2$ each independently represent a linking group and typically represent a single bond, an alkylene group, an arylene group, a heterocyclic group, —O—, —S—, —$NR_N$, —C(═O)—, —$SO_2$—, —SO—, —P(═O)— or combinations of these groups. Herein, $R_N$ represents one selected from a hydrogen atom, an alkyl group, an aryl group, or a heterocyclic group. S represents a residue which is obtained by removing one atom from the compound represented by Group 1 or 2. i and j are an integer of one or more and are selected in a range of i+j=2 to 6. The case where i is 1 to 3 and j is 1 to 2 is preferable, the case where i is 1 or 2 and j is 1 is more preferable, and the case where i is 1 and j is 1 is particularly preferable. The compound represented by formula (X) preferably has 10 to 100 carbon atoms in total, more preferably 10 to 70 carbon atoms, further preferably 11 to 60 carbon atoms, and particularly preferably 12 to 50 carbon atoms in total.

The compounds of Groups 1 or 2 may be used at any time during preparation of the photosensitive silver halide emulsion and production of the photothermographic material. For example, the compound may be used in a photosensitive silver halide grain formation step, in a desalting step, in a chemical sensitization step, before coating, or the like. The compound may be added in several times during these steps. The compound is preferably added after the photosensitive silver halide grain formation step and before the desalting step; at the chemical sensitization step (just before the chemical sensitization to immediately after the chemical sensitization); or before coating. The compound is more preferably added from at the chemical sensitization step to before being mixed with non-photosensitive organic silver salt.

It is preferred that the compound of Groups 1 or 2 according to the invention is dissolved in water, a water-soluble solvent such as methanol or ethanol, or a mixed solvent thereof. In the case where the compound is dissolved in water and solubility of the compound is increased by increasing or decreasing a pH value of the solvent, the pH value may be increased or decreased to dissolve and add the compound.

The compound of Groups 1 or 2 according to the invention is preferably used in the image forming layer which contains the photosensitive silver halide and the non-photosensitive organic silver salt. The compound may be added to a surface protective layer, or an intermediate layer, as well as the image forming layer containing the photosensitive silver halide and the non-photosensitive organic silver salt, to be diffused to the image forming layer in the coating step. The compound may be added before or after addition of a sensitizing dye. Each compound is contained in the image forming layer preferably in an amount of from $1\times10^{-9}$ mol to $5\times10^{-1}$ mol, more preferably from $1\times10^{-8}$ mol to $5\times10^{-2}$ mol, per 1 mol of silver halide.

10) Compound Having Adsorptive Group and Reducing Group

The photothermographic material of the present invention preferably comprises a compound having an adsorptive group to silver halide and a reducing group in a molecule. It is preferred that the compound is represented by the following formula (AR).

$$A\text{-}(W)n\text{-}B \qquad \text{Formula (AR)}$$

In formula (AR), A represents a group which adsorbs to a silver halide (hereafter, it is called an adsorptive group); W represents a divalent linking group; n represents 0 or 1; and B represents a reducing group.

In formula (AR), the adsorptive group represented by A is a group to adsorb directly to a silver halide or a group to promote adsorption to a silver halide. As typical examples, a mercapto group (or a salt thereof), a thione group (—C(═S)—), a nitrogen atom, a heterocyclic group containing at least one atom selected from a nitrogen atom, a sulfur atom, a selenium atom, or a tellurium atom, a sulfide group, a disulfide group, a cationic group, an ethynyl group, and the like are described.

The mercapto group (or the salt thereof) as an adsorptive group means a mercapto group (or a salt thereof) itself and simultaneously more preferably represents a heterocyclic group or an aryl group or an alkyl group substituted by at least one mercapto group (or a salt thereof). Herein, as the heterocyclic group, a monocyclic or a condensed aromatic or nonaromatic heterocyclic group having at least a 5 to 7-membered ring, for example, an imidazole ring group, a thiazole ring group, an oxazole ring group, a benzimidazole ring group, a benzothiazole ring group, a benzoxazole ring group, a triazole ring group, a thiadiazole ring group, an oxadiazole ring group, a tetrazole ring group, a purine ring group, a pyridine ring group, a quinoline ring group, an isoquinoline ring group, a pyrimidine ring group, a triazine ring group, and the like are described. A heterocyclic group having a quaternary nitrogen atom may also be adopted, wherein a mercapto group as a substituent may dissociate to form a mesoion. When the mercapto group forms a salt, a counter ion of the salt may be a cation of an alkaline metal, an alkaline earth metal, a heavy metal, or the like, such as $Li^+$, $Na^+$, $K^+$, $Mg^{2+}$, $Ag^+$ and $Zn^{2+}$; an ammonium ion; a heterocyclic group containing a quaternary nitrogen atom; a phosphonium ion; or the like.

Further, the mercapto group as an adsorptive group may become a thione group by a tautomerization.

The thione group used as the adsorptive group also includes a linear or cyclic thioamide group, thioureido group, thiourethane group, and dithiocarbamate ester group.

The heterocyclic group, as an adsorptive group, which contains at least one atom selected from a nitrogen atom, a sulfur atom, a selenium atom, or a tellurium atom represents a nitrogen-containing heterocyclic group having —NH— group, which to forms silver iminate (—N(Ag)—), as a partial structure of a heterocycle, or a heterocyclic group having an —S— group, a —Se— group, a —Te— group, or a ═N— group, which coordinates to a silver ion by a chelate bonding, as a partial structure of a heterocycle. As the former examples, a benzotriazole group, a triazole group, an indazole group, a pyrazole group, a tetrazole group, a benzimidazole group, an imidazole group, a purine group, and the like are described. As the latter examples, a thiophene group, a thiazole group, an oxazole group, a benzothiophene group, a benzothiazole group, a benzoxazole group, a thiadiazole group, an oxadiazole group, a triazine group, a selenoazole group, a benzoselenoazole group, a tellurazole group, a benzotellurazole group, and the like are described.

The sulfide group or disulfide group as an adsorptive group contains all groups having "—S—" or "—S—S—" as a partial structure.

The cationic group as an adsorptive group means the group containing a quaternary nitrogen atom, such as an ammonio group or a nitrogen-containing heterocyclic group including a quaternary nitrogen atom. As examples of the heterocyclic group containing a quaternary nitrogen atom, a pyridinio group, a quinolinio group, an isoquinolinio group, an imidazolio group, and the like are described.

The ethynyl group as an adsorptive group means —C≡CH group and the said hydrogen atom may be substituted.

The adsorptive group described above may have any substituent.

Further, as typical examples of an adsorptive group, the compounds described in pages 4 to 7 in the specification of JP-A No. 11-95355 are described.

As an adsorptive group represented by A in formula (AR), a heterocyclic group substituted by a mercapto group (e.g., a 2-mercaptothiadiazole group, a 2-mercapto-5-aminothiadiazole group, a 3-mercapto-1,2,4-triazole group, a 5-mercaptotetrazole group, a 2-mercapto-1,3,4-oxadiazole group, a 2-mercaptobenzimidazole group, a 1,5-dimethyl-1,2,4-triazorium-3-thiolate group, a 2,4-dimercaptopyrimidine group, a 2,4-dimercaptotriazine group, a 3,5-dimercapto-1,2,4-triazole group, a 2,5-dimercapto-1,3-thiazole group, or the like) and a nitrogen atom containing heterocyclic group having an —NH— group, which forms silver iminate (—N(Ag)—) as a partial structure of heterocycle (e.g., a benzotriazole group, a benzimidazole group, an indazole group, or the like) are preferable, and more preferable as an adsorptive group are a 2-mercaptobenzimidazole group and a 3,5-dimercapto-1,2,4-triazole group.

In formula (AR), W represents a divalent linking group. The said linking group may be any divalent linking group, as far as it does not give a bad effect toward photographic properties. For example, a divalent linking group which includes a carbon atom, a hydrogen atom, an oxygen atom, a nitrogen atom, or a sulfur atom, can be used. As typical examples, an alkylene group having 1 to 20 carbon atoms (e.g., a methylene group, an ethylene group, a trimethylene group, a tetramethylene group, a hexamethylene group, or the like), an alkenylene group having 2 to 20 carbon atoms, an alkynylene group having 2 to 20 carbon atoms, an arylene group having 6 to 20 carbon atoms (e.g., a phenylene group, a naphthylene group, or the like), —CO—, —$SO_2$—, —O—, —S—, —$NR_1$—, and the combinations of these linking groups are described. Herein, $R_1$ represents a hydrogen atom, an alkyl group, a heterocyclic group, or an aryl group.

The linking group represented by W may have any substituent.

In formula (AR), a reducing group represented by B represents the group capable to reduce a silver ion. As the examples, a formyl group, an amino group, a triple bond group such as an acetylene group, a propargyl group and the like, a mercapto group, and residues which are obtained by removing one hydrogen atom from hydroxyamines, hydroxamic acids, hydroxyureas, hydroxyurethanes, hydroxysemicarbazides, reductones (reductone derivatives are contained), anilines, phenols (chroman-6-ols, 2,3-dihydrobenzofuran-5-ols, aminophenols, sulfonamidophenols, and polyphenols such as hydroquinones, catechols, resorcinols, benzenetriols, bisphenols are included), acylhydrazines, carbamoylhydrazines, 3-pyrazolidones, and the like can be described. They may have any substituent.

The oxidation potential of a reducing group represented by B in formula (AR), can be measured by using the measuring method described in Akira Fujishima, "DENKIKAGAKU SOKUTEIHO", pages 150 to 208, GIHODO SHUPPAN and The Chemical Society of Japan, "ZIKKEN KAGAKUKOZA", 4th ed., vol. 9, pages 282 to 344, MARUZEN. For example, the method of rotating disc voltammetry can be used; namely the sample is dissolved in the solution (methanol: pH 6.5 Britton-Robinson buffer=10%: 90% (% by volume)) and after bubbling with nitrogen gas during 10 minutes the voltamograph can be measured under the conditions of 1000 rotations/minute, the sweep rate 20 mV/second, at 25° C. by using a rotating disc electrode (RDE) made by glassy carbon as a working electrode, a platinum electrode as a counter electrode and a saturated calomel electrode as a reference electrode. The half wave potential (E1/2) can be calculated by that obtained voltamograph.

When a reducing group represented by B in the present invention is measured by the method described above, an oxidation potential is preferably in a range of from about −0.3 V to about 1.0 V, more preferably from about −0.1 V to about 0.8 V, and particularly preferably from about 0 V to about 0.7 V.

In formula (AR), a reducing group represented by B is preferably a residue which is obtained by removing one hydrogen atom from hydroxyamines, hydroxamic acids, hydroxyureas, hydroxysemicarbazides, reductones, phenols, acylhydrazines, carbamoylhydrazines, or 3-pyrazolidones.

The compound of formula (AR) according to the present invention may have the ballasted group or polymer chain in it generally used in the non-moving photographic additives as a coupler. And as a polymer, for example, the polymer described in JP-A No. 1-100530 can be selected.

The compound of formula (AR) according to the present invention may be bis or tris type of compound. The molecular weight of the compound represented by formula (AR) according to the present invention is preferably from 100 to 10000, more preferably from 120 to 1000, and particularly preferably from 150 to 500.

The examples of the compound represented by formula (AR) according to the present invention are shown below, but the present invention is not limited in these.

(1)

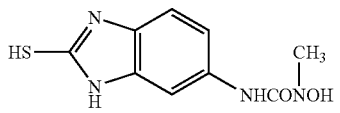

-continued
(2)
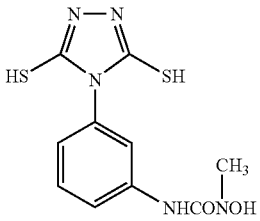
(3)
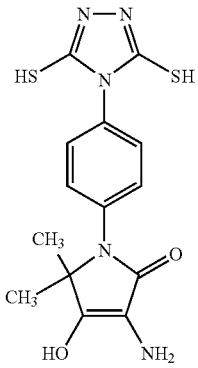
(4)
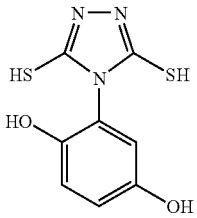
(5)
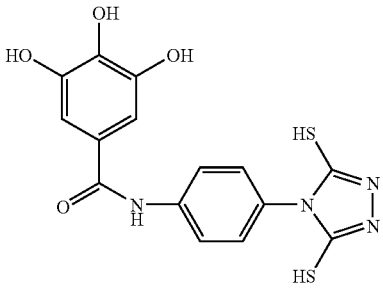
(6)
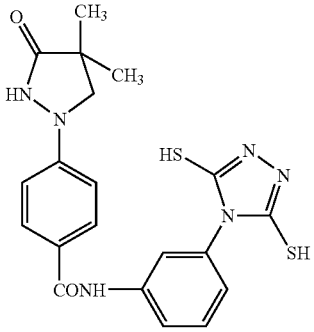
-continued
(7)
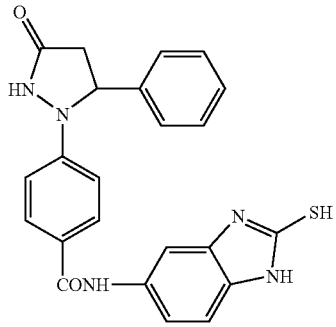
(8)
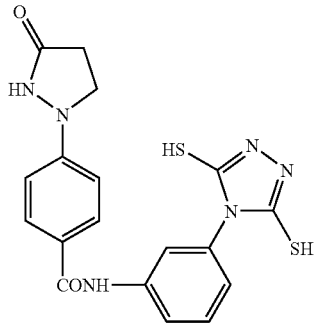
(9)
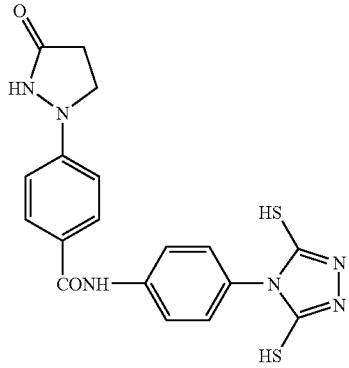
(10)
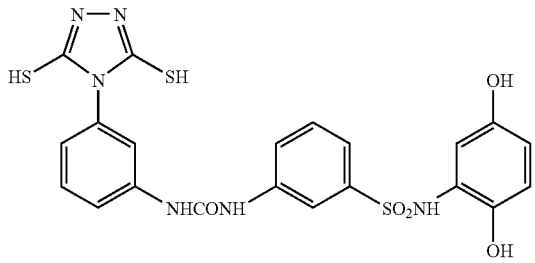
(11)
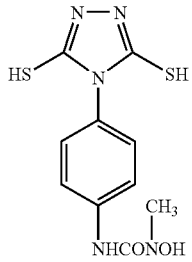

-continued (12)

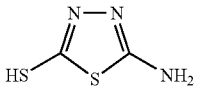

(13)

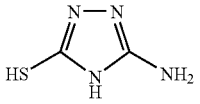

Further, example compounds 1 to 30 and 1"-1 to 1"-77 shown in EP No. 1308776A2, pages 73 to 87 are also described as preferable examples of the compound having an adsorptive group and a reducing group according to the invention.

These compounds can be easily synthesized by any known method. The compound of formula (AR) according to the present invention can be used alone, but it is preferred to use two or more of the compounds in combination. When two or more of the compounds are used in combination, those may be added to the same layer or the different layers, whereby adding methods may be different from each other.

The compound represented by formula (AR) according to the present invention is preferably added to an image forming layer and more preferably is to be added at an emulsion preparing process. In the case, where these compounds are added at an emulsion preparing process, these compounds may be added at any step in the process. For example, the compounds may be added during the silver halide grain formation step, the step before starting of desalting step, the desalting step, the step before starting of chemical ripening, the chemical ripening step, the step before preparing a final emulsion, or the like. The compound can be added in several times during these steps. It is preferred to be added in the image forming layer. But the compound may be added to a surface protective layer or an intermediate layer, in combination with its addition to the image forming layer, to be diffused to the image forming layer in the coating step.

The preferred addition amount is largely dependent on the adding method described above or the type of the compound, but generally from $1\times10^{-6}$ mol to 1 mol, preferably from $1\times10^{-5}$ mol to $5\times10^{-1}$ mol, and more preferably from $1\times10^{-4}$ mol to $1\times10^{-1}$ mol, per 1 mol of photosensitive silver halide in each case.

The compound represented by formula (AR) according to the present invention can be added by dissolving in water or water-soluble solvent such as methanol, ethanol and the like or a mixed solution thereof. At this time, the pH may be arranged suitably by an acid or an alkaline and a surfactant can coexist. Further, these compounds can be added as an emulsified dispersion by dissolving them in an organic solvent having a high boiling point and also can be added as a solid dispersion.

11) Combined Use of a Plurality of Silver Halides

The photosensitive silver halide emulsion in the photothermographic material used in the invention may be used alone, or two or more of them (for example, those of different average particle sizes, different halogen compositions, of different crystal habits and of different conditions for chemical sensitization) may be used together. Gradation can be controlled by using plural photosensitive silver halides having sensitivities that are different from one another. The relevant techniques can include those described, for example, in JP-A Nos. 57-119341, 53-106125, 47-3929, 48-55730, 46-5187, 50-73627, and 57-150841. It is preferred to provide a sensitivity difference of 0.2 or more in terms of log E between each of the emulsions.

12) Coating Amount

The addition amount of the photosensitive silver halide, when expressed by the amount of coated silver per 1 $m^2$ of the photothermographic material, is preferably from 0.03 $g/m^2$ to 0.6 $g/m^2$, more preferably, from 0.05 $g/m^2$ to 0.4 $g/m^2$ and, most preferably, from 0.07 $g/m^2$ to 0.3 $g/m^2$. The photosensitive silver halide is used in a range of from 0.01 mol to 0.5 mol, preferably from 0.02 mol to 0.3 mol, and even more preferably from 0.03 mol to 0.2 mol, per 1 mol of the organic silver salt.

13) Mixing Photosensitive Silver Halide and Organic Silver Salt

The method of mixing separately prepared the photosensitive silver halide and the organic silver salt can include a method of mixing prepared photosensitive silver halide grains and organic silver salt by a high speed stirrer, ball mill, sand mill, colloid mill, vibration mill, or homogenizer, or a method of mixing a photosensitive silver halide completed for preparation at any timing in the preparation of an organic silver salt and preparing the organic silver salt. The effect of the invention can be obtained preferably by any of the methods described above. Further, a method of mixing two or more aqueous dispersions of organic silver salts and two or more aqueous dispersions of photosensitive silver salts upon mixing is used preferably for controlling the photographic properties.

14) Mixing Silver Halide into Coating Solution

In the invention, the time of adding silver halide to the coating solution for the image forming layer is preferably in a range of from 180 minutes before to just prior to the coating, more preferably, 60 minutes before to 10 seconds before coating. But there is no restriction for mixing method and mixing condition as long as the effect of the invention is sufficient. As an embodiment of a mixing method, there is a method of mixing in a tank and controlling an average residence time. The average residence time herein is calculated from addition flux and the amount of solution transferred to the coater. And another embodiment of mixing method is a method using a static mixer, which is described in 8th edition of "Ekitai Kongo Gijutu" by N. Harnby and M. F. Edwards, translated by Koji Takahashi (Nikkan Kogyo Shinbunsha, 1989).

(Preferred Solvent of Coating Solution)

In the invention, a solvent of a coating solution for the image forming layer in the photothermographic material of the invention (wherein a solvent and water are collectively described as a solvent for simplicity) is preferably an aqueous solvent containing water at 30% by weight or more. Examples of solvents other than water may include any of water-miscible organic solvents such as methyl alcohol, ethyl alcohol, isopropyl alcohol, methyl cellosolve, ethyl cellosolve, dimethylformamide and ethyl acetate. A water content in a solvent is more preferably 50% by weight or higher, and even more preferably 70% by weight or higher. Concrete examples of a preferable solvent composition, in addition to water=100, are compositions in which methyl alcohol is contained at ratios of water/methyl alcohol=90/10 and 70/30, in which dimethylformamide is further contained at a ratio of water/methyl alcohol/dimethylformamide=80/15/5, in which ethyl cellosolve is further contained at a ratio of water/methyl alcohol/ethyl cellosolve=85/10/5, and in which isopropyl alcohol is further contained at a ratio of water/methyl alcohol/isopropyl alcohol=85/10/5 (wherein the numerals presented above are values in % by weight).

(Development Accelerator)

In the photothermographic material of the invention, as a development accelerator, sulfonamide phenolic compounds described in the specification of JP-A No. 2000-267222, and represented by formula (A) described in the specification of JP-A No. 2000-330234; hindered phenolic compounds represented by formula (II) described in JP-A No. 2001-92075; hydrazine compounds described in the specification of JP-A No. 10-62895, represented by formula (I) described in the specification of JP-A No. 11-15116, represented by formula (D) described in the specification of JP-A No. 2002-156727, and represented by formula (1) described in the specification of JP-A No. 2002-278017; and phenolic or naphtholic compounds represented by formula (2) described in the specification of JP-A No. 2001-264929 are used preferably. The development accelerator described above is used in a range of from 0.1 mol % to 20 mol %, preferably, in a range of from 0.5 mol % to 10 mol % and, more preferably in a range of from 1 mol % to 5 mol %, with respect to the reducing agent. The introducing methods to the photothermographic material can include similar methods as those for the reducing agent and, it is particularly preferred to add as a solid dispersion or an emulsified dispersion. In the case of adding as an emulsified dispersion, it is preferred to add as an emulsified dispersion dispersed by using a high boiling solvent which is solid at a normal temperature and an auxiliary solvent having a low boiling point, or to add as a so-called oilless emulsified dispersion not using the high boiling solvent.

In the present invention, among the development accelerators described above, hydrazine compounds represented by formula (D) described in the specification of JP-A No. 2002-156727, and phenolic or naphtholic compounds represented by formula (2) described in the specification of JP-A No. 2001-264929 are more preferred.

Particularly preferred development accelerators of the invention are compounds represented by the following formulae (A-1) or (A-2).

$Q_1$—NHNH-$Q_2$ Formula (A-1)

In the formula, $Q_1$ represents an aromatic group or a heterocyclic group which bonds to —NHNH-$Q_2$ at a carbon atom, and $Q_2$ represents one selected from a carbamoyl group, an acyl group, an alkoxycarbonyl group, an aryloxycarbonyl group, a sulfonyl group, or a sulfamoyl group.

In formula (A-1), the aromatic group or the heterocyclic group represented by $Q_1$ is preferably a 5 to 7-membered unsaturated ring. Preferred examples include a benzene ring, a pyridine ring, a pyrazine ring, a pyrimidine ring, a pyridazine ring, a 1,2,4-triazine ring, a 1,3,5-triazine ring, a pyrrole ring, an imidazole ring, a pyrazole ring, a 1,2,3-triazole ring, a 1,2,4-triazole ring, a tetrazole ring, a 1,3,4-thiadiazole ring, a 1,2,4-thiadiazole ring, a 1,2,5-thiadiazole ring, a 1,3,4-oxadiazole ring, a 1,2,4-oxadiazole ring, a 1,2,5-oxadiazole ring, a thiazole ring, an oxazole ring, an isothiazole ring, an isooxazole ring, a thiophene ring, and the like. Condensed rings in which the rings described above are condensed to each other are also preferred.

The rings described above may have substituents and in a case where they have two or more substituents, the substituents may be identical or different from each other. Examples of the substituents can include a halogen atom, an alkyl group, an aryl group, a carbonamide group, an alkylsulfonamide group, an arylsulfonamide group, an alkoxy group, an aryloxy group, an alkylthio group, an arylthio group, a carbamoyl group, a sulfamoyl group, a cyano group, an alkylsulfonyl group, an arylsulfonyl group, an alkoxycarbonyl group, an aryloxycarbonyl group, and an acyl group. In the case where the substituents are groups capable of substitution, they may have further substituents and examples of preferred substituents can include a halogen atom, an alkyl group, an aryl group, a carbonamide group, an alkylsulfonamide group, an arylsulfonamide group, an alkoxy group, an aryloxy group, an alkylthio group, an arylthio group, an acyl group, an alkoxycarbonyl group, an aryloxycarbonyl group, a carbamoyl group, a cyano group, a sulfamoyl group, an alkylsulfonyl group, an arylsulfonyl group, and an acyloxy group.

The carbamoyl group represented by $Q_2$ is a carbamoyl group preferably having 1 to 50 carbon atoms and, more preferably having 6 to 40 carbon atoms, and examples can include unsubstituted carbamoyl, methyl carbamoyl, N-ethylcarbamoyl, N-propylcarbamoyl, N-sec-butylcarbamoyl, N-octylcarbamoyl, N-cyclohexylcarbamoyl, N-tert-butylcarbamoyl, N-dodecylcarbamoyl, N-(3-dodecyloxypropyl) carbamoyl, N-octadecylcarbamoyl, N-{3-(2,4-tert-pentylphenoxy)propyl}carbamoyl, N-(2-hexyldecyl) carbamoyl, N-phenylcarbamoyl, N-(4-dodecyloxyphenyl) carbamoyl, N-(2-chloro-5-dodecyloxycarbonylphenyl) carbamoyl, N-naphthylcarbamoyl, N-3-pyridylcarbamoyl, and N-benzylcarbamoyl.

The acyl group represented by $Q_2$ is an acyl group, preferably having 1 to 50 carbon atoms and, more preferably having 6 to 40 carbon atoms, and can include, for example, formyl, acetyl, 2-methylpropanoyl, cyclohexylcarbonyl, octanoyl, 2-hexyldecanoyl, dodecanoyl, chloroacetyl, trifluoroacetyl, benzoyl, 4-dodecyloxybenzoyl, and 2-hydroxymethylbenzoyl. The alkoxycarbonyl group represented by $Q_2$ is an alkoxycarbonyl group, preferably having 2 to 50 carbon atoms and, more preferably having 6 to 40 carbon atoms, and can include, for example, methoxycarbonyl, ethoxycarbonyl, isobutyloxycarbonyl, cyclohexyloxycarbonyl, dodecyloxycarbonyl, and benzyloxycarbonyl.

The aryloxy carbonyl group represented by $Q_2$ is an aryloxycarbonyl group, preferably having 7 to 50 carbon atoms and, more preferably having 7 to 40 carbon atoms, and can include, for example, phenoxycarbonyl, 4-octyloxyphenoxycarbonyl, 2-hydroxymethylphenoxycarbonyl, and 4-dodecyloxyphenoxycarbonyl. The sulfonyl group represented by $Q_2$ is a sulfonyl group, preferably having 1 to 50 carbon atoms and, more preferably, having 6 to 40 carbon atoms and can include, for example, methylsulfonyl, butylsulfonyl, octylsulfonyl, 2-hexadecylsulfonyl, 3-dodecyloxypropylsulfonyl, 2-octyloxy-5-tert-octylphenyl sulfonyl, and 4-dodecyloxyphenyl sulfonyl.

The sulfamoyl group represented by $Q_2$ is a sulfamoyl group, preferably having 0 to 50 carbon atoms, more preferably having 6 to 40 carbon atoms, and can include, for example, unsubstituted sulfamoyl, N-ethylsulfamoyl group, N-(2-ethylhexyl)sulfamoyl, N-decylsulfamoyl, N-hexadecylsulfamoyl, N-{3-(2-ethylhexyloxy)propyl}sulfamoyl, N-(2-chloro-5-dodecyloxycarbonylphenyl)sulfamoyl, and N-(2-tetradecyloxyphenyl)sulfamoyl. The group represented by $Q_2$ may further have a group mentioned as the example of the substituent of 5 to 7-membered unsaturated ring represented by $Q_1$ at the position capable of substitution. In a case where the group has two or more substituents, such substituents may be identical or different from one another.

Next, preferred range for the compound represented by formula (A-1) is to be described. A 5 or 6-membered unsaturated ring is preferred for $Q_1$, and a benzene ring, a pyrimidine ring, a 1,2,3-triazole ring, a 1,2,4-triazole ring, a tetrazole ring, a 1,3,4-thiadiazole ring, a 1,2,4-thiadiazole ring, a 1,3,4-oxadiazole ring, a 1,2,4-oxadiazole ring, a thioazole ring, an oxazole ring, an isothiazole ring, an isooxazole ring, and a ring in which the ring described above is condensed with a benzene ring or unsaturated hetero ring are more preferred. Further, $Q_2$ is preferably a carbamoyl group and, particularly, a carbamoyl group having a hydrogen atom on the nitrogen atom is particularly preferred.

Formula (A-2)

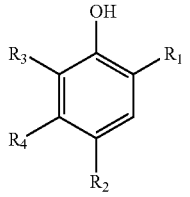

In formula (A-2), $R_1$ represents one selected from an alkyl group, an acyl group, an acylamino group, a sulfonamide group, an alkoxycarbonyl group, or a carbamoyl group. $R_2$ represents one selected from a hydrogen atom, a halogen atom, an alkyl group, an alkoxy group, an aryloxy group, an alkylthio group, an arylthio group, an acyloxy group, or a carbonate ester group. $R_3$ and $R_4$ each independently represent a group substituting for a hydrogen atom on a benzene ring which is mentioned as the example of the substituent for formula (A-1). $R_3$ and $R_4$ may link together to form a condensed ring.

$R_1$ is preferably an alkyl group having 1 to 20 carbon atoms (for example, a methyl group, an ethyl group, an isopropyl group, a butyl group, a tert-octyl group, a cyclohexyl group, or the like), an acylamino group (for example, an acetylamino group, a benzoylamino group, a methylureido group, a 4-cyanophenylureido group, or the like), or a carbamoyl group (for example, a n-butylcarbamoyl group, an N,N-diethylcarbamoyl group, a phenylcarbamoyl group, a 2-chlorophenylcarbamoyl group, a 2,4-dichlorophenylcarbamoyl group, or the like). An acylamino group (including a ureido group and a urethane group) is more preferred. $R_2$ is preferably a halogen atom (more preferably, a chlorine atom or a bromine atom), an alkoxy group (for example, a methoxy group, a butoxy group, an n-hexyloxy group, an n-decyloxy group, a cyclohexyloxy group, a benzyloxy group, or the like), or an aryloxy group (for example, a phenoxy group, a naphthoxy group, or the like).

$R_3$ is preferably a hydrogen atom, a halogen atom, or an alkyl group having 1 to 20 carbon atoms, and most preferably a halogen atom. $R_4$ is preferably a hydrogen atom, an alkyl group, or an acylamino group, and more preferably an alkyl group or an acylamino group. Examples of the preferred substituent thereof are similar to those for $R_1$. In the case where $R_4$ is an acylamino group, $R_4$ may preferably link with $R_3$ to form a carbostyryl ring.

In the case where $R_3$ and $R_4$ in formula (A-2) link together to form a condensed ring, a naphthalene ring is particularly preferred as the condensed ring. The same substituent as the example of the substituent referred to for formula (A-1) may bond to the naphthalene ring. In the case where formula (A-2) is a naphtholic compound, $R_1$ is preferably a carbamoyl group. Among them, a benzoyl group is particularly preferred. $R_2$ is preferably an alkoxy group or an aryloxy group and, particularly preferably an alkoxy group.

Preferred specific examples for the development accelerator of the invention are to be described below. The invention is not restricted to them.

A-1

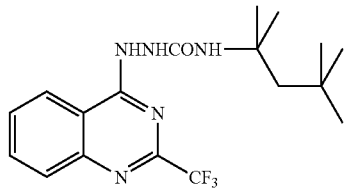

A-2

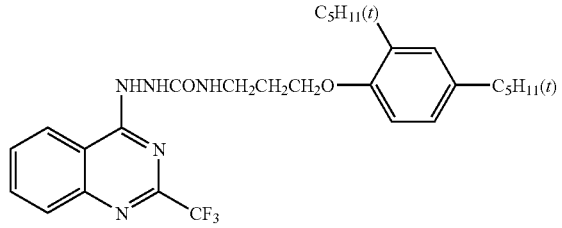

A-3

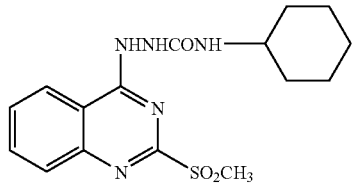

A-4

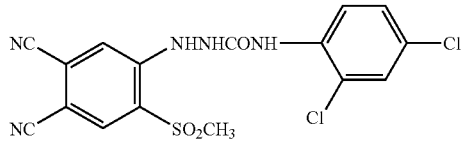

A-5

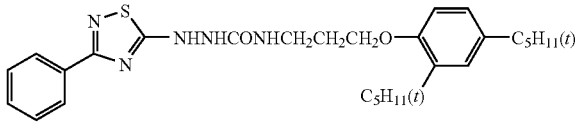

A-6

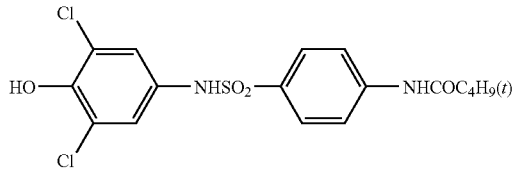

A-7

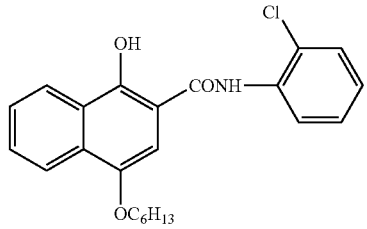

-continued

A-8

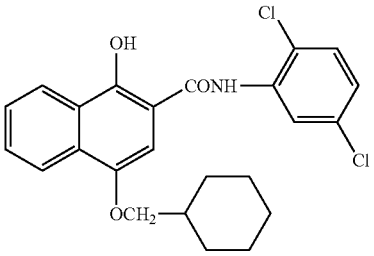

A-9

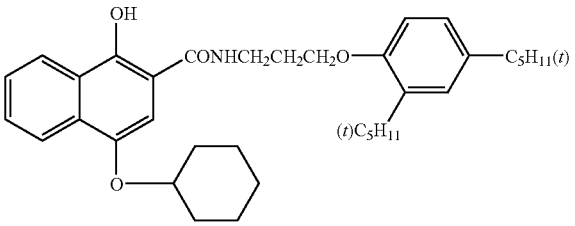

A-10

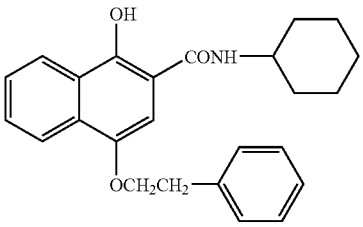

A-11

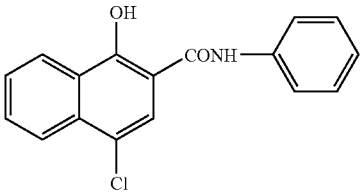

A-12

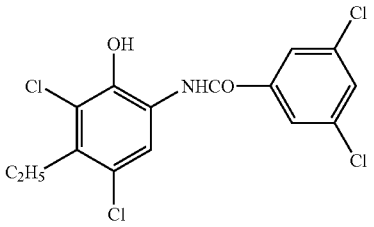

(Hydrogen Bonding Compound)

In the invention, in the case where the reducing agent has an aromatic hydroxy group (—OH) or an amino group (—NHR, R represents a hydrogen atom or an alkyl group), particularly in the case where the reducing agent is a bisphenol described above, it is preferred to use in combination, a non-reducing compound having a group which reacts with these groups of the reducing agent and forms a hydrogen bond therewith.

As a group forming a hydrogen bond with a hydroxy group or an amino group, there can be mentioned a phosphoryl group, a sulfoxide group, a sulfonyl group, a carbonyl group, an amide group, an ester group, a urethane group, a ureido group, a tertiary amino group, a nitrogen-containing aromatic group, and the like. Particularly preferred among them is a phosphoryl group, a sulfoxide group, an amide group (not having —N(H)— moiety but being blocked in the form of —N(Ra)—(where, Ra represents a substituent other than H)), a urethane group (not having —N(H)— moiety but being blocked in the form of —N(Ra)—(where, Ra represents a substituent other than H)), and a ureido group (not having —N(H)— moiety but being blocked in the form of —N(Ra)—(where, Ra represents a substituent other than H)).

In the invention, particularly preferable as the hydrogen bonding compound is the compound expressed by formula (D) shown below.

Formula (D)

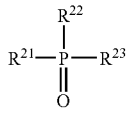

In formula (D), $R^{21}$ to $R^{23}$ each independently represent one selected from an alkyl group, an aryl group, an alkoxy group, an aryloxy group, an amino group, or a heterocyclic group, which may be substituted or unsubstituted.

In the case where $R^{21}$ to $R^{23}$ contain a substituent, examples of the substituent include a halogen atom, an alkyl group, an aryl group, an alkoxy group, an amino group, an acyl group, an acylamino group, an alkylthio group, an arylthio group, a sulfonamide group, an acyloxy group, an oxycarbonyl group, a carbamoyl group, a sulfamoyl group, a sulfonyl group, a phosphoryl group, and the like, in which preferred as the substituents are an alkyl group or an aryl group, e.g., a methyl group, an ethyl group, an isopropyl group, a t-butyl group, a t-octyl group, a phenyl group, a 4-alkoxyphenyl group, a 4-acyloxyphenyl group, and the like.

Specific examples of an alkyl group expressed by $R^{21}$ to $R^{23}$ include a methyl group, an ethyl group, a butyl group, an octyl group, a dodecyl group, an isopropyl group, a t-butyl group, a t-amyl group, a t-octyl group, a cyclohexyl group, a 1-methylcyclohexyl group, a benzyl group, a phenetyl group, a 2-phenoxypropyl group, and the like.

As an aryl group, there can be mentioned a phenyl group, a cresyl group, a xylyl group, a naphthyl group, a 4-t-butylphenyl group, a 4-t-octylphenyl group, a 4-anisidyl group, a 3,5-dichlorophenyl group, and the like.

As an alkoxy group, there can be mentioned a methoxy group, an ethoxy group, a butoxy group, an octyloxy group, a 2-ethylhexyloxy group, a 3,5,5-trimethylhexyloxy group, a dodecyloxy group, a cyclohexyloxy group, a 4-methylcyclohexyloxy group, a benzyloxy group, and the like.

As an aryloxy group, there can be mentioned a phenoxy group, a cresyloxy group, an isopropylphenoxy group, a 4-t-butylphenoxy group, a naphthoxy group, a biphenyloxy group, and the like.

As an amino group, there can be mentioned a dimethylamino group, a diethylamino group, a dibutylamino group, a dioctylamino group, an N-methyl-N-hexylamino group, a dicyclohexylamino group, a diphenylamino group, an N-methyl-N-phenylamino group, and the like.

Preferred as $R^{21}$ to $R^{23}$ is an alkyl group, an aryl group, an alkoxy group, or an aryloxy group. Concerning the effect of the invention, it is preferred that at least one of $R^{21}$ to $R^{23}$ is an alkyl group or an aryl group, and more preferably, two or more of them are an alkyl group or an aryl group. From the viewpoint of low cost availability, it is preferred that $R^{21}$ to $R^{23}$ are of the same group.

Specific examples of hydrogen bonding compounds represented by formula (D) of the invention and others are shown below, but it should be understood that the invention is not limited thereto.
D-1
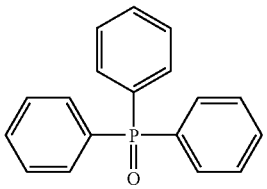
D-2
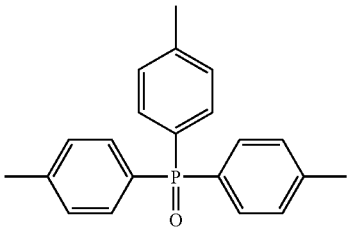
D-3
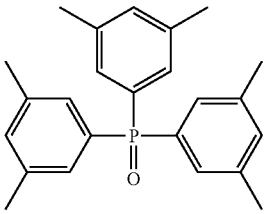
D-4
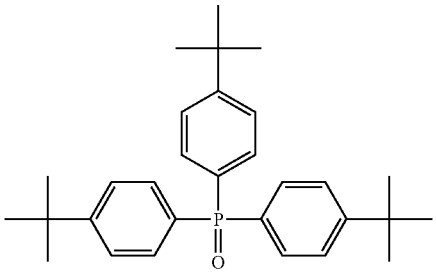
D-5
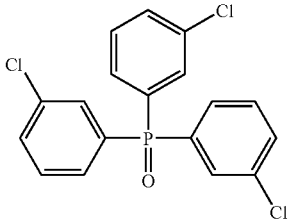
D-6
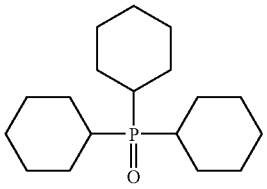
-continued
D-7
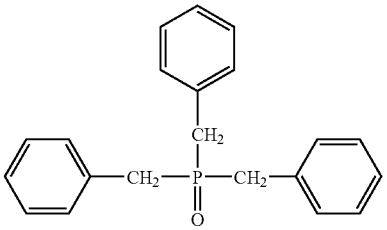
D-8
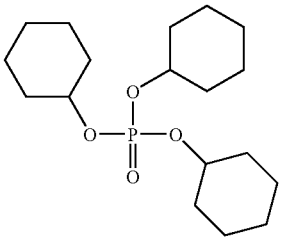
D-9
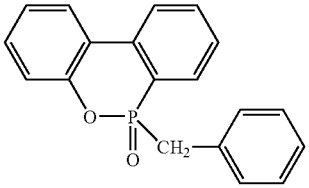
D-10
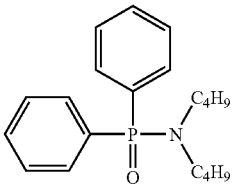
D-11
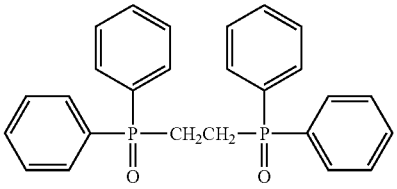
D-12
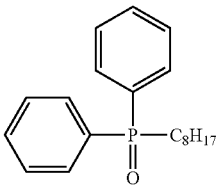
D-13
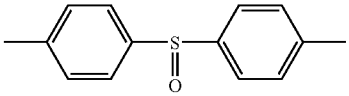

-continued

D-14

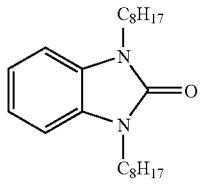

D-15

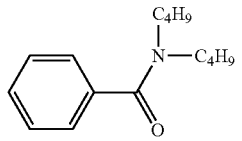

Specific examples of hydrogen bonding compounds other than those enumerated above can be found in those described in EP No. 1,096,310 and in JP-A Nos. 2002-156727 and 2002-318431.

The compound expressed by formula (D) used in the invention can be used in the photothermographic material by being incorporated into the coating solution in the form of solution, emulsified dispersion, or solid fine particle dispersion, similar to the case of reducing agent. However, it is preferably used in the form of solid dispersion. In the solution, the compound expressed by formula (D) forms a hydrogen-bonded complex with a compound having a phenolic hydroxy group or an amino group, and can be isolated as a complex in crystalline state depending on the combination of the reducing agent and the compound expressed by formula (D).

It is particularly preferred to use the crystal powder thus isolated in the form of solid fine particle dispersion, because it provides stable performance. Further, it is also preferred to use a method of leading to form complex during dispersion by mixing the reducing agent and the compound expressed by formula (D) in the form of powders and dispersing them with a proper dispersion agent using sand grinder mill or the like.

The compound expressed by formula (D) is preferably used in a range from 1 mol % to 200 mol %, more preferably from 10 mol % to 150 mol %, and even more preferably, from 20 mol % to 100 mol %, with respect to the reducing agent.

(Binder for Image Forming Layer)

The glass transition temperature (Tg) of the binder of the image forming layer according to the present invention is preferably in a range of from −50° C. to 45° C., more preferably from −30° C. to 35° C. and, even more preferably from −20° C. to 20° C.

In the specification, Tg is calculated according to the following equation:

$$1/Tg=\Sigma(Xi/Tgi)$$

where the polymer is obtained by copolymerization of n monomer compounds (from i=1 to i=n); Xi represents the mass fraction of the ith monomer ($\Sigma Xi=1$), and Tgi is the glass transition temperature (absolute temperature) of the homopolymer obtained with the ith monomer. The symbol Σ stands for the summation from i=1 to i=n. Values for the glass transition temperature (Tgi) of the homopolymers derived from each of the monomers were obtained from J. Brandrup and E. H. Immergut, Polymer Handbook (3rd Edition) (Wiley-Interscience, 1989).

The binder may be of two or more types of polymers depending on needs. And, the polymer having Tg of 20° C. or more and the polymer having Tg of less than 20° C. can be used in combination. In the case where two or more types of polymers differing in Tg may be blended for use, it is preferred that the weight-average Tg is in the range mentioned above.

In the invention, the image forming layer is preferably formed by applying a coating solution containing 30% by weight or more of water in the solvent and by then drying.

In the invention, in the case where the image forming layer is formed by first applying a coating solution containing 30% by weight or more of water in the solvent and by then drying, furthermore, in the case where the binder of the image forming layer is soluble or dispersible in an aqueous solvent (water solvent), and particularly in the case where a polymer latex having an equilibrium water content of 2% by weight or lower at 25° C. and 60% RH is used, the performance can be enhanced. Most preferred embodiment is such prepared to yield an ion conductivity of 2.5 mS/cm or lower, and as such a preparing method, there can be mentioned a refining treatment using a separation function membrane after synthesizing the polymer.

The aqueous solvent in which the polymer is soluble or dispersible, as referred herein, signifies water or water containing mixed therein 70% by weight or less of a water-miscible organic solvent. As water-miscible organic solvents, there can be used, for example, alcohols such as methyl alcohol, ethyl alcohol, propyl alcohol, and the like; cellosolves such as methyl cellosolve, ethyl cellosolve, butyl cellosolve, and the like; ethyl acetate, dimethylformamide, and the like.

The term "aqueous solvent" is also used in the case the polymer is not thermodynamically dissolved, but is present in a so-called dispersed state.

The term "equilibrium water content at 25° C. and 60% RH" as referred herein can be expressed as follows:

$$\text{Equilibrium water content at 25° C. and 60\% RH} = [(W1-W0)/W0]\times 100 \text{ (\% by weight)}$$

wherein, W1 is the weight of the polymer in moisture-controlled equilibrium under the atmosphere of 25° C. and 60% RH, and W0 is the absolutely dried weight at 25° C. of the polymer.

For the definition and the method of measurement for water content, reference can be made to Polymer Engineering Series 14, "Testing methods for polymeric materials" (The Society of Polymer Science, Japan, published by Chijin Shokan).

The equilibrium water content at 25° C. and 60% RH is preferably 2% by weight or lower, and is more preferably, in a range of from 0.01% by weight to 1.5% by weight, and is even more preferably, from 0.02% by weight to 1% by weight.

The binders used in the invention are, particularly preferably, polymers capable of being dispersed in an aqueous solvent. Examples of dispersed states may include a latex, in which water-insoluble fine particles of hydrophobic polymer are dispersed, or such in which polymer molecules are dispersed in molecular states or by forming micelles, but preferred are latex-dispersed particles. The average particle diameter of the dispersed particles is in a range of from 1 nm to 50,000 nm, preferably from 5 nm to 1,000 nm, more preferably from 10 nm to 500 nm, and even more preferably from 50 nm to 200 nm. There is no particular limitation concerning particle diameter distribution of the dispersed particles, and they may be widely distributed or may exhibit a monodispersed particle diameter distribution. From the viewpoint of controlling the physical properties of the coating solution, preferred mode of usage includes mixing two or more types of dispersed particles each having monodispersed particle diameter distribution.

In the invention, preferred embodiment of the polymers capable of being dispersed in aqueous solvent includes hydrophobic polymers such as acrylic polymers, polyesters, rubbers (e.g., SBR resin), polyurethanes, poly(vinyl chlorides), poly(vinyl acetates), poly(vinylidene chlorides), polyolefins, or the like. As the polymers above, usable are straight chain polymers, branched polymers, or crosslinked polymers; also usable are the so-called homopolymers in which one type of monomer is polymerized, or copolymers in which two or more types of monomers are polymerized. In the case of a copolymer, it may be a random copolymer or a block copolymer. The molecular weight of these polymers is, in number average molecular weight, in a range of from 5,000 to 1,000,000, preferably from 10,000 to 200,000. Those having too small a molecular weight exhibit insufficient mechanical strength on forming the image forming layer, and those having too large a molecular weight are also not preferred because the resulting film-forming properties are poor. Further, crosslinking polymer latexes are particularly preferred for use.

-Examples of Latex-

Specific examples of preferred polymer latexes are given below, which are expressed by the starting monomers with % by weight given in parenthesis. The molecular weight is given in number average molecular weight. In the case polyfunctional monomer is used, the concept of molecular weight is not applicable because they build a crosslinked structure. Hence, they are denoted as "crosslinking", and the molecular weight is omitted. Tg represents glass transition temperature.

P-1; Latex of -MMA(70)-EA(27)-MAA(3)- (molecular weight 37000, Tg 61° C.)

P-2; Latex of -MMA(70)-2EHA(20)-St(5)-AA(5)- (molecular weight 40000, Tg 59° C.)

P-3; Latex of -St(62)-Bu(35)-MAA(3)- (crosslinking, Tg 5° C.)

P-4; Latex of -St(50)-Bu(47)-MAA(3)- (crosslinking, Tg -17° C.)

P-5; Latex of -St(68)-Bu(29)-AA(3)- (crosslinking, Tg 17° C.)

P-6; Latex of -St(71)-Bu(26)-AA(3)- (crosslinking, Tg 24° C.)

P-7; Latex of -St(70)-Bu(27)-IA(3)- (crosslinking)

P-8; Latex of -St(75)-Bu(24)-AA(1)- (crosslinking, Tg 29° C.)

P-9; Latex of -St(60)-Bu(35)-DVB(3)-MAA(2)- (crosslinking)

P-10; Latex of -St(70)-Bu(25)-DVB(2)-AA(3)- (crosslinking)

P-11; Latex of -VC(50)-MMA(20)-EA(20)-AN(5)-AA(5) - (molecular weight 80000)

P-12; Latex of -VDC(85)-MMA(5)-EA(5)-MAA(5)- (molecular weight 67000)

P-13; Latex of -Et(90)-MAA(10)- (molecular weight 12000)

P-14; Latex of -St(70)-2EHA(27)-AA(3)- (molecular weight 130000, Tg 43° C.)

P-15; Latex of -MMA(63)-EA(35)-AA(2)- (molecular weight 33000, Tg 47° C.)

P-16; Latex of -St(70.5)-Bu(26.5)-AA(3)- (crosslinking, Tg 23-C)

P-17; Latex of -St(69.5)-Bu(27.5)-AA(3)- (crosslinking, Tg 20.5° C.)

P-18; Latex of -St(61.5)-Isoprene(35.5)-AA(3)- (crosslinking, Tg 17° C.)

P-19; Latex of -St(67)-Isoprene(28)-Bu(2)-AA(3)- (crosslinking, Tg 27° C.)

In the structures above, abbreviations represent monomers as follows. MMA: methyl methacrylate, EA: ethyl acrylate, MAA: methacrylic acid, 2EHA: 2-ethylhexyl acrylate, St: styrene, Bu: butadiene, AA: acrylic acid, DVB: divinylbenzene, VC: vinyl chloride, AN: acrylonitrile, VDC: vinylidene chloride, Et: ethylene, IA: itaconic acid.

The polymer latexes above are commercially available, and polymers below are usable.

As examples of acrylic polymers, there can be mentioned Cevian A-4635, 4718, and 4601 (all manufactured by Daicel Chemical Industries, Ltd.), Nipol Lx811, 814, 821, 820, and 857 (all manufactured by Nippon Zeon Co., Ltd.), and the like.

As examples of polyester, there can be mentioned FINETEX ES650, 611, 675, and 850 (all manufactured by Dainippon Ink and Chemicals, Inc.), WD-size and WMS (all manufactured by Eastman Chemical Co.), and the like.

As examples of polyurethane, there can be mentioned HYDRAN AP10, 20, 30, and 40 (all manufactured by Dainippon Ink and Chemicals, Inc.), and the like.

As examples of rubber, there can be mentioned LACSTAR 7310K, 3307B, 4700H, and 7132C (all manufactured by Dainippon Ink and Chemicals, Inc.), Nipol Lx416, 410, 438C, and 2507 (all manufactured by Nippon Zeon Co., Ltd.), and the like.

As examples of poly(vinyl chloride), there can be mentioned G351 and G576 (all manufactured by Nippon Zeon Co., Ltd.), and the like.

As examples of poly(vinylidene chloride), there can be mentioned L502 and L513 (all manufactured by Asahi Chemical Industry Co., Ltd.), and the like.

As examples of polyolefin, there can be mentioned Chemipearl S120 and SA100 (all manufactured by Mitsui Petrochemical Industries, Ltd.), and the like.

As the latex of styrene-butadiene copolymer preferably used in the invention, there can be mentioned P-18 to P-10, P-16, and P-17 described above, and commercially available LACSTAR-3307B, 7132C, Nipol Lx416, and the like.

As the latex of styrene-isoprene copolymer preferably used in the invention, there can be mentioned P-18 and P-19 described above, and the like.

<Synthetic Example 1 -Synthesis of Illustrated Compound No. P-5->

To a polymerization vessel of a gas monomer reaction apparatus (manufactured by Taiatsu Techno Corporation, TAS-2J type) were charged 287 g of distilled water, 7.73 g of a surfactant (Pionin A-43-S (manufactured by TAKEMOTO OIL & FAT CO., LTD.): solid matter content of 48.5% by weight), 14.06 mL of 1 mol/L sodium hydroxide, 0.15 g of ethylenediamine tetraacetate tetrasodium salt, 255 g of styrene, 11.25 g of acrylic acid, and 3.0 g of tert-dodecyl mercaptan, followed by sealing of the reaction vessel and stirring at a stirring rate of 200 rpm. Degassing was conducted with a vacuum pump, followed by repeating nitrogen gas replacement several times. Thereto was injected 108.75 g of 1,3-butadiene, and the inner temperature was elevated to 60° C. Thereto was added a solution of 1.875 g of ammonium persulfate dissolved in 50 mL of water, and the mixture was stirred for 5 hours as it stands. The temperature was further elevated to 90° C., followed by stirring for 3 hours. After completing the reaction, the inner temperature was lowered to reach to the room temperature, and thereafter the mixture was treated by adding 1 mol/L sodium hydroxide and ammonium hydroxide to give the molar ratio of $Na^+$ ion:$NH_4^+$ ion=1:5.3, and thus, the pH of the mixture was adjusted to 8.4. Thereafter, filtration with a polypropylene filter having the pore size of 1.0 μm was conducted to remove foreign substances such as dust followed by storage. Accordingly, the illustrated compound No. P-5 was obtained in an amount of 774.7 g. Upon the measurement of halogen ion by ion chromatography, concentration of chloride ion was revealed to be 3 ppm. As a result of the measurement of the concentration of the chelating agent by high performance liquid chromatography, it was revealed to be 145 ppm.

The aforementioned latex had a mean particle diameter of 90 nm, Tg of 17° C., a solid matter concentration of 44% by weight, an equilibrium moisture content at 25° C. and 60% RH of 0.6% by weight, and an ionic conductance of 4.80 mS/cm (measurement of the ionic conductance was performed using a conductivity meter CM-30S manufactured by To a Electronics Ltd. for the latex stock solution (44% by weight) at 25° C.).

<Synthetic Example 2 -Synthesis of Illustrated Compound No. P-18->

1500 g of distilled water were poured into the polymerization vessel of gas monomer reaction apparatus (type TAS-2J manufactured by Tiatsu Garasu Kogyo Ltd.) and the vessel was heated for 3 hours at 90° C. to make passive film over the stainless vessel surface and stainless stirring device. Thereafter, 582.28 g of distilled water deaerated by nitrogen gas for one hour, 9.49 g of surfactant "PIONIN A-43-S" (trade name, available from Takemoto Oil & Fat Co., Ltd.), 19.56 g of 1 mol/L sodium hydroxide, 0.20 g of ethylenediamine tetraacetic acid tetrasodium salt, 314.99 g of styrene, 190.87 g of isoprene, 10.43 g of acrylic acid, and 2.09 g of tert-dodecyl mercaptan were added into the pretreated reaction vessel. And then, the reaction vessel was sealed and the mixture was stirred at the stirring rate of 225 rpm, followed by elevating the inner temperature to 65° C. A solution obtained by dissolving 2.61 g of ammonium persulfate in 40 mL of water was added to the aforesaid mixture and kept for 6 hours with stirring. At this point the polymerization conversion ratio was 90% according to the solid content measurement. Thereto was added a solution obtained by dissolving 5.22 g of acrylic acid in 46.98 g of water, and then 10 g of water and a solution obtained by dissolving 1.30 g of ammonium persulfate in 50.7 mL of water were added. After the addition, the mixture was heated to 90° C. and stirred for 3 hours. After the reaction was finished, the inner temperature of the vessel was cooled to room temperature. And then, the mixture was treated by adding 1 mol/L sodium hydroxide and ammonium hydroxide to give the molar ratio of $Na^+$ ion:$NH_4^+$ ion=1:5.3, and thus, the pH of the mixture was adjusted to 8.2. Thereafter, the resulting mixture was filtered with a polypropylene filter having a pore size of 1.0 μm to remove foreign substances such as dust, and stored. 1248 g of the illustrated compound No. P-18 was obtained (solid content of 40.3% by weight, and a mean particle diameter of 113 nm).

The hydrophobic polymer may be used alone, or may be used by blending two or more of them depending on needs. Polymers other than these may be used in combination.

To control the minimum film-forming temperature of an aqueous dispersion of the hydrophobic polymer, an auxiliary film-forming agent may be added. The auxiliary film-forming agent is also called a temporally plasticizer and is the compound (usually an organic solvent) which makes a minimum film-forming temperature of polymer latex decrease and for instance, is described in the above "GOUSEI LATEX NO KAGAKU" (Soichi Muroi, published by Kobunshi Kankokai (1970)). The preferred auxiliary film-forming agents are the following compounds, but the compound usable in the present invention is not limited in the following specific examples.

Z-1: Benzyl alcohol,

Z-2: 2,2,4-trimethylpentanediol-1,3-monoisobutyrate,

Z-3: 2-dimethylaminoethanol,

Z-4: diethylene glycol.

In the image forming layer of the photothermographic material according to the invention, if necessary, there can be added hydrophilic polymers such as gelatin, poly(vinyl alcohol), methyl cellulose, hydroxypropyl cellulose, carboxymethyl cellulose, or the like. These hydrophilic polymers are added at an amount of 30% by weight or less, and preferably 20% by weight or less, with respect to the total weight of the binder incorporated in the image forming layer.

According to the invention, the layer containing organic silver salt (image forming layer) is preferably formed by using polymer latex for the binder. Concerning the amount of the binder for the image forming layer, the mass ratio of total binder to organic silver salt (total binder/organic silver salt) is preferably in a range of from 1/10 to 10/1, more preferably from 1/3 to 5/1, and even more preferably from 1/1 to 3/1.

The image forming layer is, in general, a photosensitive layer (image forming layer) containing a photosensitive silver halide, i.e., the photosensitive silver salt; in such a case, the mass ratio of total binder to silver halide (total binder/silver halide) is in a range of from 5 to 400, and more preferably from 10 to 200.

The total amount of binder in the image forming layer of the invention is preferably in a range of from 0.2 $g/m^2$ to 30 $g/m^2$, more preferably from 1 $g/m^2$ to 15 $g/m^2$, and even more preferably from 2 $g/m^2$ to 10 $g/m^2$. Concerning the image forming layer of the invention, there may be added a crosslinking agent for crosslinking, a surfactant to improve coating ability, or the like.

(Antifoggant)

1) Organic Polyhalogen Compound

Preferable organic polyhalogen compound that is used in the invention is explained specifically below. In the invention, preferred organic polyhalogen compound is the compound expressed by the following formula (H).

$$Q\text{-}(Y)n\text{—}C(Z_1)(Z_2)X \qquad \text{Formula (H)}$$

In formula (H), Q represents one selected from an alkyl group, an aryl group, or a heterocyclic group; Y represents a divalent linking group; n represents 0 or 1; $Z_1$ and $Z_2$ each represent a halogen atom; and X represents a hydrogen atom or an electron-attracting group.

In formula (H), Q is preferably an alkyl group having 1 to 6 carbon atoms, an aryl group having 6 to 12 carbon atoms, or a heterocyclic group comprising at least one nitrogen atom (pyridine, quinoline, or the like).

In the case where Q is an aryl group in formula (H), Q preferably is a phenyl group substituted by an electron-attracting group whose Hammett substituent constant σp yields a positive value. For the details of Hammett substituent constant, reference can be made to Journal of Medicinal Chemistry, vol. 16, No. 11 (1973), pp. 1207 to 1216, and the like. As such electron-attracting groups, examples include, halogen atoms, an alkyl group substituted by an electron-attracting group, an aryl group substituted by an electron-attracting group, a heterocyclic group, an alkylsulfonyl group, an arylsulfonyl group, an acyl group, an alkoxycarbonyl group, a carbamoyl group, sulfamoyl group and the like. Preferable as the electron-attracting group is a halogen atom, a carbamoyl group, or an arylsulfonyl group, and particularly preferred among them is a carbamoyl group.

X is preferably an electron-attracting group. As the electron-attracting group, preferable are a halogen atom, an aliphatic arylsulfonyl group, a heterocyclic sulfonyl group, an aliphatic arylacyl group, a heterocyclic acyl group, an aliphatic aryloxycarbonyl group, a heterocyclic oxycarbonyl group, a carbamoyl group, and a sulfamoyl group; more preferable are a halogen atom and a carbamoyl group; and particularly preferable is a bromine atom.

$Z_1$ and $Z_2$ each are preferably a bromine atom or an iodine atom, and more preferably, a bromine atom.

Y preferably represents —C(═O)—, —SO—, —$SO_2$—, —C(═O)N(R)—, or —$SO_2$N(R)—; more preferably, —C(═O)—, —$SO_2$—, or —C(═O)N(R)—; and particularly preferably, —$SO_2$— or —C(═O)N(R)—. Herein, R represents a hydrogen atom, an aryl group, or an alkyl group, preferably a hydrogen atom or an alkyl group, and particularly preferably a hydrogen atom.

n represents 0 or 1, and is preferably 1.

In formula (H), in the case where Q is an alkyl group, Y is preferably —C(═O)N(R)—. And, in the case where Q is an aryl group or a heterocyclic group, Y is preferably —$SO_2$—.

In formula (H), the embodiment where the residues, which are obtained by removing a hydrogen atom from the compound, bond to each other (generally called bis type, tris type, or tetrakis type) is also preferably used.

In formula (H), the embodiment having a substituent of a dissociative group (for example, a COOH group or a salt thereof, an $SO_3H$ group or a salt thereof, a $PO_3H$ group or a salt thereof, or the like), a group containing a quaternary nitrogen cation (for example, an ammonium group, a pyridinium group, or the like), a polyethyleneoxy group, a hydroxy group, or the like is also preferable.

Specific examples of the compound expressed by formula (H) of the invention are shown below.

H-1

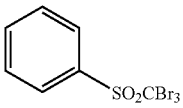

H-2

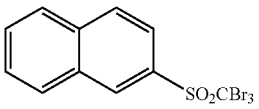

H-3

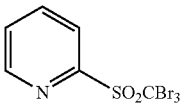

H-4

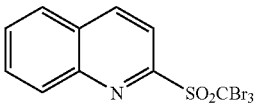

H-5

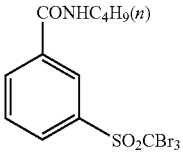

-continued

H-6

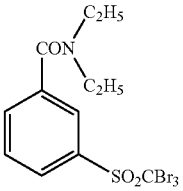

H-7

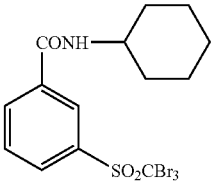

H-8

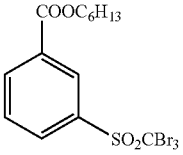

H-9

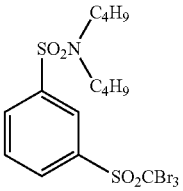

H-10

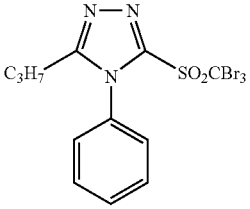

H-11

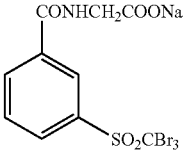

H-12

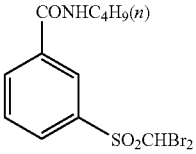

H-13

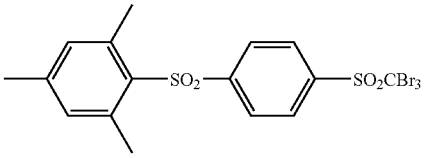

H-14

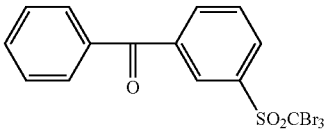

-continued

H-15

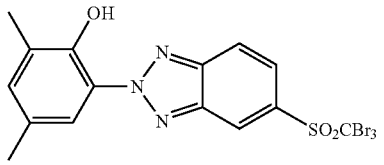

H-16

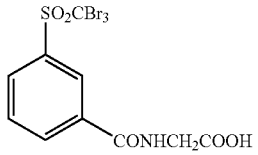

H-17

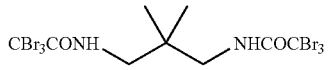

H-18

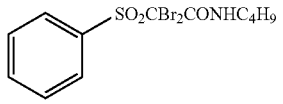

H-19

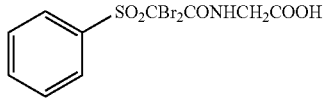

As preferred organic polyhalogen compounds of the invention other than those above, there can be mentioned compounds disclosed in U.S. Pat. Nos. 3,874,946, 4,756,999, 5,340,712, 5,369,000, 5,464,737, and 6,506,548, JP-A Nos. 50-137126, 50-89020, 50-119624, 59-57234, 7-2781, 7-5621, 9-160164, 9-244177, 9-244178, 9-160167, 9-319022, 9-258367, 9-265150, 9-319022, 10-197988, 10-197989, 11-242304, 2000-2963, 2000-112070, 2000-284410, 2000-284412, 2001-33911, 2001-31644, 2001-312027, and 2003-50441. Particularly, compounds disclosed in JP-A Nos. 7-2781, 2001-33911 and 20001-312027 are preferable.

The compound expressed by formula (H) of the invention is preferably used in an amount of from $10^{-4}$ mol to 1 mol, more preferably, from $10^{-3}$ mol to 0.5 mol, and further preferably, from $1\times10^{-2}$ mol to 0.2 mol, per 1 mol of non-photosensitive silver salt incorporated in the image forming layer.

In the invention, usable methods for incorporating the antifoggant into the photothermographic material are those described above in the method for incorporating the reducing agent, and also for the organic polyhalogen compound, it is preferably added in the form of a solid fine particle dispersion.

2) Other Antifoggants

As other antifoggants, there can be mentioned a mercury (II) salt described in paragraph number 0113 of JP-A No. 11-65021, benzoic acids described in paragraph number 0114 of the same literature, a salicylic acid derivative described in JP-A No. 2000-206642, a formalin scavenger compound expressed by formula (S) in JP-A No. 2000-221634, a triazine compound related to Claim 9 of JP-A No. 11-352624, a compound expressed by formula (III), 4-hydroxy-6-methyl-1,3,3a,7-tetrazaindene and the like, described in JP-A No. 6-11791.

The photothermographic material of the invention may further contain an azolium salt in order to prevent fogging. Azolium salts useful in the present invention include a compound expressed by formula (XI) described in JP-A No. 59-193447, a compound described in JP-B No. 55-12581, and a compound expressed by formula (II) in JP-A No. 60-153039. The azolium salt may be added to any part of the photothermographic material, but as an additional layer, it is preferred to select a layer on the side having thereon the image forming layer, and more preferred is to select the image forming layer itself. The azolium salt may be added at any time of the process of preparing the coating solution; in the case where the azolium salt is added into the image forming layer, any time of the process may be selected, from the preparation of the organic silver salt to the preparation of the coating solution, but preferred is to add the salt after preparing the organic silver salt and just before coating. As the method for adding the azolium salt, any method using a powder, a solution, a fine-particle dispersion, and the like, may be used. Furthermore, it may be added as a solution having mixed therein other additives such as sensitizing agents, reducing agents, toners, and the like.

In the invention, the azolium salt may be added at any amount, but preferably, it is added in a range of from $1\times10^{-6}$ mol to 2 mol, and more preferably, from $1\times10^{-3}$ mol to 0.5 mol, per 1 mol of silver.

(Other Additives)

1) Mercapto Compounds, Disulfides and Thiones

In the invention, mercapto compounds, disulfide compounds, and thione compounds can be added in order to control the development by suppressing or enhancing development, to improve spectral sensitization efficiency, and to improve storage stabilities of before and after development. Descriptions can be found in paragraph numbers 0067 to 0069 of JP-A No. 10-62899, a compound expressed by formula (I) of JP-A No. 10-186572 and specific examples thereof shown in paragraph numbers 0033 to 0052, in lines 36 to 56 in page 20 of EP No. 0803764A1. Among them, mercapto-substituted heterocyclic aromatic compounds described in JP-A Nos. 9-297367, 9-304875, 2001-100358, 2002-303954, 2002-303951, and the like are preferred.

2) Toner

In the photothermographic material of the present invention, the addition of a toner is preferred. Description on the toner can be found in JP-A No. 10-62899 (paragraph numbers 0054 to 0055), EP No. 0803764A1 (page 21, lines 23 to 48), JP-A Nos. 2000-356317 and 2000-187298. Preferred are phthalazinones (phthalazinone, phthalazinone derivatives and metal salts thereof, (e.g., 4-(1-naphthyl)phthalazinone, 6-chlorophthalazinone, 5,7-dimethoxyphthalazinone, and 2,3-dihydro-1,4-phthalazinedione); combinations of phthalazinones and phthalic acids (e.g., phthalic acid, 4-methylphthalic acid, 4-nitrophthalic acid, diammonium phthalate, sodium phthalate, potassium phthalate, and tetrachlorophthalic anhydride); phthalazines (phthalazine, phthalazine derivatives and metal salts thereof, (e.g., 4-(1-naphthyl)phthalazine, 6-isopropylphthalazine, 6-tert-butylphthalazine, 6-chlorophthalazine, 5,7-dimethoxyphthalazine, and 2,3-dihydrophthalazine); combinations of phthalazines and phthalic acids. Particularly preferred is a combination of phthalazines and phthalic acids. Among them, particularly preferable are the combination of 6-isopropylphthalazine and phthalic acid, and the combination of 6-isopropylphthalazine and 4-methylphthalic acid.

3) Plasticizer and Lubricant

Plasticizers and lubricants usable in the image forming layer of the invention are described in paragraph No. 0117 of JP-A No. 11-65021. Lubricants are described in paragraph Nos. 0061 to 0064 of JP-A No. 11-84573.

4) Dyes and Pigments

From the viewpoint of improving color tone, preventing the generation of interference fringes and preventing irradiation on laser exposure, various dyes and pigments (for instance, C.I. Pigment Blue 60, C.I. Pigment Blue 64, and C.I. Pigment Blue 15:6) can be used in the photothermographic material of the invention together with the aforementioned metal phthalocyanine dye. Detailed description can be found in WO No. 98/36322, JP-A Nos. 10-268465 and 11-338098, and the like.

5) Nucleator

Concerning the photothermographic material of the invention, it is preferred to add a nucleator into the image forming layer. Details on the nucleators, method for their addition and addition amount can be found in paragraph No. 0118 of JP-A No. 11-65021, paragraph Nos. 0136 to 0193 of JP-A No. 11-223898, as compounds expressed by formulae (H), (1) to (3), (A), and (B) in JP-A No. 2000-284399; as for a nucleation accelerator, description can be found in paragraph No. 0102 of JP-A No. 11-65021, and in paragraph Nos. 0194 to 0195 of JP-A No. 11-223898.

In the case of using formic acid or formates as a strong fogging agent, it is preferably incorporated into the side having thereon the image forming layer containing photosensitive silver halide in an amount of 5 mmol or less, and more preferably 1 mmol or less, per 1 mol of silver.

In the case of using a nucleator in the photothermographic material of the invention, it is preferred to use an acid resulting from hydration of diphosphorus pentaoxide, or a salt thereof in combination. Acids resulting from the hydration of diphosphorus pentaoxide or salts thereof include metaphosphoric acid (salt), pyrophosphoric acid (salt), orthophosphoric acid (salt), triphosphoric acid (salt), tetraphosphoric acid (salt), hexametaphosphoric acid (salt), and the like. Particularly preferred acids obtainable by the hydration of diphosphorus pentaoxide or salts thereof include orthophosphoric acid (salt) and hexametaphosphoric acid (salt). Specifically mentioned as the salts are sodium orthophosphate, sodium dihydrogen orthophosphate, sodium hexametaphosphate, ammonium hexametaphosphate, and the like.

The addition amount of the acid obtained by hydration of diphoshorus pentaoxide or the salt thereof (i.e., the coating amount per 1 $m^2$ of the photothermographic material) may be set as desired depending on sensitivity and fogging, but preferred is an amount of from 0.1 $mg/m^2$ to 500 $mg/m^2$, and more preferably, from 0.5 mg/m to 100 $mg/m^2$.

(Preparation of Coating Solution and Coating)

The temperature for preparing the coating solution for the image forming layer of the invention is preferably from 30° C. to 65° C., more preferably, 35° C. or more and less than 60° C., and further preferably, from 35° C. to 55° C. Furthermore, the temperature of the coating solution for the image forming layer immediately after adding the polymer latex is preferably maintained in the temperature range from 30° C. to 65° C.

(Layer Constitution and Constituent Components)

The photothermographic material of the invention has one or more image forming layers constructed on a support. In the case of constituting the image forming layer from one layer, the image forming layer comprises an organic silver salt, a photosensitive silver halide, a reducing agent, and a binder, and may further comprise additional materials as desired and necessary, such as an antifoggant, a toner, a film-forming promoting agent, and other auxiliary agents. In the case of constituting the image forming layer from two or more layers, the first image forming layer (in general, a layer placed nearer to the support) contains an organic silver salt and a photosensitive silver halide. Some of the other components may be incorporated in the second image forming layer or in both of the layers.

The photothermographic material according to the invention has a non-photosensitive layer in addition to the image forming layer. In general, non-photosensitive layers can be classified depending on the layer arrangement into (a) a surface protective layer provided on the image forming layer (on the side farther from the support), (b) an intermediate layer provided among plural image forming layers or between the image forming layer and the protective layer, (c) an undercoat layer provided between the image forming layer and the support, and (d) a back layer which is provided on the side opposite to the image forming layer.

Furthermore, a layer that functions as an optical filter may be provided as (a) or (b) above. An antihalation layer may be provided as (c) or (d) to the photothermographic material.

1) Surface Protective Layer

The photothermographic material of the invention can comprise a surface protective layer with an object to prevent adhesion of the image forming layer. The surface protective layer may be a single layer, or plural layers.

Description on the surface protective layer may be found in paragraph Nos. 0119 to 0120 of JP-A No. 11-65021 and in JP-A No. 2000-171936.

Preferred as the binder of the surface protective layer of the invention is gelatin, but poly(vinyl alcohol) (PVA) may be used preferably instead, or in combination. As gelatin, there can be used an inert gelatin (e.g., Nitta gelatin 750), a phthalated gelatin (e.g., Nitta gelatin 801), and the like. Usable as PVA are those described in paragraph Nos. 0009 to 0020 of JP-A No. 2000-171936, and preferred are the completely saponified product PVA-105, the partially saponified PVA-205, and PVA-335, as well as modified poly(vinyl alcohol) MP-203 (all trade name of products from Kuraray Ltd.). The amount of coated poly(vinyl alcohol) (per 1 $m^2$ of support) in the surface protective layer (per one layer) is preferably in a range from 0.3 $g/m^2$ to 4.0 $g/m^2$, and more preferably, from 0.3 $g/m^2$ to 2.0 $g/m^2$.

The total amount of the coated binder (including water-soluble polymer and latex polymer) (per 1 $m^2$ of support) in the surface protective layer (per one layer) is preferably in a range from 0.3 $g/m^2$ to 5.0 $g/m^2$, and more preferably from 0.3 $g/m^2$ to 2.0 $g/m^2$.

2) Antihalation Layer

The photothermographic material of the present invention can comprise an antihalation layer provided to the side farther from the light source than the image forming layer. It is preferred that an antihalation layer is provided between the back layer and the support, or between the image forming layer and the support.

Description on the antihalation layer can be found in paragraph Nos. 0123 to 0124 of JP-A No. 11-65021, in JP-A Nos. 11-223898, 9-230531, 10-36695, 10-104779, 11-231457, 11-352625, 11-352626, and the like.

The antihalation layer contains an antihalation dye having its absorption at the wavelength of the exposure light. In the case where the exposure wavelength is in the infrared region, an infrared-absorbing dye may be used, and in such a case, preferred are dyes having no absorption in the visible light region.

In the photothermographic material of the invention, it is preferred to use the aforementioned metal phthalocyanine dye as the antihalation dye.

In general, the dye is used at an amount as such that the optical density (absorbance) exceeds 0.1 when measured at the desired wavelength. The optical density is preferably in a range from 0.15 to 2, and more preferably from 0.2 to 1. The addition amount of dyes to obtain optical density in the above range is generally about from 0.001 g/m$^2$ to 1 g/m$^2$.

3) Back Layer

Back layers usable in the invention are described in paragraph Nos. 0128 to 0130 of JP-A No. 11-65021.

In the invention, coloring matters having absorption maximum in a wavelength range from 300 nm to 450 nm can be added in order to improve color tone of developed silver images and a deterioration of the images during aging. Such coloring matters are described in, for example, JP-A Nos. 62-210458, 63-104046, 63-103235, 63-208846, 63-306436, 63-314535, 01-61745, 2001-100363, and the like.

Such coloring matters are generally added in a range of from 0.1 mg/m$^2$ to 1 g/m$^2$. Concerning the layer to be added, the coloring matter is preferably added to the back layer which is provided to the opposite side of the support from the image forming layer.

4) Matting Agent

A matting agent is preferably added to the photothermographic material of the invention in order to improve transportability. Description on the matting agent can be found in paragraphs Nos. 0126 to 0127 of JP-A No. 11-65021. The addition amount of the matting agent is preferably in a range from 1 mg/m$^2$ to 400 mg/m$^2$, and more preferably, from 5 mg/m$^2$ to 300 mg/m$^2$, with respect to the coating amount per 1 m$^2$ of the photothermographic material.

The shape of the matting agent usable in the invention may be a fixed form or non-fixed form. Preferred is to use those having fixed form and globular shape. The mean particle diameter is preferably in a range of from 0.5 μm to 10 μm, more preferably from 1.0 μm to 8.0 μm, and even more preferably from 2.0 μm to 6.0 μm. Furthermore, the particle size distribution of the matting agent is preferably set as such that the variation coefficient may become 50% or lower, more preferably, 40% or lower, and further preferably, 30% or lower. The variation coefficient, herein, is defined by (the standard deviation of particle diameter)/(mean diameter of the particle)×100. Furthermore, it is preferred to use two types of matting agents having low variation coefficient and the ratio of their mean particle diameters being higher than 3 in combination.

The level of matting on the image forming layer surface is not restricted as far as star-dust trouble occurs, but the level of matting of from 30 seconds to 2000 seconds is preferred, particularly preferred, from 40 seconds to 1500 seconds as Beck's smoothness. Beck's smoothness can be calculated easily, using Japan Industrial Standard (JIS) P8119 "The method of testing Beck's smoothness for papers and sheets using Beck's test apparatus", or TAPPI standard method T479.

The level of matting of the back layer in the invention is preferably in a range of 1200 seconds or less and 10 seconds or more; more preferably, 800 seconds or less and 20 seconds or more; and even more preferably, 500 seconds or less and 40 seconds or more, when expressed by Beck's smoothness.

In the present invention, a matting agent is preferably contained in an outermost layer, in a layer which can function as an outermost layer, or in a layer nearer to outer surface, and also preferably is contained in a layer which can function as a so-called protective layer.

5) Polymer Latex

In the present invention, a polymer latex is preferably used in the surface protective layer and the back layer of the photothermographic material in the present invention. As such polymer latex, descriptions can be found in "Gosei Jushi Emulsion (Synthetic resin emulsion)" (Taira Okuda and Hiroshi Inagaki, Eds., published by Kobunshi Kankokai (1978)), "Gosei Latex no Oyo (Application of synthetic latex)" (Takaaki Sugimura, Yasuo Kataoka, Soichi Suzuki, and Keiji Kasahara, Eds., published by Kobunshi Kankokai (1993)), and "Gosei Latex no Kagaku (Chemistry of synthetic latex)" (Soichi Muroi, published by Kobunshi Kankokai (1970)). More specifically, there can be mentioned a latex of methyl methacrylate (33.5% by weight)/ethyl acrylate (50% by weight)/methacrylic acid (16.5% by weight) copolymer, a latex of methyl methacrylate (47.5% by weight)/butadiene (47.5% by weight)/itaconic acid (5% by weight) copolymer, a latex of ethyl acrylate/methacrylic acid copolymer, a latex of methyl methacrylate (58.9% by weight)/2-ethylhexyl acrylate (25.4% by weight)/styrene (8.6% by weight)/2-hydroethyl methacrylate (5.1% by weight)/acrylic acid (2.0% by weight) copolymer, a latex of methyl methacrylate (64.0% by weight)/styrene (9.0% by weight)/butyl acrylate (20.0% by weight)/2-hydroxyethyl methacrylate (5.0% by weight)/acrylic acid (2.0% by weight) copolymer, and the like.

Furthermore, as the binder for the surface protective layer, there can be applied the technology described in paragraph Nos. 0021 to 0025 of the specification of JP-A No. 2000-267226, and the technology described in paragraph Nos. 0023 to 0041 of the specification of JP-A No. 2000-19678. The polymer latex in the surface protective layer is preferably contained in an amount of from 10% by weight to 90% by weight, particularly preferably from 20% by weight to 80% by weight, based on a total weight of binder.

6) Surface pH

The surface pH of the photothermographic material according to the invention preferably yields a pH of 7.0 or lower, and more preferably 6.6 or lower, before thermal developing process. Although there is no particular restriction concerning the lower limit, the lower limit of pH value is about 3. The most preferred surface pH range is from 4 to 6.2. From the viewpoint of reducing the surface pH, it is preferred to use an organic acid such as phthalic acid derivative or a non-volatile acid such as sulfuric acid, or a volatile base such as ammonia for the adjustment of the surface pH. In particular, ammonia can be used favorably for the achievement of low surface pH, because it can easily vaporize to remove it before the coating step or before applying thermal development.

It is also preferred to use a non-volatile base such as sodium hydroxide, potassium hydroxide, lithium hydroxide, and the like, in combination with ammonia. The method of measuring surface pH value is described in paragraph No. 0123 of the specification of JP-A No. 2000-284399.

7) Hardener

A hardener may be used in each of image forming layer, protective layer, back layer, and the like of the invention. As examples of the hardener, descriptions of various methods can be found in pages 77 to 87 of T. H. James, "THE THEORY OF THE PHOTOGRAPHIC PROCESS, FOURTH EDITION" (Macmillan Publishing Co., Inc., 1977). Preferably used are, in addition to chromium alum, sodium salt of 2,4-dichloro-6-hydroxy-s-triazine, N,N-ethylene bis(vinylsulfonacetamide), and N,N-propylene bis(vinylsulfonacetamide), polyvalent metal ions described in page 78 of the above literature and the like, polyisocyanates described in U.S. Pat. No. 4,281,060, JP-A No. 6-208193, and the like, epoxy compounds of U.S. Pat. No. 4,791,042 and the like, and vinylsulfone compounds of JP-A No. 62-89048.

The hardener is added as a solution, and the solution is added to a coating solution 180 minutes before coating to just before coating, preferably 60 minutes before to 10 seconds before coating. However, so long as the effect of the invention is sufficiently exhibited, there is no particular restriction concerning the mixing method and the conditions of mixing. As specific mixing methods, there can be mentioned a method of mixing in the tank, in which the average stay time calculated from the flow rate of addition and the feed rate to the coater is controlled to yield a desired time, or a method using static mixer as described in Chapter 8 of N. Harnby, M. F. Edwards, A. W. Nienow (translated by Koji Takahashi) "Ekitai Kongo Gijutu (Liquid Mixing Technology)" (Nikkan Kogyo Shinbunsha, 1989), and the like.

8) Surfactant

Concerning the surfactant, the solvent, the support, antistatic agent and the electrically conductive layer, and the method for obtaining color images applicable in the invention, there can be used those disclosed in paragraph numbers 0132, 0133, 0134, 0135, and 0136, respectively, of JP-A No. 11-65021. Concerning lubricants, there can be used those disclosed in paragraph numbers 0061 to 0064 of JP-A No. 11-84573 and in paragraph numbers 0049 to 0062 of JP-A No. 2001-83679.

In the invention, it is preferred to use a fluorocarbon surfactant. Specific examples of fluorocarbon surfactants can be found in those described in JP-A Nos. 10-197985, 2000-19680, and 2000-214554. Polymer fluorocarbon surfactants described in JP-A No. 9-281636 can be also used preferably. For the photothermographic material in the invention, the fluorocarbon surfactants described in JP-A Nos. 2002-82411, 2003-57780, and 2001-264110 are preferably used. Especially, the usage of the fluorocarbon surfactants described in JP-A Nos. 2003-57780 and 2001-264110 in an aqueous coating solution is preferred viewed from the standpoint of capacity in static control, stability of the coated surface state, and sliding facility. The fluorocarbon surfactant described in JP-A No. 2001-264110 is most preferred because of high capacity in static control and that it needs small amount to use.

According to the invention, the fluorocarbon surfactant can be used on either side of image forming layer side or backside, but is preferred to use on the both sides. Further, it is particularly preferred to use in combination with electrically conductive layer including metal oxides described below. In this case the amount of the fluorocarbon surfactant on the side of the electrically conductive layer can be reduced or removed.

The addition amount of the fluorocarbon surfactant is preferably in a range of from 0.1 mg/m$^2$ to 100 mg/m$^2$ on each side of image forming layer and back layer, more preferably from 0.3 mg/m$^2$ to 30 mg/m$^2$, and even more preferably from 1 mg/m$^2$ to 10 mg/m$^2$. Especially, the fluorocarbon surfactant described in JP-A No. 2001-264110 is very effective, and used preferably in a range of from 0.01 mg/m$^2$ to 10 mg/m$^2$, and more preferably, in a range of from 0.1 mg/m$^2$ to 5 mg/m$^2$.

9) Antistatic Agent

The photothermographic material of the invention preferably contains an electrically conductive layer including metal oxides or electrically conductive polymers. The antistatic layer may serve as an undercoat layer, a back surface protective layer, or the like, but can also be placed specially. As an electrically conductive material of the antistatic layer, metal oxides having enhanced electric conductivity by the method of introducing oxygen defects or different types of metallic atoms into the metal oxides are preferable for use. Examples of metal oxides are preferably selected from ZnO, $TiO_2$, or $SnO_2$. As the combination of different types of atoms, preferred are ZnO combined with Al, or In; $SnO_2$ with Sb, Nb, P, halogen atoms, or the like; $TiO_2$ with Nb, Ta, or the like.

Particularly preferred for use is $SnO_2$ combined with Sb. The addition amount of different types of atoms is preferably in a range of from 0.01 mol % to 30 mol %, and more preferably, in a range of from 0.1 mol % to 10 mol %. The shape of the metal oxides can include, for example, spherical, needle-like, or tabular. The needle-like particles, with the rate of (the major axis)/(the minor axis) is 2.0 or more, and more preferably in a range of from 3.0 to 50, is preferred viewed from the standpoint of the electric conductivity effect. The metal oxides is preferably used in a range of from 1 mg/m$^2$ to 1000 mg/m$^2$, more preferably from 10 mg/m$^2$ to 500 mg/m$^2$, and even more preferably from 20 mg/m$^2$ to 200 mg/m$^2$.

The antistatic layer according to the invention can be laid on either side of the image forming layer side or the backside, it is preferred to set between the support and the back layer.

Specific examples of the antistatic layer in the invention include described in paragraph Nos. 0135 of JP-A No. 11-65021, in JP-A Nos. 56-143430, 56-143431, 58-62646, and 56-120519, and in paragraph Nos. 0040 to 0051 of JP-A No. 11-84573, in U.S. Pat. No. 5,575,957, and in paragraph Nos. 0078 to 0084 of JP-A No. 11-223898.

10) Support

As the transparent support, preferably used is polyester, particularly, polyethylene terephthalate, which is subjected to heat treatment in the temperature range of from 130° C. to 185° C. in order to relax the internal strain caused by biaxial stretching and remaining inside the film, and to remove strain ascribed to heat shrinkage generated during thermal development. In the case of a photothermographic material for medical use, the transparent support may be colored with a blue dye (for instance, dye-1 described in the Example of JP-A No. 8-240877), or may be uncolored. As to the support, it is preferred to apply undercoating technology, such as water-soluble polyester described in JP-A No. 11-84574, a styrene-butadiene copolymer described in JP-A No. 10-186565, a vinylidene chloride copolymer described in JP-A No. 2000-39684, and the like. The moisture content of the support is preferably 0.5% by weight or lower when coating for image forming layer and back layer is conducted on the support.

11) Other Additives

Furthermore, an antioxidant, stabilizing agent, plasticizer, UV absorbing agent, or film-forming promoting agent may be added to the photothermographic material. Each of the additives is added to either of the image forming layer or the non-photosensitive layer. Reference can be made to WO No. 98/36322, EP No. 803764A1, JP-A Nos. 10-186567 and 10-18568, and the like.

12) Coating Method

The photothermographic material of the invention may be coated by any method. Specifically, various types of coating operations including extrusion coating, slide coating, curtain coating, immersion coating, knife coating, flow coating, or an extrusion coating using the type of hopper described in U.S. Pat. No. 2,681,294 are used. Preferably used is extrusion coating or slide coating described in pages 399 to 536 of Stephen F. Kistler and Petert M. Shweizer, "LIQUID FILM COATING" (Chapman & Hall, 1997), and particularly preferably used is slide coating. Example of the shape of the slide coater for use in slide coating is shown in FIG.

11*b*.1, page 427, of the same literature. If desired, two or more layers can be coated simultaneously by the method described in pages 399 to 536 of the same literature, or by the method described in U.S. Pat. No. 2,761,791 and British Patent No. 837,095. Particularly preferred in the invention is the method described in JP-A Nos. 2001-194748, 2002-153808, 2002-153803, and 2002-182333.

The coating solution for the image forming layer in the invention is preferably a so-called thixotropic fluid. For the details of this technology, reference can be made to JP-A No. 11-52509. Viscosity of the coating solution for the image forming layer in the invention at a shear velocity of 0.1 $S^{-1}$ is preferably from 400 mPa·s to 100,000 mPa·s, and more preferably, from 500 mPa·s to 20,000 mPa·s. At a shear velocity of 1000 $S^{-1}$, the viscosity is preferably from 1 mPa·s to 200 mPa·s, and more preferably, from 5 mPa·s to 80 mPa·s.

In the case of mixing two types of liquids on preparing the coating solution of the invention, known in-line mixer and in-plant mixer can be used favorably. Preferred in-line mixer of the invention is described in JP-A No. 2002-85948, and the in-plant mixer is described in JP-A No. 2002-90940.

The coating solution of the invention is preferably subjected to antifoaming treatment to maintain the coated surface in a fine state. Preferred method for antifoaming treatment in the invention is described in JP-A No. 2002-66431.

In the case of applying the coating solution of the invention to the support, it is preferred to perform diselectrification in order to prevent the adhesion of dust, particulates, and the like due to charge up. Preferred example of the method of diselectrification for use in the invention is described in JP-A No. 2002-143747.

Since a non-setting coating solution is used for the image forming layer in the invention, it is important to precisely control the drying wind and the drying temperature. Preferred drying method for use in the invention is described in detail in JP-A Nos. 2001-194749 and 2002-139814.

In order to improve the film-forming properties in the photothermographic material of the invention, it is preferred to apply a heat treatment immediately after coating and drying. The temperature of the heat treatment is preferably in a range of from 60° C. to 100° C. at the film surface, and time period for heating is preferably in a range of from 1 second to 60 seconds. More preferably, heating is performed in a temperature range of from 70° C. to 90° C. at the film surface, and the time period for heating is from 2 seconds to 10 seconds. A preferred method of heat treatment for the invention is described in JP-A No. 2002-107872.

Furthermore, the producing methods described in JP-A Nos. 2002-156728 and 2002-182333 are favorably used in the invention in order to stably and successively produce the photothermographic material of the invention.

The photothermographic material is preferably of monosheet type (i.e., a type which can form image on the photothermographic material without using other sheets such as an image-receiving material).

13) Wrapping Material

In order to suppress fluctuation from occurring on photographic property during a preservation of the photothermographic material of the invention before thermal development, or in order to improve curling or winding tendencies when the photothermographic material is manufactured in a roll state, it is preferred that a wrapping material having low oxygen transmittance and/or vapor transmittance is used. Preferably, oxygen transmittance is 50 $mL \cdot atm^{-1}m^{-2}day^{-1}$ or lower at 25° C., more preferably, 10 $mL \cdot atm^{-1}m^{-2}$ $day^{-1}$ or lower, and even more preferably, 1.0 $mL.atm^{-1}m^{-2}day^{-1}$ or lower. Preferably, vapor transmittance is 10 $g \cdot atm^{-1}m^{-2}day^{-1}$ or lower, more preferably, 5 $g \cdot atm^{-1}m^{-2}day^{-1}$ or lower, and even more preferably, 1 $g \cdot atm^{-1}m^{-2}day^{-1}$ or lower.

As specific examples of a wrapping material having low oxygen transmittance and/or vapor transmittance, reference can be made to, for instance, the wrapping material described in JP-A Nos. 8-254793 and 2000-206653.

14) Other Applicable Techniques

Techniques which can be used for the photothermographic material of the invention also include those in EP No. 803764A1, EP No. 883022A1, WO No. 98/36322, JP-A Nos. 56-62648, 58-62644, JP-A Nos. 9-43766, 9-281637, 9-297367, 9-304869, 9-311405, 9-329865, 10-10669, 10-62899, 10-69023, 10-186568, 10-90823, 10-171063, 10-186565, 10-186567, 10-186569 to 10-186572, 10-197974, 10-197982, 10-197983, 10-197985 to 10-197987, 10-207001, 10-207004, 10-221807, 10-282601, 10-288823, 10-288824, 10-307365, 10-312038, 10-339934, 11-7100, 11-15105, 11-24200, 11-24201, 11-30832, 11-84574, 11-65021, 11-109547, 11-125880, 11-129629, 11-133536 to 11-133539, 11-133542, 11-133543, 11-223898, 11-352627, 11-305377, 11-305378, 11-305384, 11-305380, 11-316435, 11-327076, 11-338096, 11-338098, 11-338099, 11-343420, JP-A Nos. 2000-187298, 2000-10229, 2000-47345, 2000-206642, 2000-98530, 2000-98531, 2000-112059, 2000-112060, 2000-112104, 2000-112064, and 2000-171936.

(Image Forming Method)

1) Exposure

The photothermographic material of the invention may be subjected to imagewise exposure by any known methods. The photothermographic material of the present invention is preferably subjected to scanning exposure using a laser beam.

As a laser beam which can be used in the present invention, there can be mentioned He—Ne laser of red through infrared emission, red laser diode, or $Ar^+$, He—Ne, He—Cd laser of blue through green emission, and blue laser diode. Preferred is red to infrared laser diode and the peak wavelength of laser beam is 600 nm to 900 nm, and preferably 620 nm to 850 nm.

In recent years, development has been made particularly on a light source module with an SHG (a second harmonic generator) and a laser diode integrated into a single piece whereby a laser output apparatus in a short wavelength region has become popular. A blue laser diode enables high definition image recording and makes it possible to obtain an increase in recording density and a stable output over a long lifetime, which results in expectation of an expanded demand in the future. The peak wavelength of blue laser beam is preferably from 300 nm to 500 nm, and particularly preferably from 400 nm to 500 nm.

Laser beam which oscillates in a longitudinal multiple modulation by a method such as high frequency superposition is also preferably employed.

2) Thermal Development

Although any method may be used for developing the photothermographic material of the present invention, development is usually performed by elevating the temperature of the photothermographic material exposed imagewise. The temperature of development is preferably from 80° C. to 250° C., more preferably from 100° C. to 140° C., and even more preferably from 110° C. to 130° C. Time period for development is preferably from 1 second to 60 seconds, more preferably from 3 seconds to 30 seconds, and even more preferably from 5 seconds to 25 seconds.

In the process of thermal development, either a drum type heater or a plate type heater may be used, although a plate type heater is preferred. A preferable process of thermal development by a plate type heater is a process described in JP-A No. 11-133572, which discloses a thermal developing apparatus in which a visible image is obtained by bringing a photothermographic material with a formed latent image into contact with a heating means at a thermal developing section, wherein the heating means comprises a plate heater, and a plurality of pressing rollers are oppositely provided along one surface of the plate heater, the thermal developing apparatus is characterized in that thermal development is performed by passing the photothermographic material between the pressing rollers and the plate heater. It is preferred that the plate heater is divided into 2 to 6 steps, with the leading end having a lower temperature by 1° C. to 10° C. For example, 4 sets of plate heaters which can be independently subjected to the temperature control are used, and are controlled so that they respectively become 112° C., 119° C., 121° C., and 120° C. Such a process is also described in JP-A No. 54-30032, which allows for passage of moisture and organic solvents included in the photothermographic material out of the system, and also allows for suppressing the change of shapes of the support of the photothermographic material upon rapid heating of the photothermographic material.

For downsizing the thermal developing apparatus and for reducing the time period for thermal development, it is preferred that the heater is more stably controlled, and a top part of one sheet of the photothermographic material is exposed and thermal development of the exposed part is started before exposure of the end part of the sheet has completed.

Preferable imagers which enable a rapid process according to the invention are described in, for example, JP-A Nos. 2002-289804 and 2002-287668.

3) System

Examples of a medical laser imager equipped with an exposing portion and a thermal developing portion include Fuji Medical Dry Laser Imager FM-DPL and DRYPIX 7000. In connection with FM-DPL, description is found in Fuji Medical Review No. 8, pages 39 to 55. The described techniques may be applied as the laser imager for the photothermographic material of the invention. In addition, the present photothermographic material can be also applied as a photothermographic material for the laser imager used in "AD network" which was proposed by Fuji Film Medical Co., Ltd. as a network system accommodated to DICOM standard.

(Application of the Invention)

The photothermographic material of the invention is preferably used for photothermographic materials for use in medical diagnosis, photothermographic materials for use in industrial photographs, photothermographic materials for use in graphic arts, as well as for COM, through forming black and white images by silver imaging.

All publications, patent applications, and technical standards mentioned in this specification are herein incorporated by reference to the same extent as if each individual publication, patent application, or technical standard was specifically and individually indicated to be incorporated by reference.

EXAMPLES

The present invention is specifically explained by way of Examples below, which should not be construed as limiting the invention thereto.

Example 1

(Preparation of PET Support)

(1) Film Manufacturing

PET having IV (intrinsic viscosity) of 0.66 (measured in phenol/tetrachloroethane=6/4 (mass ratio) at 25° C.) was obtained according to a conventional manner using terephthalic acid and ethylene glycol. The product was pelletized, dried at 130° C. for 4 hours, and melted at 300° C. Thereafter, the mixture was extruded from a T-die and rapidly cooled to form a non-tentered film.

The film was stretched along the longitudinal direction by 3.3 times using rollers of different peripheral speeds, and then stretched along the transverse direction by 4.5 times using a tenter machine. The temperatures used for these operations were 110° C. and 130° C., respectively. Then, the film was subjected to thermal fixation at 240° C. for 20 seconds, and relaxed by 4% along the transverse direction at the same temperature. Thereafter, the chucking part was slit off, and both edges of the film were knurled. Then the film was rolled up at the tension of 4 kg/cm$^2$ to obtain a roll having the thickness of 175 μm.

(2) Surface Corona Discharge Treatment

Both surfaces of the support were treated at room temperature at 20 m/minute using Solid State Corona Discharge Treatment Machine Model 6 KVA manufactured by Piller GmbH. It was proven that treatment of 0.375 kV A ·minute/m$^2$ was executed, judging from the readings of current and voltage on that occasion. The frequency upon this treatment was 9.6 kHz, and the gap clearance between the electrode and dielectric roll was 1.6 mm.

(3) Undercoating

1) Preparations of Coating Solution for Undercoat Layer

| | |
|---|---|
| Formula (1) (for undercoat layer on the image forming layer side) | |
| Pesresin A-520 manufactured by Takamatsu Oil & Fat Co., Ltd. (30% by weight solution) | 59 g |
| Polyethyleneglycol monononylphenylether (average ethylene oxide number = 8.5) 10% by weight solution | 5.4 g |
| MP-1000 manufactured by Soken Chemical & Engineering Co., Ltd. (polymer fine particle, mean particle diameter of 0.4 μm) | 0.91 g |
| Distilled water | 935 mL |
| Formula (2) (for first layer on the backside) | |
| Styrene-butadiene copolymer latex (solid content of 40% by weight, styrene/butadiene mass ratio = 68/32) | 158 g |
| Sodium salt of 2,4-dichloro-6-hydroxy-S-triazine (8% by weight aqueous solution) | 20 g |
| 1% by weight aqueous solution of sodium laurylbenzenesulfonate | 10 mL |
| Distilled water | 854 mL |
| Formula (3) (for second layer on the backside) | |
| $SnO_2$/SbO (9/1 by mass ratio, mean particle diameter of 0.038 μm, 17% by weight dispersion) | 84 g |
| Gelatin (10% by weight aqueous solution) | 89.2 g |
| METOLOSE TC-5 manufactured by Shin-Etsu Chemical Co., Ltd. (2% by weight aqueous solution) | 8.6 g |
| MP-1000 manufactured by Soken Chemical & Engineering Co., Ltd. | 0.01 g |
| 1% by weight aqueous solution of sodium dodecylbenzenesulfonate | 10 mL |
| NaOH (1% by weight) | 6 mL |
| Proxel (manufactured by Imperial Chemical Industries PLC) | 1 mL |
| Distilled water | 805 mL |

2) Undercoating

Both surfaces of the biaxially tentered polyethylene terephthalate support having the thickness of 175 μm were subjected to the corona discharge treatment as described above, respectively. Thereafter, the aforementioned formula (1) of the coating solution for the undercoat was coated on one side (image forming layer side) with a wire bar so that the amount of wet coating became 6.6 mL/m$^2$ (per one side), and dried at 180° C. for 5 minutes. Then, the aforementioned formula (2) of the coating solution for the undercoat was coated on the reverse side (backside) with a wire bar so that the amount of wet coating became 5.7 mL/m$^2$, and dried at 180° C. for 5 minutes. Furthermore, the aforementioned formula (3) of the coating solution for the undercoat was coated on the reverse side (backside) with a wire bar so that the amount of wet coating became 7.7 mL/m$^2$, and dried at 180° C. for 6 minutes. Thus, an undercoated support was produced.

(Back Layer and Back Surface Protective Layer)

1) Preparations of Dispersion of Antihalation Dye and Aqueous Solution of Antihalation Dye <<Preparations of Emulsified Dispersion>>

5.0 g of oil-soluble dye (2) represented by formula (1) of the present invention was added to 15.0 g of tricresyl phosphate and 40 mL of ethyl acetate, and was dissolved at 60° C. The obtained solution was mixed with 150 g of an aqueous solution prepared by dissolving 15 g of lime-processed gelatin and 1.0 g of sodium dodecylbenzenesulfonate, and was dispersed and emulsified at 10000 rpm by using a dissolver stirrer over 20 minutes. After adding ion-exchange water to give a total amount of 250 g, it was further mixed at 200 rpm for 10 minutes to obtain a dye emulsion.

<<Preparation of Solid Dispersion>>

10.0 g of oil-soluble dye (9) represented by formula (1) of the present invention, 20.0 g of a 10% by weight aqueous solution of poly(vinyl pyrrolidone), and 40 mL of water were mixed and dispersed by a sand grinder mill for 15 hours, using zirconia beads having a mean particle diameter of 0.5 mm. 30 mL of water was added to this, and after separating beads, filtrated through a 10 μm filter to obtain a dye solid dispersion.

<<Preparation of Comparative Pigment Dispersion>>

64 g of C.I. Pigment Blue 60 (described as the abbreviation of PB60 in the table) and 6.4 g of DEMOL N manufactured by Kao Corporation were added to 250 g of water and thoroughly mixed to give a slurry. Zirconia beads having the mean particle diameter of 0.5 mm were provided in an amount of 800 g, and charged in a vessel with the slurry. Dispersion was performed with a dispersing machine (1/4G sand grinder mill: manufactured by AIMEX Co., Ltd.) for 25 hours. Thereto was added water to adjust so that the concentration of the pigment became 5% by weight to obtain a pigment dispersion. Particles of the pigment included in the resulting pigment dispersion had a mean particle diameter of 0.21 μm.

<<Preparations of Aqueous Solution 1 of Metal Phthalocyanine Dye>>

Each of the water-soluble dye Nos. 11, 32, and 91 represented by formula (PC-1) of the present invention was dissolved in water, to make 2% by weight aqueous solutions.

<<Preparation of Aqueous Solution 2 of Metal Phthalocyanine Dye>>

The comparative water-soluble metal phthalocyanine, Kayafect Turquoise $R_N$ (produced by Nippon Kayaku Co., Ltd.) (described as the abbreviation of K. T. $R_N$ in the table) was dissolved in water to obtain a 2% by weight aqueous solution.

2) Preparations of Coating Solution-1 to −5 for Back Layer

A vessel was kept at 40° C., and thereto were added 40 g of gelatin, 20 g of monodispersed poly(methyl methacrylate) fine particles (mean particle size of 8 μm, standard deviation of particle diameter of 0.4), 0.1 g of benzisothiazolinone, and 570 mL of water to allow gelatin to be dissolved. Additionally, 2.3 mL of a 1 mol/L sodium hydroxide aqueous solution, the dispersion or solution of dye prepared above as shown in Table 1, 12 mL of a 3% by weight aqueous solution of poly(sodium styrenesulfonate), and 180 g of a 10% by weight liquid of SBR latex were admixed. Just prior to the coating, 80 mL of a 4% by weight aqueous solution of N,N-ethylenebis(vinylsulfone acetamide) was admixed to give a coating solution for the back layer.

3) Preparation of Coating Solution for Back Surface Protective Layer

A vessel was kept at 40° C., and thereto were added 40 g of gelatin, 35 mg of benzisothiazolinone, and 840 mL of water to allow gelatin to be dissolved. Additionally, 5.8 mL of a 1 mol/L sodium hydroxide aqueous solution, liquid paraffin emulsion at 1.5 g equivalent to liquid paraffin, 10 mL of a 5% by weight aqueous solution of sodium di(2-ethylhexyl)sulfosuccinate, 20 mL of a 3% by weight aqueous solution of poly(sodium styrenesulfonate), 2.4 mL of a 2% by weight solution of a fluorocarbon surfactant (F-1), 2.4 mL of a 2% by weight solution of another fluorocarbon surfactant (F-2), and 32 g of a 19% by weight liquid of methyl methacrylate/styrene/butyl acrylate/hydroxyethyl methacrylate/acrylic acid copolymer (mass ratio of the copolymerization of 57/8/28/5/2) latex were admixed. Just prior to the coating, 25 mL of a 4% by weight aqueous solution of N,N-ethylenebis(vinylsulfone acetamide) was admixed to give a coating solution for the back surface protective layer.

4) Coating of Back Layer-1 to −5

The backside of the undercoated support as described above was subjected to simultaneous double coating so that the coating solution for the back layer gives the coating amount of gelatin of 1.7 g/m$^2$, and so that the coating solution for the back surface protective layer gives the coating amount of gelatin of 0.52 g/m$^2$, followed by drying to produce a back layer.

5) Measurement of Spectral Light Absorption Spectrum

The absorption spectrum of the back layer was measured by means of an automatic recording spectrophotometer (U4100, trade name, produced by Hitachi Ltd.). The spectrometer was equipped with an integrating sphere and the sample was placed in the center of the integrating sphere so as to collect the diffused light. An undercoated support in which the back layer is not coated was used for reference.

The maximum absorption wavelength and the half band width at the maximum absorption wavelength are shown in Table 1. The dyes according to the present invention exhibit a narrow half band width (55 nm or less) and a sharp spectral light absorption, compared with the comparative dye and pigment.

(Image Forming Layer, Intermediate Layer, and Surface Protective Layer)

1. Preparations of Coating Material

1) Preparation of Silver Halide Emulsion

<<Preparation of Silver Halide Emulsion 1>>

A liquid was prepared by adding 3.1 mL of a 1% by weight potassium bromide solution, and then 3.5 mL of 0.5 mol/L sulfuric acid and 31.7 g of phthalated gelatin to 1421 mL of distilled water. The liquid was kept at 30° C. while stirring in a stainless steel reaction vessel, and thereto were added a total amount of: solution A prepared through diluting 22.22 g of silver nitrate by adding distilled water to give the volume of 95.4 mL; and solution B prepared through diluting 15.3 g of potassium bromide and 0.8 g of potassium iodide with distilled water to give the volume of 97.4 mL, over 45 seconds at a constant flow rate. Thereafter, 10 mL of a 3.5% by weight aqueous solution of hydrogen peroxide was added thereto, and 10.8 mL of a 10% by weight aqueous solution of benzimidazole was further added. Moreover, a solution C prepared through diluting 51.86 g of silver nitrate by adding distilled water to give the volume of 317.5 mL and a solution D prepared through diluting 44.2 g of potassium bromide and 2.2 g of potassium iodide with distilled water to give the volume of 400 mL were added. A controlled double jet method was executed through adding the total amount of the solution C at a constant flow rate over 20 minutes, accompanied by adding the solution D while maintaining the pAg at 8.1. Potassium hexachloroiridate (III) was added in its entirely to give $1\times10^{-4}$ mol per 1 mol of silver, at 10 minutes post initiation of the addition of the solution C and the solution D. Moreover, at 5 seconds after completing the addition of the solution C, a potassium hexacyanoferrate (II) in an aqueous solution was added in its entirety to give $3\times10^{-4}$ mol per 1 mol of silver. The mixture was adjusted to the pH of 3.8 with 0.5 mol/L sulfuric acid. After stopping stirring, the mixture was subjected to precipitation/desalting/water washing steps. The mixture was adjusted to the pH of 5.9 with 1 mol/L sodium hydroxide to produce a silver halide dispersion having the pAg of 8.0.

The above-described silver halide dispersion was kept at 38° C. with stirring, and thereto was added 5 mL of a 0.34% by weight methanol solution of 1,2-benzisothiazoline-3-one, followed by elevating the temperature to 47° C. at 40 minutes thereafter. At 20 minutes after elevating the temperature, sodium benzene thiosulfonate in a methanol solution was added at $7.6\times10^{-5}$ mol per 1 mol of silver. At additional 5 minutes later, a tellurium sensitizer C in a methanol solution was added at $2.9\times10^{-4}$ mol per 1 mol of silver and subjected to ripening for 91 minutes. Thereafter, a methanol solution of a spectral sensitizing dye A and a spectral sensitizing dye B with a molar ratio of 3:1 was added thereto at 1.2×0-3 mol in total of the spectral sensitizing dye A and B per 1 mol of silver. At 1 minute later, 1.3 mL of a 0.8% by weight methanol solution of N,N'-dihydroxy-N",N"-diethylmelamine was added thereto, and at additional 4 minutes thereafter, 5-methyl-2-mercaptobenzimidazole in a methanol solution at $4.8\times10^{-3}$ mol per 1 mol of silver, 1-phenyl-2-heptyl-5-mercapto-1,3,4-triazole in a methanol solution at $5.4\times10^{-3}$ mol per 1 mol of silver, and 1-(3-methylureidophenyl)-5-mercaptotetrazole in an aqueous solution at $8.5\times10^{-3}$ mol per 1 mol of silver were added to produce a silver halide emulsion 1.

Grains in thus prepared silver halide emulsion were silver iodobromide grains having a mean equivalent spherical diameter of 0.042 μm, a variation coefficient of an equivalent spherical diameter distribution of 20%, which uniformly include iodine at 3.5 mol %. Grain size and the like were determined from the average of 1000 grains using an electron microscope. The {100} face ratio of these grains was found to be 80% using a Kubelka-Munk method.

<<Preparation of Silver Halide Emulsion 2>>

Preparation of silver halide dispersion 2 was conducted in a similar manner to the process in the preparation of the silver halide emulsion 1 except that: the temperature of the liquid upon the grain forming process was altered from 30° C. to 47° C.; the solution B was changed to that prepared through diluting 15.9 g of potassium bromide with distilled water to give the volume of 97.4 mL; the solution D was changed to that prepared through diluting 45.8 g of potassium bromide with distilled water to give the volume of 400 mL; time period for adding the solution C was changed to 30 minutes; and potassium hexacyanoferrate (II) was deleted; further the precipitation/desalting/water washing/dispersion were carried out similar to the silver halide emulsion 1. Furthermore, the spectral sensitization, chemical sensitization, and addition of 5-methyl-2-mercaptobenzimidazole and 1-phenyl-2-heptyl-5-mercapto-1,3,4-triazole were executed to the silver halide dispersion 2 similar to the silver halide emulsion 1 except that: the amount of the tellurium sensitizer C to be added was changed to $1.1\times10^{-4}$ mol per 1 mol of silver; the amount of the methanol solution of the spectral sensitizing dye A and a spectral sensitizing dye B with a molar ratio of 3:1 to be added was changed to $7.0\times10^{-4}$ mol in total of the spectral sensitizing dye A and the spectral sensitizing dye B per 1 mol of silver; the addition of 1-phenyl-2-heptyl-5-mercapto-1,3,4-triazole was changed to give $3.3\times10^{-3}$ mol per 1 mol of silver; and the addition of 1-(3-methylureidophenyl)-5-mercaptotetrazole was changed to give $4.7\times10^{-3}$ mol per 1 mol of silver, to produce silver halide emulsion 2. Grains in the silver halide emulsion 2 were cubic pure silver bromide grains having a mean equivalent spherical diameter of 0.080 μm and a variation coefficient of an equivalent spherical diameter distribution of 20%.

<<Preparation of Silver Halide Emulsion 3>>

Preparation of silver halide dispersion 3 was conducted in a similar manner to the process in the preparation of the silver halide emulsion 1 except that the temperature of the liquid upon the grain forming process was altered from 30° C. to 27° C., and in addition, the precipitation/desalting/water washing/dispersion were carried out similarly to the silver halide emulsion 1 Silver halide emulsion 3 was obtained similarly to the silver halide emulsion 1 except that: to the silver halide dispersion 3, the addition of the methanol solution of the spectral sensitizing dye A and the spectral sensitizing dye B was changed to the solid dispersion (aqueous gelatin solution) at a molar ratio of 1:1 with the amount to be added being $6\times10^{-3}$ mol in total of the spectral sensitizing dye A and spectral sensitizing dye B per 1 mol of silver; the addition amount of tellurium sensitizer C was changed to $5.2\times10^{-4}$ mol per 1 mol of silver; and bromoauric acid at $5\times10^{-4}$ mol per 1 mol of silver and potassium thiocyanate at $2\times10^{-3}$ mol per 1 mol of silver were added at 3 minutes following the addition of the tellurium sensitizer. Grains in the silver halide emulsion 3 were silver iodobromide grains having a mean equivalent spherical diameter of 0.034 μm and a variation coefficient of an equivalent spherical diameter distribution of 20%, which uniformly include iodine at 3.5 mol %.

<<Preparation of Mixed Emulsion A for Coating Solution>>

The silver halide emulsion 1 at 70% by weight, the silver halide emulsion 2 at 15% by weight, and the silver halide emulsion 3 at 15% by weight were dissolved, and thereto was added benzothiazolium iodide in a 1% by weight aqueous solution to give $7\times10^{-3}$ mol per 1 mol of silver. Further, water was added thereto to give the content of silver of 38.2 g per 1 kg of the mixed emulsion for a coating solution, and 1-(3-methylureidophenyl)-5-mercaptotetrazole was added to give 0.34 g per 1 kg of the mixed emulsion for a coating solution.

Further, as "a compound that is one-electron-oxidized to provide a one-electron oxidation product, which releases one or more electrons", the compounds Nos. 1, 2, and 3 were added respectively in an amount of $2\times10^{-3}$ mol per 1 mol of silver in silver halide.

2) Preparation of Dispersion of Silver Salt of Fatty Acid

<Preparation of Recrystallized Behenic Acid>

Behenic acid manufactured by Henkel Co. (trade name: Edenor C22-85R) in an amount of 100 kg was admixed with 1200 kg of isopropyl alcohol, and dissolved at 50° C. The mixture was filtrated through a 10 μm filter, and cooled to 30° C. to allow recrystallization. Cooling speed for the recrystallization was controlled to be 3° C./hour. The resulting crystal was subjected to centrifugal filtration, and washing was performed with 100 kg of isopropyl alcohol. Thereafter, the crystal was dried. The resulting crystal was esterified, and subjected to GC-FID analysis to give the results of the content of behenic acid being 96 mol %, lignoceric acid 2 mol %, and arachidic acid 2 mol %. In addition, erucic acid was included at 0.001 mol %.

<Preparation of Dispersion of Silver Salt of Fatty Acid>

88 kg of the recrystallized behenic acid, 422 L of distilled water, 49.2 L of 5 mol/L sodium hydroxide aqueous solution, and 120 L of t-butyl alcohol were admixed, and subjected to reaction with stirring at 75° C. for one hour to give a solution of sodium behenate. Separately, 206.2 L of an aqueous solution of 40.4 kg of silver nitrate (pH 4.0) was provided, and kept at a temperature of 10° C. A reaction vessel charged with 635 L of distilled water and 30 L of t-butyl alcohol was kept at 30° C., and thereto were added the total amount of the solution of sodium behenate and the total amount of the aqueous silver nitrate solution with sufficient stirring at a constant flow rate over 93 minutes and 15 seconds, and 90 minutes, respectively. Upon this operation, during first 11 minutes following the initiation of adding the aqueous silver nitrate solution, the added material was restricted to the aqueous silver nitrate solution alone. The addition of the solution of sodium behenate was thereafter started, and during 14 minutes and 15 seconds following the completion of adding the aqueous silver nitrate solution, the added material was restricted to the solution of sodium behenate alone. The temperature inside of the reaction vessel was then set to be 30° C., and the temperature outside was controlled so that the liquid temperature could be kept constant. In addition, the temperature of a pipeline for the addition system of the solution of sodium behenate was kept constant by circulation of warm water outside of a double wall pipe, so that the temperature of the liquid at an outlet in the leading edge of the nozzle for addition was adjusted to be 75° C. Further, the temperature of a pipeline for the addition system of the aqueous silver nitrate solution was kept constant by circulation of cool water outside of a double wall pipe. Position at which the solution of sodium behenate was added and the position, at which the aqueous silver nitrate solution was added, was arranged symmetrically with a shaft for stirring located at a center. Moreover, both of the positions were adjusted to avoid contact with the reaction liquid.

After completing the addition of the solution of sodium behenate, the mixture was left to stand at the temperature as it was for 20 minutes. The temperature of the mixture was then elevated to 35° C. over 30 minutes followed by ripening for 210 minutes. Immediately after completing the ripening, solid matters were filtered out with centrifugal filtration. The solid matters were washed with water until the electric conductivity of the filtrated water became 30 ES/cm. A silver salt of a fatty acid was thus obtained. The resulting solid matters were stored as a wet cake without drying.

When the shape of the resulting particles of the silver behenate was evaluated by an electron micrography, a crystal was revealed having a=0.21 μm, b=0.4 μm and c=0.4 μm on the average value, with a mean aspect ratio of 2.1, and a variation coefficient of an equivalent spherical diameter distribution of 11% (a, b and c are as defined aforementioned).

To the wet cake corresponding to 260 kg of a dry solid matter content, were added 19.3 kg of poly(vinyl alcohol) (trade name: PVA-217) and water to give the total amount of 1000 kg. Then, a slurry was obtained from the mixture using a dissolver blade. Additionally, the slurry was subjected to preliminary dispersion with a pipeline mixer (manufactured by MIZUHO Industrial Co., Ltd.: PM-10 type).

Next, a stock liquid after the preliminary dispersion was treated three times using a dispersing machine (trade name: Microfluidizer M-610, manufactured by Microfluidex International Corporation, using Z type Interaction Chamber) with the pressure controlled to be 1150 kg/cm$^2$ to give a dispersion of silver behenate. For the cooling manipulation, coiled heat exchangers were equipped in front of and behind the interaction chamber respectively, and accordingly, the temperature for the dispersion was set to be 18° C. by regulating the temperature of the cooling medium.

3) Preparations of Reducing Agent Dispersion

<<Preparation of Reducing Agent-1 Dispersion>>

To 10 kg of reducing agent-1 (2,2'-methylenebis-(4-ethyl-6-tert-butylphenol)) and 16 kg of a 10% by weight aqueous solution of modified poly(vinyl alcohol) (manufactured by Kuraray Co., Ltd., Poval MP203) was added 10 kg of water, and thoroughly mixed to give a slurry. This slurry was fed with a diaphragm pump, and was subjected to dispersion with a horizontal sand mill (UVM-2: manufactured by AIMEX Co., Ltd.) packed with zirconia beads having a mean particle diameter of 0.5 mm for 3 hours. Thereafter, 0.2 g of a benzisothiazolinone sodium salt and water were added thereto, thereby adjusting the concentration of the reducing agent to be 25% by weight. This dispersion was subjected to heat treatment at 60° C. for 5 hours to obtain reducing agent-1 dispersion.

Particles of the reducing agent included in the resulting reducing agent dispersion had a median diameter of 0.40 μm, and a maximum particle diameter of 1.4 μm or less. The resultant reducing agent dispersion was subjected to filtration with a polypropylene filter having a pore size of 3.0 μm to remove foreign substances such as dust, and stored.

<<Preparation of Reducing Agent-2 Dispersion>>

To 10 kg of reducing agent-2 (6,6'-di-t-butyl-4,4'-dimethyl-2,2'-butylidenediphenol)) and 16 kg of a 10% by weight aqueous solution of modified poly(vinyl alcohol) (manufactured by Kuraray Co., Ltd., Poval MP-203) was added 10 kg of water, and thoroughly mixed to give a slurry. This slurry was fed with a diaphragm pump, and was subjected to dispersion with a horizontal sand mill (UVM-2: manufactured by AIMEX Co., Ltd.) packed with zirconia beads having a mean particle diameter of 0.5 mm for 3 hours and 30 minutes. Thereafter, 0.2 g of a benzoisothiazolinone sodium salt and water were added thereto, thereby adjusting the concentration of the reducing agent to be 25% by weight. This dispersion was warmed at 40° C. for one hour, followed by a subsequent heat treatment at 80° C. for one hour to obtain reducing agent-2 dispersion. Particles of the reducing agent included in the resulting reducing agent dispersion had a median diameter of 0.50 μm, and a maximum particle diameter of 1.6 μm or less. The resultant reducing agent dispersion was subjected to filtration with a polypropylene filter having a pore size of 3.0 μm to remove foreign substances such as dust, and stored.

4) Preparation of Hydrogen Bonding Compound-1 Dispersion

To 10 kg of hydrogen bonding compound-1 (tri(4-t-butylphenyl)phosphineoxide) and 16 kg of a 10% by weight aqueous solution of modified poly(vinyl alcohol) (manufactured by Kuraray Co., Ltd., Poval MP203) was added 10 kg of water, and thoroughly mixed to give a slurry. This slurry was fed with a diaphragm pump, and was subjected to dispersion with a horizontal sand mill (UVM-2: manufactured by AIMEX Co., Ltd.) packed with zirconia beads having a mean particle diameter of 0.5 mm for 4 hours. Thereafter, 0.2 g of a benzisothiazolinone sodium salt and water were added thereto, thereby adjusting the concentration of the hydrogen bonding compound to be 25% by weight. This dispersion was warmed at 40° C. for one hour, followed by a subsequent heat treatment at 80° C. for one hour to obtain hydrogen bonding compound-1 dispersion. Particles of the hydrogen bonding compound included in the resulting hydrogen bonding compound dispersion had a median diameter of 0.45 μm, and a maximum particle diameter of 1.3 μm or less. The resultant hydrogen bonding compound dispersion was subjected to filtration with a polypropylene filter having a pore size of 3.0 μm to remove foreign substances such as dust, and stored.

5) Preparation of Development Accelerator-1 Dispersion

To 10 kg of development accelerator-1 and 20 kg of a 10% by weight aqueous solution of modified poly(vinyl alcohol) (manufactured by Kuraray Co., Ltd., Poval MP203) was added 10 kg of water, and thoroughly mixed to give a slurry. This slurry was fed with a diaphragm pump, and was subjected to dispersion with a horizontal sand mill (UVM-2: manufactured by AIMEX Co., Ltd.) packed with zirconia beads having a mean particle diameter of 0.5 mm for 3 hours and 30 minutes. Thereafter, 0.2 g of a benzisothiazolinone sodium salt and water were added thereto, thereby adjusting the concentration of the development accelerator to be 20% by weight. Accordingly, development accelerator-1 dispersion was obtained. Particles of the development accelerator included in the resultant development accelerator dispersion had a median diameter of 0.48 μm, and a maximum particle diameter of 1.4 μm or less. The resultant development accelerator dispersion was subjected to filtration with a polypropylene filter having a pore size of 3.0 μm to remove foreign substances such as dust, and stored.

6) Preparation of Development Accelerator-2 Dispersion

Also concerning solid dispersion of development accelerator-2, dispersion was executed similar to the development accelerator-1, and thus dispersion of 20% by weight was obtained.

7) Preparations of Organic Polyhalogen Compound Dispersion

<<Preparation of Organic Polyhalogen Compound-1 Dispersion>>

10 kg of organic polyhalogen compound-1 (tribromomethane sulfonylbenzene), 10 kg of a 20% by weight aqueous solution of modified poly(vinyl alcohol) (manufactured by Kuraray Co., Ltd., Poval MP203), 0.4 kg of a 20% by weight aqueous solution of sodium triisopropylnaphthalenesulfonate and 14 kg of water were thoroughly admixed to give a slurry. This slurry was fed with a diaphragm pump, and was subjected to dispersion with a horizontal sand mill (UVM-2: manufactured by AIMEX Co., Ltd.) packed with zirconia beads having a mean particle diameter of 0.5 mm for 5 hours. Thereafter, 0.2 g of a benzisothiazolinone sodium salt and water were added thereto, thereby adjusting the concentration of the organic polyhalogen compound to be 26% by weight. Accordingly, organic polyhalogen compound-1 dispersion was obtained.

Particles of the organic polyhalogen compound included in the resulting organic polyhalogen compound dispersion had a median diameter of 0.41 μm, and a maximum particle diameter of 2.0 μm or less. The resultant organic polyhalogen compound dispersion was subjected to filtration with a polypropylene filter having a pore size of 10.0 μm to remove foreign substances such as dust, and stored.

<<Preparation of Organic Polyhalogen Compound-2 Dispersion>>

10 kg of organic polyhalogen compound-2 (N-butyl-3-tribromomethane sulfonylbenzamide), 20 kg of a 10% by weight aqueous solution of modified poly(vinyl alcohol) (manufactured by Kuraray Co., Ltd., Poval MP203) and 0.4 kg of a 20% by weight aqueous solution of sodium triisopropylnaphthalenesulfonate were thoroughly admixed to give a slurry.

This slurry was fed with a diaphragm pump, and was subjected to dispersion with a horizontal sand mill (UVM-2: manufactured by AIMEX Co., Ltd.) packed with zirconia beads having a mean particle diameter of 0.5 mm for 5 hours. Thereafter, 0.2 g of a benzisothiazolinone sodium salt and water were added thereto, thereby adjusting the concentration of the organic polyhalogen compound to be 30% by weight. This dispersion was heated at 40° C. for 5 hours to obtain organic polyhalogen compound-2 dispersion. Particles of the organic polyhalogen compound included in the resulting organic polyhalogen compound dispersion had a median diameter of 0.40 μm, and a maximum particle diameter of 1.3 μm or less. The resultant organic polyhalogen compound dispersion was subjected to filtration with a polypropylene filter having a pore size of 3.0 μm to remove foreign substances such as dust, and stored.

8) Preparation of Phthalazine Compound-1 Solution

Modified poly(vinyl alcohol) MP-203 in an amount of 8 kg was dissolved in 174.57 kg of water, and then thereto were added 3.15 kg of a 20% by weight aqueous solution of sodium triisopropylnaphthalenesulfonate and 14.28 kg of a 70% by weight aqueous solution of phthalazine compound-1 (6-isopropyl phthalazine) to prepare a 5% by weight solution of phthalazine compound-1.

9) Preparations of Aqueous Solution of Mercapto Compound

<<Preparation of Aqueous Solution of Mercapto Compound-1>>

Mercapto compound-1 (1-(3-sulfophenyl)-5-mercaptotetrazole sodium salt) in an amount of 7 g was dissolved in 993 g of water to give a 0.7% by weight aqueous solution.

<<Preparation of Aqueous Solution of Mercapto Compound-2>>

Mercapto compound-2 (1-(3-methylureidophenyl)-5-mercaptotetrazole) in an amount of 20 g was dissolved in 980 g of water to give a 2.0% by weight aqueous solution.

10) Preparation of SBR Latex Liquid

SBR latex was prepared as follows.

To a polymerization vessel of a gas monomer reaction apparatus (manufactured by Taiatsu Techno Corporation, TAS-2J type) were charged 287 g of distilled water, 7.73 g of a surfactant (Pionin A-43-S (manufactured by TAKEMOTO OIL & FAT CO., LTD.): solid matter content of 48.5% by weight), 14.06 mL of 1 mol/L sodium hydroxide, 0.15 g of ethylenediamine tetraacetate tetrasodium salt, 255 g of styrene, 11.25 g of acrylic acid, and 3.0 g of tert-dodecyl mercaptan, followed by sealing of the reaction vessel and stirring at a stirring rate of 200 rpm.

Degassing was conducted with a vacuum pump, followed by repeating nitrogen gas replacement several times. Thereto was injected 108.75 g of 1,3-butadiene, and the inner temperature is elevated to 60° C. Thereto was added a solution of 1.875 g of ammonium persulfate dissolved in 50 mL of water, and the mixture was stirred for 5 hours as it stands. The temperature was further elevated to 90° C., followed by stirring for 3 hours. After completing the reaction, the inner temperature was lowered to reach to the room temperature, and thereafter the mixture was treated by adding 1 mol/L sodium hydroxide and ammonium hydroxide to give the molar ratio of $Na^+$ion:$NH_4^+$ ion=1:5.3, and thus, the pH of the mixture was adjusted to 8.4. Thereafter, filtration with a polypropylene filter having the pore size of 1.0 μm was conducted to remove foreign substances such as dust followed by storage. Accordingly, SBR latex was obtained in an amount of 774.7 g. Upon the measurement of halogen ion by ion chromatography, concentration of chloride ion was revealed to be 3 ppm. As a result of the measurement of the concentration of the chelating agent by high performance liquid chromatography, it was revealed to be 145 ppm.

The aforementioned latex had a mean particle diameter of 90 nm, Tg of 17° C., a solid matter concentration of 44% by weight, an equilibrium moisture content at 25° C. and 60% RH of 0.6% by weight, and an ionic conductance of 4.80 mS/cm (measurement of the ionic conductance was performed using a conductivity meter CM-30S manufactured by Toa Electronics Ltd. for the latex stock solution (44% by weight) at 25° C.).

11) Preparations of Dye Dispersion and Pigment Dispersion

<<Preparation of Comparative Pigment Dispersion>>

C.I. Pigment Violet 37 (maximum absorption wavelength: 564 nm) disclosed in JP-A No. 10-268465 was dispersed according to the method described in the same specification.

<<Preparation of Comparative Fine Particle Solid Dye Dispersion>>

Anthraquinone dye B-3 disclosed in JP-A No. 2000-39685 was dispersed according to the method described in the same specification.

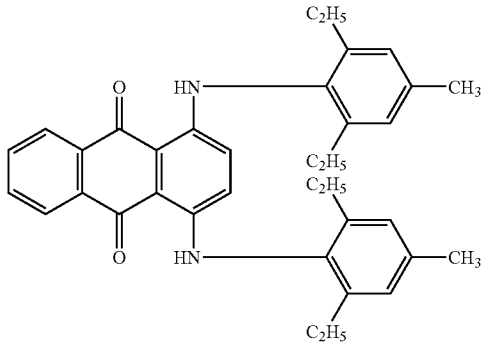

<<Preparation of Aqueous Solution of Comparative Dye D-1>>

1 g of the water-soluble azomethine dye D-1 described below was dissolved in water to make a 1% by weight aqueous solution.

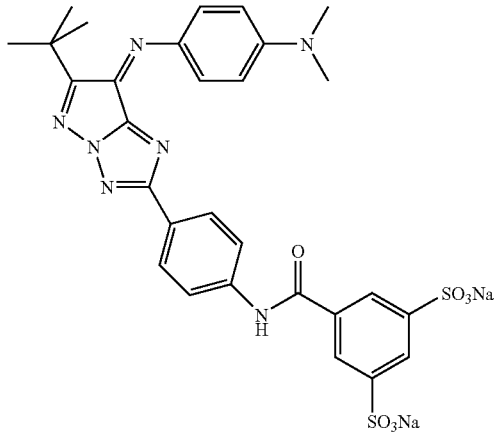

<<Preparation of Solid Dispersion of Azomethine Dye of the Invention>>

To the water-insoluble azomethine dye, the illustrated compound (27) described above in an amount of 10 kg and 20 kg of a 10% by weight aqueous solution of modified poly(vinyl alcohol) (manufactured by Kuraray Co., Ltd., Poval MP203) were added 0.17 kg of a surfactant (Pionin A-43-S (manufactured by TAKEMOTO OIL & FAT CO., LTD.): solid matter content of 48% by weight), 20 g of an antifoaming agent (trade name: SURFYNOL 104E, manufactured by Nissin Chemical Industry Co., Ltd.), and thoroughly mixed to give a slurry.

This slurry was fed with a diaphragm pump, and was subjected to dispersion with a horizontal sand mill (UVM-2: manufactured by AIMEX Co., Ltd.) packed with zirconia beads having a mean particle diameter of 0.5 mm for 5 hours. Thereafter, 0.2 g of a benzisothiazolinone sodium salt and water were added thereto, thereby adjusting the concentration of the water-insoluble azomethine dye to be 20% by weight. This dispersion was heated at 40° C. for 3 hours to obtain azomethine-27 dispersion. Particles of the azomethine dye included in the resultant azomethine dye dispersion had a median diameter of 0.55 μm, and a maximum particle diameter of 1.8 μm or less. The resultant azomethine dye dispersion was subjected to filtration with a polypropylene filter having a pore size of 3.0 μm to remove foreign substances such as dust, and stored.

2. Preparations of Coating Solution

1) Preparation of Coating Solution for Image Forming Layer

To the dispersion of the silver salt of fatty acid obtained as described above in an amount of 1000 g were serially added water, the dispersion of pigment or the dispersion of dye (shown in Table 1), the organic polyhalogen compound-1 dispersion, the organic polyhalogen compound-2 dispersion, the phthalazine compound-1 solution, the SBR latex (Tg: 17° C.) liquid, the reducing agent-1 dispersion, the reducing agent-2 dispersion, the hydrogen bonding compound-1 dispersion, the development accelerator-1 dispersion, the development accelerator-2 dispersion, the mercapto compound-1 aqueous solution, and the mercapto compound-2 aqueous solution. The coating solution for the image forming layer prepared by adding the mixed emulsion A for coating solution thereto followed by thorough mixing just prior to the coating was fed directly to a coating die.

2) Preparation of Coating Solution for Intermediate Layer

To 1000 g of poly(vinyl alcohol) PVA-205 (manufactured by Kuraray Co., Ltd.), 27 mL of a 5% by weight aqueous solution of sodium di(2-ethylhexyl)sulfosuccinate, and 4200 mL of a 19% by weight liquid of methyl methacrylate/styrene/butyl acrylate/hydroxyethyl methacrylate/acrylic acid copolymer (mass ratio of the copolymerization of 57/8/28/5/2) latex, 27 mL of a 5% by weight aqueous solution of aerosol OT (manufactured by American Cyanamid Co.), 135 mL of a 20% by weight aqueous solution of diammonium phthalate was added water to give a total amount of 10000 g. The mixture was adjusted with sodium hydroxide to give the pH of 7.5. Accordingly, the coating solution for the intermediate layer was prepared, and was fed to a coating die to provide 8.9 mL/$m^2$.

Viscosity of the coating solution was 58 [mPa·s] which was measured with a B type viscometer at 40° C. (No. 1 rotor, 60 rpm).

3) Preparation of Coating Solution for First Layer of Surface Protective Layers

In 840 mL of water were dissolved 100 g of inert gelatin and 10 mg of benzoisothiazolinone, and thereto were added 180 g of a 19% by weight liquid of methyl methacrylate/styrene/butyl acrylate/hydroxyethyl methacrylate/acrylic acid copolymer (mass ratio of the copolymerization of 57/8/28/5/2) latex, 46 mL of a 15% by weight methanol solution of phthalic acid, and 5.4 mL of a 5% by weight aqueous solution of sodium di(2-ethylhexyl)sulfosuccinate, and were mixed. Immediately before coating, 40 mL of a 4% by weight chrome alum which had been mixed with a static mixer was fed to a coating die so that the amount of the coating solution became 26.1 mL/$m^2$.

Viscosity of the coating solution was 20 [mPa·s] which was measured with a B type viscometer at 40° C. (No. 1 rotor, 60 rpm).

4) Preparation of Coating Solution for Second Layer of Surface Protective Layers In 800 mL of water were dissolved 100 g of inert gelatin and 10 mg of benzoisothiazolinone, and thereto were added liquid paraffin emulsion at 8.0 g equivalent to liquid paraffin, 180 g of a 19% by weight liquid of methyl methacrylate/styrene/butyl acrylate/hydroxyethyl methacrylate/acrylic acid copolymer (mass ratio of the copolymerization of 57/8/28/5/2) latex, 40 mL of a 15% by weight methanol solution of phthalic acid, 5.5 mL of a 1% by weight solution of a fluorocarbon surfactant (F-1), 5.5 mL of a 1% by weight aqueous solution of another fluorocarbon surfactant (F-2), 28 mL of a 5% by weight aqueous solution of sodium di(2-ethylhexyl)sulfosuccinate, 4 g of poly(methyl methacrylate) fine particles (mean particle diameter of 0.7 μm), and 21 g of poly(methyl methacrylate) fine particles (mean particle diameter of 4.5 μm), and the obtained mixture was mixed to give a coating solution for the surface protective layer, which was fed to a coating die so that 8.3 mL/$m^2$ could be provided.

Viscosity of the coating solution was 19 [mPa·s] which was measured with a B type viscometer at 40° C. (No. 1 rotor, 60 rpm).

3. Preparations of Photothermographic Material

1) Preparations of Photothermographic Material-101 to -115

Reverse surface of the back surface was subjected to simultaneous overlaying coating by a slide bead coating method in order of coating solution for the image forming layer, the coating solution for intermediate layer, the coating solution for the first layer of the surface protective layers, and the coating solution for the second layer of the surface protective layers, starting from the undercoated face, and thus sample of photothermographic material was produced.

The combination of formulae for the back layer and image forming layer is shown in Table 1. In this method, the temperature of the coating solution was adjusted to 31° C. for the image forming layer and intermediate layer, to 36° C. for the first layer of the surface protective layers, and to 37° C. for the second layer of the surface protective layers.

The coating amount of each compound (g/m 2) for the image forming layer is as follows.

| | |
|---|---|
| Silver salt of fatty acid | 5.42 |
| Pigment or dye | (see Table 1) |
| Organic polyhalogen compound-1 | 0.12 |
| Organic polyhalogen compound-2 | 0.25 |
| Phthalazine compound-1 | 0.18 |
| SBR latex | 9.70 |
| Reducing agent-1 | 0.40 |
| Reducing agent-2 | 0.40 |
| Hydrogen bonding compound-1 | 0.58 |
| Development accelerator-1 | 0.019 |
| Development accelerator-2 | 0.016 |
| Mercapto compound-1 | 0.002 |
| Mercapto compound-2 | 0.012 |
| Silver halide (on the basis of Ag content) | 0.10 |

Conditions for coating and drying are as follows.

Coating was performed at the speed of 160 m/min. The clearance between the leading end of the coating die and the support was from 0.10 mm to 0.30 mm. The pressure in the vacuum chamber was set to be lower than atmospheric pressure by 196 Pa to 882 Pa. The support was decharged by ionic wind.

In the subsequent cooling zone, the coating solution was cooled by wind having the dry-bulb temperature of from 10° C. to 20° C. Transportation with no contact was carried out, and the coated support was dried with an air of the dry-bulb of from 23° C. to 45° C. and the wet-bulb of from 15° C. to 21° C. in a helical type contactless drying apparatus.

After drying, moisture conditioning was performed at 25° C. in the humidity of from 40% RH to 60% RH. Then, the film surface was heated to be from 70° C. to 90° C., and after heating, the film surface was cooled to 25° C.

TABLE 1

| | Back Layer | | | | | | Dye included in Image Forming Layer | | | | |
|---|---|---|---|---|---|---|---|---|---|---|---|
| Sample No. | No. | Adding Method | Dye | Addition Amount (mg/$m^2$) | Spectral Light Absorption Maximum (nm) | Half Band Width (nm) | No. | Adding Method | Dye | Addition Amount (mg/$m^2$) | Note |
| 101 | 1 | Aqueous solution | K.T.RN | 76 | 612 | 102 | 1 | Pigment | PV37 | 60 | Comparative |
| 102 | 1 | Aqueous solution | K.T.RN | 76 | — | — | 2 | Solid dispersion | B-3 | 35 | Comparative |
| 103 | 2 | Pigment | PB60 | 76 | 617 | 158 | 2 | Solid dispersion | B-3 | 35 | Comparative |
| 104 | 3 | Emulsion | Oil-soluble(2) | 50 | 661 | 36 | 3 | Solid dispersion | Azomethine 27 | 10 | Invention |
| 105 | 4 | Solid dispersion | Oil-soluble(9) | 50 | 668 | 48 | 3 | Solid dispersion | Azomethine 27 | 10 | Invention |

TABLE 1-continued

| | Back Layer | | | | | | Dye included in Image Forming Layer | | | | |
|---|---|---|---|---|---|---|---|---|---|---|---|
| Sample No. | No. | Adding Method | Dye | Addition Amount ($mg/m^2$) | Spectral Light Absorption Maximum (nm) | Half Band Width (nm) | No. | Adding Method | Dye | Addition Amount ($mg/m^2$) | Note |
| 106 | 5 | Aqueous solution | Water-soluble No. 11 | 50 | 665 | 33 | 3 | Solid dispersion | Azomethine 27 | 10 | Invention |
| 107 | 5 | Aqueous solution | Water-soluble No. 11 | 50 | — | — | 4 | Solid dispersion | Comparative D-1 | 10 | Comparative |
| 108 | 5 | Aqueous solution | Water-soluble No. 11 | 50 | — | — | 5 | Solid dispersion | Azomethine 3 | 10 | Invention |
| 109 | 5 | Aqueous solution | Water-soluble No. 11 | 50 | — | — | 6 | Solid dispersion | Azomethine 5 | 10 | Invention |
| 110 | 5 | Aqueous solution | Water-soluble No. 11 | 50 | — | — | 7 | Solid dispersion | Azomethine 13 | 10 | Invention |
| 111 | 5 | Aqueous solution | Water-soluble No. 11 | 50 | — | — | 8 | Solid dispersion | Azomethine 14 | 10 | Invention |
| 112 | 5 | Aqueous solution | Water-soluble No. 11 | 50 | — | — | 9 | Solid dispersion | Azomethine 26 | 10 | Invention |
| 113 | 5 | Aqueous solution | Water-soluble No. 11 | 50 | — | — | 8 | Solid dispersion | Azomethine 32 | 10 | Invention |
| 114 | 5 | Aqueous solution | Water-soluble No. 32 | 50 | 667 | 38 | 8 | Solid dispersion | Azomethine 32 | 10 | Invention |
| 115 | 5 | Aqueous solution | Water-soluble No. 91 | 50 | 660 | 55 | 8 | Solid dispersion | Azomethine 32 | 10 | Invention |

Thus prepared photothermographic material had a level of matting of 550 seconds on the image forming layer side, and 130 seconds on the back surface as Beck's smoothness. In addition, measurement of pH of the film surface on the image forming layer side gave the result of 6.0.

Chemical structures of the compounds used in Examples of the invention are shown below.

Spectal sensitizing dye A

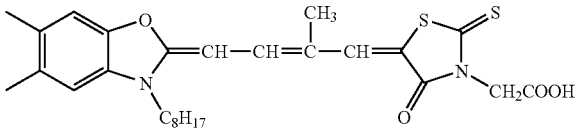

Spectral sensitizung dye B

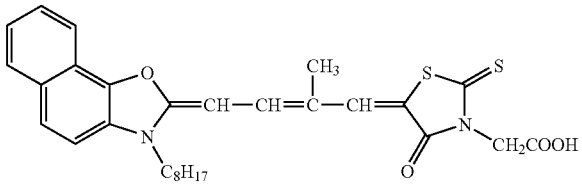

Tellurium sensitizer C

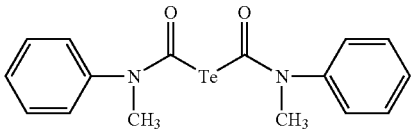

Compound 1 that is one-electron-oxidized to provide a one-electron oxidation product which releases one or more electrons

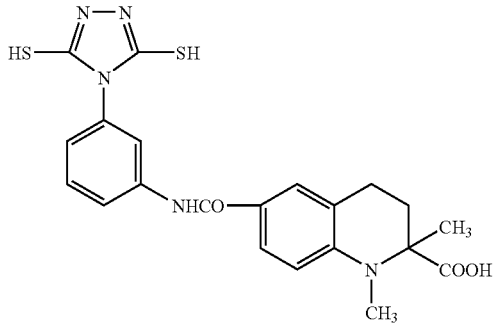

Compound 2 that is one-electron-oxidized to provide a one-electron oxidation product which releases one or more electrons

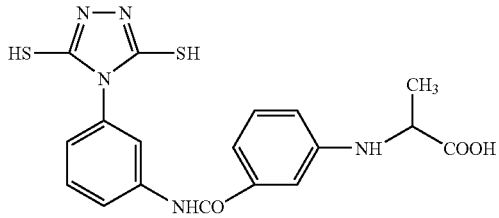

Compound 3 that is one-electron-oxidized to provide a one-electron oxidation product which releases one or more electrons

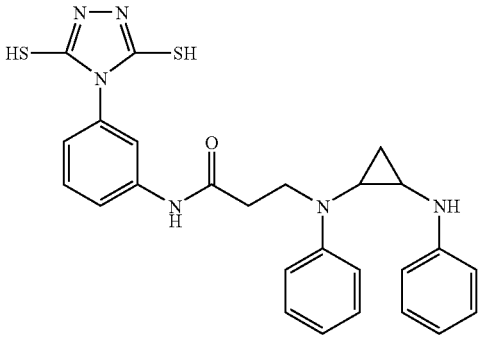

Reducing agent-1

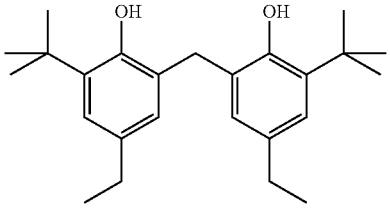

Reducing agent-2

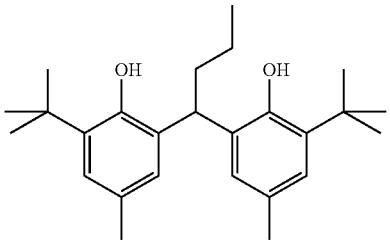

Hydrogen bonding compound-1

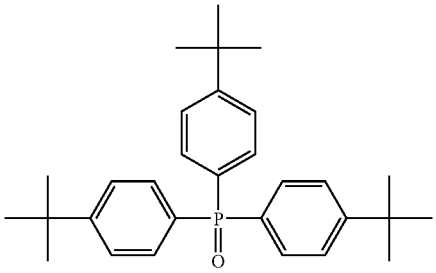

Organic polyhalogen compound-1

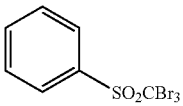

Organic polyhalogen compound-2

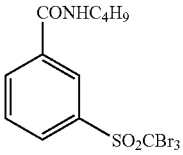

-continued

Mercapto compound-1

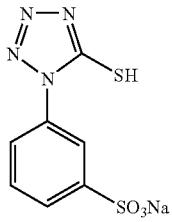

Mercapto compound-2

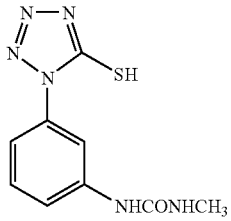

Phthalazine compound-1

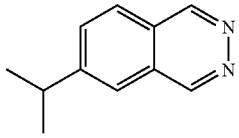

Development accelerator-1

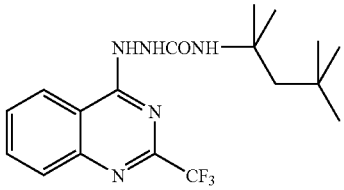

Development accelerator-2

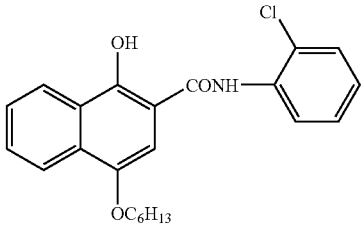

(F-1)

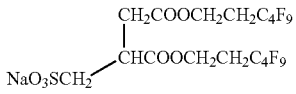

(F-2)

Mixture of

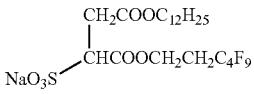

and

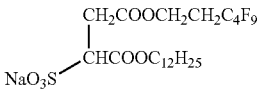

4. Evaluation of Photographic Properties

1) Preparation

The obtained sample was cut into a half-cut size, and was wrapped with the following packaging material under an environment of 25° C. and 50% RH, and stored for 2 weeks at an ambient temperature.

<Packaging Material>

A film laminated with PET 10 μm/PE 12 μm/aluminum foil 9 μm/Ny 15 μm/polyethylene 50 μm containing carbon at 3% by weight:

oxygen permeability at 25° C.: 0.02 $mL \cdot atm^{-1} m^{-2} day^{-1}$;

vapor permeability at 25° C.: 0.10 $g \cdot atm^{-1} m^{-2} day^{-1}$.

2) Exposure and Thermal Development

To each sample, exposure and thermal development (14 seconds in total with 3 panel heaters set to 107° C.-121° C.-121° C.) with Fuji Medical Dry Laser Imager DRYPIX 7000 (equipped with 660 nm laser diode having a maximum output of 50 mW (IIIB)) were performed. Evaluation on the obtained image was performed with a densitometer.

3) Evaluation of Performance

<<Evaluation of Photographic Properties>>

The photothermographic material prepared above was subjected to exposure by changing the exposure value of a laser beam step by step. The density of the image obtained after development was measured by a Macbeth densitometer. A photographic characteristic curve was prepared by plotting the density against the exposure value.

<Fog>

With regard to the samples after development, the density of the portion unexposed by a laser beam is defined as fog.

<Sensitivity>

Sensitivity is the inverse of the exposure value giving an image density of fog+1.0. The sensitivities are shown in relative value, detecting the sensitivity of sample No. 101 to be 100.

<Sharpness>

Sharpness is expressed by a relative value taken as 100 for the value obtained for the portion having a density of 1.2 and a width of 5 mm, where the sample was subjected to exposure to give a density of 1.2 and a width of 0.5 mm and then the width of the portion having a density of fog+0.1 or more was measured by a micro-densitometer with an aperture diameter of 50 μm.

<Image Tone>

With regard to the samples after developing process, the coloring of the unexposed part was evaluated by visual observation and classified into five sensory evaluation criteria as follows, [5]: excellent level, [1]: unacceptable level for practical use, and [3]: allowable level for practical use.

<<Image stability>>

<Light Stability (Stored Under Fluorescent Lamp)>

The unexposed samples were subjected to thermal development similar to the evaluation on photographic properties. The obtained samples were stored under an illumination condition of 8,500 lux of fluorescent lamp for one day. Thereafter, changes in image tone were evaluated and ranked into five levels. Level 5 represents no changes in image tone before and after exposure to the fluorescent lamp. Level 1 represents remarkable changes in image tone and not allowable level for practical use.

<Dark and Thermal Image Stability>

The unexposed samples were subjected to thermal development similar to the evaluation on photographic properties. The obtained samples were stored under an environmental condition of 50° C. and 60% relative humidity for 3 days. Thereafter, changes in image tone before and after the storage were evaluated and ranked into the five levels similar to the above.

The obtained results are shown in Table 2.

Comparative samples Nos. 101 to 103 exhibit an inferior degree of sharpness and unfavorable image tone. Moreover, comparative sample No. 107 exhibits inferior dye stability due to light exposure. On the other hand, samples of the present invention present no problem in fog and sensitivity, and exhibit excellent performances in sharpness, image color tone, and storability.

Especially, the samples containing a dye, which has an absorption maximum accorded with the wavelength region of the exposure and a sharp absorption with a narrow band width, exhibit excellent performances.

Among the samples of the present invention, the sample Nos. 104 to 106, and 110 to 115, which contain azomethine dye Nos. 13, 14, 26, 27, or 32, exhibit particularly excellent performances.

TABLE 2

| | Photographic Properties | | | | Image Storability | | |
|---|---|---|---|---|---|---|---|
| | | | | | Stored under | | |
| Sample No. | Fog | Sensitivity | Sharpness | Image Tone | Fluorescent Lamp | Stored in Dark Place | Note |
| 101 | 0.19 | 100 | 89 | 3 | 5 | 5 | Comparative |
| 102 | 0.21 | 98 | 90 | 3 | 5 | 5 | Comparative |
| 103 | 0.23 | 102 | 92 | 3 | 5 | 5 | Comparative |
| 104 | 0.16 | 105 | 95 | 5 | 5 | 5 | Invention |
| 105 | 0.16 | 105 | 95 | 5 | 5 | 5 | Invention |
| 106 | 0.16 | 105 | 95 | 5 | 5 | 5 | Invention |
| 107 | 0.16 | 105 | 95 | 5 | 3 | 4 | Comparative |
| 108 | 0.16 | 105 | 95 | 4 | 4 | 5 | Invention |
| 109 | 0.16 | 105 | 95 | 4 | 4 | 5 | Invention |
| 110 | 0.16 | 105 | 95 | 5 | 5 | 5 | Invention |
| 111 | 0.16 | 105 | 95 | 5 | 5 | 5 | Invention |
| 112 | 0.16 | 105 | 95 | 5 | 5 | 5 | Invention |
| 113 | 0.16 | 105 | 95 | 5 | 5 | 5 | Invention |
| 114 | 0.16 | 105 | 95 | 5 | 5 | 5 | Invention |
| 115 | 0.17 | 105 | 94 | 5 | 5 | 5 | Invention |

Example 2

Sample Nos. 201 to 221 were prepared similar to Example 1, except that, in addition to the dyes added into the back layer and the layer on the image forming layer side, the metal phthalocyanine dye of the present invention or the like was added in the layer on the image forming layer side, as shown in Table 3.

Thus prepared samples were evaluated similar to Example 1. However, concerning image tone, image tones of both unexposed but processed portion with no silver image and the portion where silver image was formed were evaluated.

TABLE 3

| | Back Layer | | | Layer in which Dye is added ① | | | | Layer in which Dye is added ② | | | | |
|---|---|---|---|---|---|---|---|---|---|---|---|---|
| Sample No. | Adding Method | Dye | Addition Amount (mg/m$^2$) | Layer to be added | Adding Method | Dye | Addition Amount (mg/m$^2$) | Layer to be added | Adding Method | Dye | Addition Amount (mg/m$^2$) | Note |
| 201 | Aqueous Solution | K.T.RN | 76 | Image forming layer | Pigment | PV37 | 60 | — | — | — | — | Comparative |
| 202 | Aqueous Solution | K.T.RN | 76 | Image forming layer | Pigment | PV37 | 60 | Image forming layer | Aqueous solution | K.T.RN | 30 | Comparative |
| 203 | Aqueous Solution | K.T.RN | 46 | Image forming layer | Pigment | PV37 | 60 | Image forming layer | Aqueous solution | K.T.RN | 30 | Comparative |
| 204 | Aqueous Solution | K.T.RN | 76 | Image forming layer | Solid dispersion | B-3 | 35 | Image forming layer | Aqueous solution | K.T.RN | 30 | Comparative |
| 205 | Pigment | PB60 | 76 | Image forming layer | Solid dispersion | B-3 | 35 | Image forming layer | Pigment | PB60 | 30 | Comparative |
| 206 | Emulsion | Oil-soluble(2) | 50 | Image forming layer | Solid dispersion | Azomethine 27 | 10 | First layer of surface protective layers | Emulsion | Oil-soluble(2) | 20 | Invention |
| 207 | Solid dispersion | Oil-soluble(9) | 50 | Image forming layer | Solid dispersion | Azomethine 27 | 10 | Intermediate layer | Solid dispersion | Oil-soluble(9) | 20 | Invention |
| 208 | Solid dispersion | Oil-soluble(9) | 50 | Image forming layer | Solid dispersion | Azomethine 27 | 10 | Image forming layer | Solid dispersion | Oil-soluble(9) | 20 | Invention |
| 209 | Aqueous Solution | Water-soluble No. 11 | 50 | Image forming layer | Solid dispersion | Azomethine 27 | 10 | — | — | — | — | Invention |
| 210 | Aqueous Solution | Water-soluble No. 11 | 50 | Image forming layer | Solid dispersion | Azomethine 27 | 10 | Image forming layer | Aqueous solution | Water-soluble No. 11 | 20 | Invention |
| 211 | Aqueous Solution | Water-soluble No. 11 | 50 | Image forming layer | Solid dispersion | Azomethine 27 | 10 | Image forming layer | Aqueous solution | Water-soluble No. 11 | 20 | Invention |
| 212 | Aqueous Solution | Water-soluble No. 11 | 50 | Image forming layer | Solid dispersion | Azomethine 27 | 10 | Intermediate layer | Aqueous solution | Water-soluble No. 11 | 20 | Invention |
| 213 | Aqueous Solution | Water-soluble No. 11 | 50 | Image forming layer | Solid dispersion | Azomethine 27 | 10 | First layer of surface protective layers | Aqueous solution | Water-soluble No. 11 | 20 | Invention |
| 214 | Aqueous Solution | Water-soluble No. 11 | 50 | Image forming layer | Aqueous solution | Comparative D-1 | 10 | Image forming layer | Aqueous solution | Water-soluble No. 11 | 20 | Comparative |
| 215 | Aqueous Solution | Water-soluble No. 11 | 50 | Image forming layer | Solid dispersion | Azomethine 3 | 10 | Image forming layer | Aqueous solution | Water-soluble No. 11 | 20 | Invention |
| 216 | Aqueous Solution | Water-soluble No. 11 | 50 | Image forming layer | Solid dispersion | Azomethine 5 | 10 | Image forming layer | Aqueous solution | Water-soluble No. 11 | 20 | Invention |
| 217 | Aqueous Solution | Water-soluble No. 11 | 50 | Image forming layer | Solid dispersion | Azomethine 13 | 10 | Image forming layer | Aqueous solution | Water-soluble No. 11 | 20 | Invention |

TABLE 3-continued

| | Back Layer | | | Layer in which Dye is added ① | | | | Layer in which Dye is added ② | | | | |
|---|---|---|---|---|---|---|---|---|---|---|---|---|
| Sample No. | Adding Method | Dye | Addition Amount ($mg/m^2$) | Layer to be added | Adding Method | Dye | Addition Amount ($mg/m^2$) | Layer to be added | Adding Method | Dye | Addition Amount ($mg/m^2$) | Note |
| 218 | Aqueous Solution | Water-soluble No. 11 | 50 | Image forming layer | Solid dispersion | Azomethine 14 | 10 | Image forming layer | Aqueous solution | Water-soluble No. 11 | 20 | Invention |
| 219 | Aqueous Solution | Water-soluble No. 11 | 50 | Image forming layer | Solid dispersion | Azomethine 26 | 10 | Image forming layer | Aqueous solution | Water-soluble No. 11 | 20 | Invention |
| 220 | Aqueous Solution | Water-soluble No. 11 | 50 | Image forming layer | Solid dispersion | Azomethine 32 | 10 | Image forming layer | Aqueous solution | Water-soluble No. 11 | 20 | Invention |
| 221 | Aqueous Solution | Water-soluble No. 32 | 50 | Image forming layer | Solid dispersion | Azomethine 32 | 10 | Image forming layer | Aqueous solution | Water-soluble No. 32 | 20 | Invention |
| 222 | Aqueous Solution | Water-soluble No. 91 | 50 | Image forming layer | Solid dispersion | Azomethine 32 | 10 | Image forming layer | Aqueous solution | Water-soluble No. 91 | 20 | Invention |

The obtained results are shown in Table 4.

Comparative samples Nos. 201 to 205 exhibit high fog and unfavorable image tone. By adding the same dye as the one added in the back layer to the layer on the image forming layer side, sharpness is improved a little but is not sufficient.

Moreover, comparative sample No. 214 exhibits inferior image storability, and particularly, inferior dye stability due to light exposure.

Among the samples of the present invention, the samples in which the metal phthalocyanine dye of the present invention is used also in the layer on the image forming layer side exhibit more preferable performances such as low fog and excellent sharpness.

TABLE 4

| | Photographic Properties | | | | | Image Storability | | |
|---|---|---|---|---|---|---|---|---|
| Sample No. | Fog | Sensitivity | Sharpness | Image Tone of Unexposed but Processed Portion | Image Tone of Silver Image Portion | Stored under Fluorescent Lamp | Stored in Dark Place | Note |
| 201 | 0.19 | 100 | 89 | 3 | 3 | 5 | 5 | Comparative |
| 202 | 0.21 | 63 | 92 | 2 | 3 | 5 | 5 | Comparative |
| 203 | 0.19 | 65 | 90 | 3 | 3 | 5 | 5 | Comparative |
| 204 | 0.24 | 60 | 92 | 2 | 3 | 5 | 5 | Comparative |
| 205 | 0.26 | 56 | 94 | 2 | 3 | 5 | 5 | Comparative |
| 206 | 0.18 | 66 | 96 | 5 | 5 | 5 | 5 | Invention |
| 207 | 0.18 | 66 | 97 | 5 | 5 | 5 | 5 | Invention |
| 208 | 0.18 | 66 | 98 | 5 | 5 | 5 | 5 | Invention |
| 209 | 0.16 | 102 | 95 | 5 | 5 | 5 | 5 | Invention |
| 210 | 0.18 | 66 | 98 | 5 | 5 | 5 | 5 | Invention |
| 211 | 0.16 | 66 | 97 | 5 | 5 | 5 | 5 | Invention |
| 212 | 0.18 | 66 | 98 | 5 | 5 | 5 | 5 | Invention |
| 213 | 0.18 | 66 | 97 | 5 | 5 | 5 | 5 | Invention |
| 214 | 0.18 | 66 | 98 | 4 | 5 | 3 | 4 | Comparative |
| 215 | 0.18 | 66 | 98 | 4 | 4 | 4 | 5 | Invention |
| 216 | 0.18 | 66 | 98 | 4 | 4 | 4 | 5 | Invention |
| 217 | 0.18 | 66 | 98 | 5 | 5 | 5 | 5 | Invention |
| 218 | 0.18 | 66 | 98 | 5 | 5 | 5 | 5 | Invention |
| 219 | 0.18 | 66 | 98 | 5 | 5 | 5 | 5 | Invention |
| 220 | 0.18 | 66 | 98 | 5 | 5 | 5 | 5 | Invention |
| 221 | 0.18 | 66 | 98 | 5 | 5 | 5 | 5 | Invention |
| 222 | 0.18 | 66 | 98 | 5 | 5 | 5 | 5 | Invention |

What is claimed is:

1. A photothermographic material comprising, on at least one side of a support, an image forming layer comprising at least a photosensitive silver halide, a non-photosensitive organic silver salt, a reducing agent, and a binder, and at least one non-photosensitive layer, wherein the photothermographic material contains a water-insoluble azomethine dye in the form of a solid fine particle dispersion and a metal phthalocyanine dye represented by formula (PC-1):

Formula (PC-1)

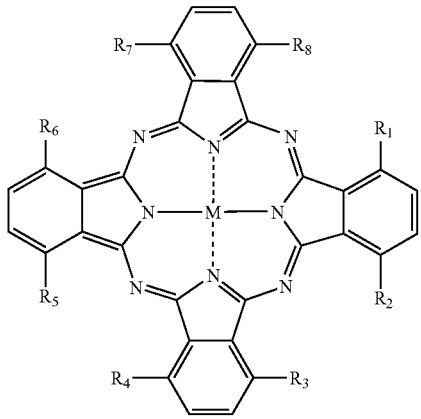

wherein M represents a metal atom; $R_1$, $R_2$, $R_3$, $R_4$, $R_5$, $R_6$, $R_7$, and $R_8$ each independently represent a hydrogen atom or a substituent; and at least one of $R_1$, $R_2$, $R_3$, $R_4$, $R_5$, $R_6$, $R_7$, and $R_8$ is an electron-attracting group.

2. The photothermographic material according to claim 1, wherein the electron-attracting group of at least one of $R_1$, $R_2$, $R_3$, $R_4$, $R_5$, $R_6$, $R_7$, and $R_8$ in formula (PC-1) is a group represented by the following formula (PC-II):

$$—L^1—R^{17}$$ Formula (PC-II)

wherein $L^1$ represents **—$SO_2$—*, **—$SO_3$—*, **—$SO_2NR_N$—*, **—SO—*, **—CO—*, **—$CONR_N$—*, **—COO—*, **—COCO—*, **—$COCO_2$—*, or **—$COCONR_N$—*; ** denotes a bond with a phthalocyanine skeleton at this position; * denotes a bond with $R^{17}$ at this position; $R_N$ represents a hydrogen atom, an alkyl group, an aryl group, a heterocyclic group, an acyl group, an alkoxycarbonyl group, a carbamoyl group, a sulfonyl group, or a sulfamoyl group; and $R^{17}$ represents a hydrogen atom, an alkyl group, an aryl group, or a heterocyclic group.

3. The photothermographic material according to claim 2, wherein four or more from among $R_1$, $R_2$, $R_3$, $R_4$, $R_5$, $R_6$, $R_7$, and $R_8$ are groups represented by formula (PC-II).

4. The photothermographic material according to claim 2, wherein the at least one group represented by formula (PC-II) includes at least one water-soluble group.

5. The photothermographic material according to claim 2, wherein the at least one group represented by formula (PC-II) includes at least one oil-soluble group.

6. The photothermographic material according to claim 5, wherein the metal phthalocyanine dye is contained in the form of a solid fine particle dispersion.

7. The photothermographic material according to claim 1, wherein the water-insoluble azomethine dye is a compound represented by the following formula (I):

Formula (I)

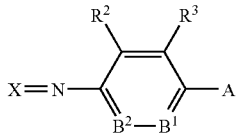

wherein X represents a residual of a color photographic coupler; A represents-$NR^4R^5$ or a hydroxy group; $R^4$ and $R^5$ each independently represent a hydrogen atom, an aliphatic group, an aromatic group, or a heterocyclic group; $B^1$ represents =$C(R^6)$— or =N—; $B^2$ represents —$C(R^7)$= or —N=; $R^2$, $R^3$, $R^6$, and $R^7$ each independently represent a hydrogen atom, a halogen atom, an aliphatic group, an aromatic group, a heterocyclic group, a cyano group, —$OR^{51}$, —$SR^{52}$, —$CO_2R^{53}$, —$OCOR^{54}$, —$NR^{55}R^{56}$, —$CONR^{57}R^{58}$, —$SO_2R^{59}$, —$SO_2NR^{60}R^{61}$, —$NR^{62}CONR^{63}R^{64}$, —$NR^{65}CO_2R^{66}$, —$COR^{67}$, —$NR^{68}COR^{69}$, or —$NR^{70}SO_2R^{71}$; and $R^{51}$, $R^{52}$, $R^{53}$, $R^{54}$, $R^{55}$, $R^{56}$, $R^{57}$, $R^{58}$, $R^{59}$, $R^{60}$, $R^{61}$, $R^{62}$, $R^{63}$, $R^{64}$, $R^{65}$, $R^{66}$, $R^{67}$, $R^{68}$, $R^{69}$, $R^{70}$, and $R^{71}$ each independently represent a hydrogen atom, an aliphatic group, or an aromatic group.

8. The photothermographic material according to claim 7, wherein the water-insoluble azomethine dye is a compound represented by the following formula (II):

Formula (II)

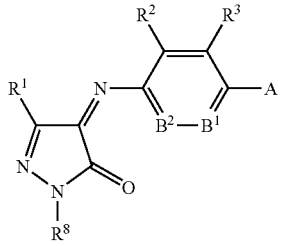

wherein $R^1$ represents a halogen atom, an aliphatic group, an aromatic group, a heterocyclic group, a cyano group, —$OR^{81}$, —$SR^{82}$, —$CO_2R^{83}$, —$OCOR^{84}$, —$NR^{85}R^{86}$, —$CONR^{87}R^{88}$, —$SO_2R^{89}$, —$SO_2NR^{90}R^{91}$, —$NR^{92}CONR^{93}R9^{94}$, —$NR^{95}CO_2R^{96}$, —$COR^{97}$, —$NR^{98}COR^{99}$, or —$NR^{100}SO_2R^{101}$; $R^{81}$, $R^{82}$, $R^{83}$, $R^{84}$, $R^{85}$, $R^{86}$, $R^{87}$, $R^{88}$, $R^{89}$, $R^{90}$, $R^{91}$, $R^{92}$, $R^{93}$, $R^{94}$, $R^{95}$, $R^{96}$, $R^{97}$, $R^{98}$, $R^{99}$, $R^{100}$, and $R^{101}$ each independently represent a hydrogen atom, an aliphatic group, or an aromatic group; $R^8$ represents an aliphatic group or an aromatic group; and $R^2$, $R^3$, A, $B^1$, and $B^2$ each have the same meaning as in formula (I).

9. The photothermographic material according to claim 7, wherein the water-insoluble azomethine dye is a compound represented by the following formula (III):

Formula (III)

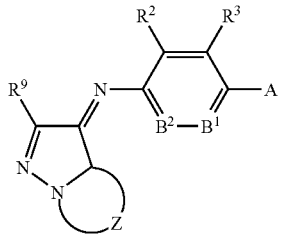

wherein $R^9$ represents a hydrogen atom, an aliphatic group, an aromatic group, a heterocyclic group, a cyano group, —$OR^{11}$, —$SR^{12}$, —$CO_2R^{13}$, —$OCOR^{14}$, —$NR^{15}R^{16}$, —$CONR^{17}R^{18}$, —$SO_2R^{19}$, —$SO_2NR^{20}R^{21}$, —$NR^{22}CONR^{23}R^{24}$, —$NR^{25}CO_2R^{26}$, —$COR^{27}$, —$NR^{28}COR^{29}$, or —$NR^{30}SO_2R^{31}$; $R^{11}$, $R^{12}$, $R^{13}$, $R^{14}$, $R^{15}$, $R^{16}$, $R^{17}$, $R^{18}$, $R^{19}$, $R^{20}$, $R^{21}$, $R^{22}$, $R^{23}$, $R^{24}$, $R^{25}$, $R^{26}$, $R^{27}$, $R^{28}$, $R^{29}$, $R^{30}$, and $R^{31}$ each independently represent a hydrogen atom, an aliphatic group or an aromatic group; Z represents an atomic group which forms a 5- or 6-membered nitrogen-containing heterocycle which may be substituted by at least one of an aliphatic group, an aromatic group, a heterocyclic group, a cyano group, —$OR^{111}$, —$SR^{112}$, —$CO_2R^{113}$, —$OCOR^{114}$, —$NR^{115}R^{116}$, —$CONR^{117}R^{118}$, —$SO_2R^{119}$, —$SO_2NR^{120}R^{121}$, $NR^{122}CONR^{123}R^{124}$, —$NR^{125}CO_2R^{126}$, —$COR^{127}$, —$NR^{128}COR^{129}$, or —$NR^{130}SO_2R^{131}$, and which heterocycle may further form a condensed ring with another ring; $R^{111}$, $R^{112}$, $R^{113}$, $R^{114}$, $R^{115}$, $R^{116}$, $R^{117}$, $R^{118}$, $R^{119}$, $R^{120}$, $R^{121}$, $R^{122}$, $R^{123}$, $R^{124}$, $R^{125}$, $R^{126}$, $R^{127}$, $R^{128}$, $R^{129}$, $R^{130}$, and $R^{131}$ each independently represent a hydrogen atom, an aliphatic group, or an aromatic group; and $R^2$, $R^3$, A, $B^1$ and $B^2$ each have the same meaning as in formula (I).

10. The photothermographic material according to claim 7, wherein the water-insoluble azomethine dye is a compound represented by the following formula (IV):

Formula (IV)

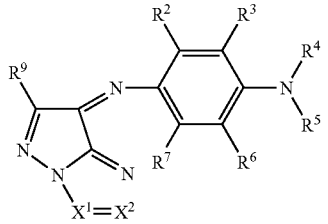

wherein $R^2$, $R^3$, $R^4$, $R^5$, $R^6$, and $R^7$ each have the same meaning as in formula (I); $R^9$ represents a hydrogen atom, an aliphatic group, an aromatic group, a heterocyclic group, a cyano group, —$OR^{11}$, —$SR^{12}$, —$CO_2R^{13}$, —$OCOR^{14}$, —$NR^{15}R^{16}$, —$CONR^{17}R^{18}$, —$SO_2R^{19}$, —$SO_2NR^{20}R^{21}$, —$NR^{22}CONR^{23}R^{24}$, —$NR^{25}CO_2R^{26}$, —$COR^{27}$, —$NR^{28}COR^{29}$, or —$NR^{30}SO_2R^{31}$; $R^{11}$, $R^2$, $R^{13}$, $R^{14}$, $R^{15}$, $R^{16}$, $R^{17}$, $R^{18}$, $R^{19}$, $R^{20}$, $R^{21}$, $R^{22}$, $R^{23}$, $R^{24}$, $R^{25}$, $R^{26}$, $R^{27}$, $R^{28}$, $R^{29}$, $R^{30}$, and $R^{31}$ each independently represent a hydrogen atom, an aliphatic group or an aromatic group; $X^1$ and $X^2$ each independently represent —$C(R^{10})$= or —N=; $R^{10}$ represents a hydrogen atom, an aliphatic group, or an aromatic group; one of $X^1$ and $X^2$ is always —N=; and $X^1$ and $X^2$ are not simultaneously —N=.

11. The photothermographic material according to claim 1, wherein at least one of the water-insoluble azomethine dye or the metal phthalocyanine dye is contained in the image forming layer.

12. The phototherinographic material according to claim 11, wherein the water-insoluble azomethine dye and the metal phthalocyanine dye are contained in the image forming layer.

13. The photothermographic material according to claim 1, wherein one of the water-insoluble azomethine dye or the metal phthalocyanine dye is contained in the image forming layer and the other of them is contained in the non-photosensitive layer.

14. The photothermographic material according to claim 13, wherein the water-insoluble azomethine dye is contained in the image forming layer and the metal phthalocyanine dye is contained in the non-photosensitive layer.

15. The photothermographic material according to claim 1, wherein the water-insoluble azomethine dye is contained in the image forming layer, the metal phthalocyanine dye is contained in the non-photosensitive layer, the metal phthalocyanine dye is a water-soluble dye, and the non-photosensitive layer is a back layer.

16. The photothermographic material according to claim 15, wherein at least one of $R_1$, $R_2$, $R_3$, $R_4$, $R_5$, $R_6$, $R_7$, and $R_8$ in formula (PC-1) is an electron-attracting group represented by the following formula (PC-II):

$$—L^1—R^{17}$$ Formula (PC-II)

wherein $L^1$ represents **—$SO_2$—*, **—$SO_3$—*, **—$SO_2NR_N$—*, **—SO—*, **—CO—*, **—$CONR_N$—*, **—COO—*, **—COCO—*, **—$COCO_2$—*, or **—$COCONR_N$—*; * * denotes a bond with a phthalocyanine skeleton at this position; * denotes a bond with $R^{17}$ at this position; $R_N$ represents a hydrogen atom, an alkyl group, an aryl group, a heterocyclic group, an acyl group, an alkoxycarbonyl group, a carbamoyl group, a sulfonyl group, or a sulfamoyl group; and $R^{17}$ represents a hydrogen atom, an alkyl group, an aryl group, or a heterocyclic group.

17. The photothermographic material according to claim 16, wherein four or more from among $R_1$, $R_2$, $R_3$, $R_4$, $R_5$, $R_6$, $R_7$, and $R_8$ are groups represented by formula (PC-II).

18. The photothermographic material according to claim 16, wherein the at least one group represented by formula (PC-II) includes at least one water-soluble group.

19. The photothermographic material according to claim 1, wherein the image forming layer contains a polymer latex having a glass transition temperature (Tg) of from −50° C. to 45° C.

* * * * *